US009235145B2

(12) United States Patent
Nukada et al.

(10) Patent No.: US 9,235,145 B2
(45) Date of Patent: Jan. 12, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Katsumi Nukada, Kanagawa (JP); Wataru Yamada, Kanagawa (JP); Hidekazu Hirose, Kanagawa (JP); Yuko Iwadate, Kanagawa (JP); Kenji Kajiwara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/036,510

(22) Filed: Sep. 25, 2013

(65) Prior Publication Data

US 2014/0205939 A1 Jul. 24, 2014

(30) Foreign Application Priority Data

Jan. 21, 2013 (JP) ..... 2013-008711

(51) Int. Cl.

*G03G 5/147* (2006.01)
*G03G 5/05* (2006.01)
*G03G 5/06* (2006.01)

(52) U.S. Cl.

CPC ..... *G03G 5/0564* (2013.01); *G03G 5/0535* (2013.01); *G03G 5/0614* (2013.01); *G03G 5/14708* (2013.01); *G03G 5/14721* (2013.01); *G03G 5/14791* (2013.01)

(58) Field of Classification Search

CPC ..... G03G 5/0535; G03G 5/0532; G03G 5/14721; G03G 5/14717; G03G 5/14726; G03G 5/14708; G03G 5/0564

USPC ..... 430/58.7, 59.6, 66

See application file for complete search history.

(56) References Cited

U.S. PATENT DOCUMENTS

| | | | | |
|---|---|---|---|---|
| 5,047,803 | A * | 9/1991 | Kanoto | 399/111 |
| 5,411,827 | A | 5/1995 | Tamura et al. | |
| 5,427,880 | A | 6/1995 | Tamura et al. | |
| 5,456,989 | A | 10/1995 | Nogami et al. | |
| 5,496,671 | A | 3/1996 | Tamura et al. | |
| 5,695,898 | A | 12/1997 | Go et al. | |
| 7,893,185 | B2 * | 2/2011 | Hikosaka et al. | 528/196 |
| 8,808,952 | B2 * | 8/2014 | Iwadate et al. | 430/58.7 |
| 2002/0119382 | A1 | 8/2002 | Nakata et al. | |
| 2004/0043312 | A1 | 3/2004 | Kikuchi et al. | |
| 2004/0248024 | A1 | 12/2004 | Suzuki et al. | |
| 2004/0253527 | A1 | 12/2004 | Suzuki et al. | |
| 2007/0122724 | A1 | 5/2007 | Suzuki et al. | |
| 2007/0178400 | A1 | 8/2007 | Kikuchi et al. | |
| 2008/0020305 | A1 | 1/2008 | Suzuki et al. | |
| 2011/0229809 | A1 * | 9/2011 | Nukada et al. | 430/56 |
| 2013/0052572 | A1 * | 2/2013 | Nukada et al. | 430/56 |

FOREIGN PATENT DOCUMENTS

| | | |
|---|---|---|
| JP | A-62-251757 | 11/1987 |
| JP | A-5-40360 | 2/1993 |
| JP | A-5-216249 | 8/1993 |
| JP | A-7-72640 | 3/1995 |
| JP | A-7-146564 | 6/1995 |
| JP | B2-2852464 | 2/1999 |
| JP | A-2000-19749 | 1/2000 |
| JP | A-2000-206715 | 7/2000 |
| JP | A-2000-206717 | 7/2000 |
| JP | A-2001-166509 | 6/2001 |
| JP | A-2001-175016 | 6/2001 |
| JP | A-2002-82469 | 3/2002 |
| JP | B2-3287678 | 6/2002 |
| JP | A-2004-12986 | 1/2004 |
| JP | A-2004-302450 | 10/2004 |
| JP | A-2005-62301 | 3/2005 |
| JP | A-2005-62302 | 3/2005 |
| JP | A-2006-84711 | 3/2006 |
| JP | A-2006-98728 | 4/2006 |
| JP | A-2006-138956 | 6/2006 |
| JP | A-2007-86522 | 4/2007 |
| JP | B2-4717665 | 7/2011 |

OTHER PUBLICATIONS

Jul. 31, 2014 Office Action issued in U.S. Appl. No. 13/867,604.

* cited by examiner

*Primary Examiner* — Janis L Dote
(74) *Attorney, Agent, or Firm* — Oliff PLC

(57) ABSTRACT

An electrophotographic photoreceptor includes a conductive substrate, and a photosensitive layer provided on the conductive substrate, and an outermost surface layer of the electrophotographic photoreceptor is constituted with a polymerized product or crosslinked product of a composition including at least one selected from reactive compounds represented by the formulae (I) and (II) and a non-reactive charge transporting material, a content of the non-reactive charge transporting material in the composition is from 5% by weight to 40% by weight based on the weight of the outermost surface layer, and a content of the unreacted reactive compound in the outermost surface layer after forming the outermost surface layer is 3% by weight or less based on the weight of the outermost surface layer.

16 Claims, 7 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-008711 filed Jan. 21, 2013.

BACKGROUND

1. Technical Field

The present invention relates to an electrophotographic photoreceptor, a process cartridge, and an image forming apparatus.

2. Related Art

Generally, an electrophotographic image forming apparatus has the following configurations and processes.

That is, the surface of an electrophotographic photoreceptor is charged to desired polarity and potential by a charging unit, and the charge is selectively removed from the charged surface of the electrophotographic photoreceptor by image-wise exposure, thereby forming an electrostatic latent image. The latent image is then developed into a toner image by adhering a toner to the electrostatic latent image by a developing unit, the toner image is transferred onto an transfer medium by a transfer unit, and then the transfer medium is discharged as an image formed material.

Recently, electrophotographic photoreceptors have been increasingly used in the field of copying machines, laser beam printers, and the like in view of advantages of obtaining high printing quality with a high speed.

As electrophotographic photoreceptors used in image forming apparatus, electrophotographic photoreceptors used in the related art, using inorganic photoconductive materials such as selenium, selenium-tellurium alloy, selenium-arsenic alloy, and cadmium sulfide (inorganic photoreceptors) have been known, but recently, organic photoreceptors using organic photoconductive materials having superior advantages in views of low cost, manufacturability, and disposability (organic photoreceptors) are mainly used.

In order to attain a longer lifetime and higher reliability of the electrophotographic photoreceptor, it has been proposed to provide a protective layer on the surface of an electrophotographic photoreceptor to improve the strength.

The materials for forming a protective layer have been proposed.

SUMMARY

According to an aspect of the invention, there is provided an electrophotographic photoreceptor including:

a conductive substrate; and a photosensitive layer provided on the conductive substrate, wherein an outermost surface layer of the electrophotographic photoreceptor is constituted with a polymerized product or crosslinked product of a composition including at least one selected from reactive compounds represented by the formulae (I) and (II) and a non-reactive charge transporting material; a content of the non-reactive charge transporting material in the composition is from 5% by weight to 40% by weight based on the weight of the outermost surface layer; and a content of the unreacted reactive compound in the outermost surface layer after forming the outermost surface layer is 3% by weight or less based on the weight of the outermost surface layer:

(I)

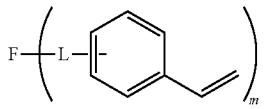

wherein in the formula (I), F represents a charge transporting skeleton; L represents a divalent linking group including two or more selected from the group consisting of an alkylene group, an alkenylene group, C(═O)—, —N(R)—, —S—, and —O—; R represents a hydrogen atom, an alkyl group, an aryl group, or an aralkyl group; And m represents an integer of 1 to 8:

(II)

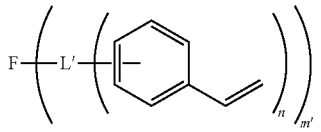

wherein in the formula (II), F represents a charge transporting skeleton; L' represents an (n+1)-valent linking group including two or more selected from the group consisting of a trivalent or tetravalent group derived from an alkane or an alkene, an alkylene group, an alkenylene group, —C(═O)—, —N(R)—, —S—, and —O—; R represents a hydrogen atom, an alkyl group, an aryl group, or an aralkyl group; m' represents an integer of 1 to 6; and n represents an integer of 2 to 3.

BRIEF DESCRIPTION OF THE DRAWINGS

Exemplary embodiments of the present invention will be described in detail based on the following figures, wherein.

DETAILED DESCRIPTION

Figure 1:
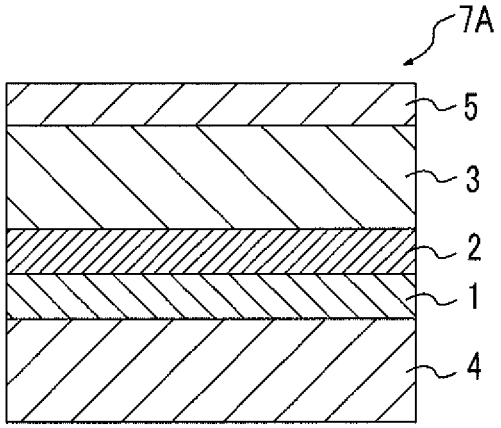
FIG. 1 is a schematic cross-sectional view showing an example of the layer configuration of the electrophotographic photoreceptor according to the present exemplary embodiment.

Hereinbelow, the present exemplary embodiment which is one example of the invention will be described.

Electrophotographic Photoreceptor

The electrophotographic photoreceptor according to the present exemplary embodiment has a conductive substrate, and a photosensitive layer provided on the conductive substrate.

The outermost surface layer is constituted with a polymerized product or crosslinked product of a composition including at least one selected from reactive compounds represented by the formulae (I) and (II) (which may be hereinafter referred to as a "specific reactive group-containing charge transporting material") and a non-reactive charge transporting material. Further, the content of the non-reactive charge transporting material in the composition is from 5% by weight to 40% by weight based on the weight of the outermost surface layer, and the content of the unreacted reactive compound in the outermost surface layer after forming the outermost surface layer is 3% by weight or less based on the weight of the outermost surface layer.

Here, it is only necessary that the outermost surface layer form an outermost surface of the electrophotographic photoreceptor itself, and the outermost surface layer is provided as a layer that functions as a protective layer or a layer that functions as a charge transporting layer. When the outermost surface layer is a layer that functions as a protective layer, the lower layer of the protective layer is a photosensitive layer including a charge transporting layer and a charge generating layer, or a single-layer type photosensitive layer.

Specifically, when the outermost surface layer is a layer that functions as a protective layer, there may be an aspect in which a photosensitive layer (a charge generating layer and a charge transporting layer, or single-layer type photosensitive layer), and a protective layer as an outermost surface layer are provided in this order on a conductive substrate. On the other hand, when the outermost surface layer is a layer that functions as a charge transporting layer, there may be an aspect in which a charge generating layer, and a charge transporting layer as an outermost surface layer are formed in this order on a conductive substrate.

The electrophotographic photoreceptor according to the present exemplary embodiment is excellent in both of electrical characteristics and mechanical strength, the configuration above, even when thickening the outermost surface layer.

The reason therefor is not clear, but is contemplated to be as follows.

First, it is thought that when a polymerized product or crosslinked product of a composition including at least one selected from specific reactive group-containing charge transporting materials (reactive compounds represented by the formulae (I) and (II)) is used in an outermost surface layer, the outermost surface layer has a combination of excellent electrical characteristics and mechanical strength, and the thickening of the outermost surface layer (for example, 7 μm or more) is achieved.

The reason is thought to be that the specific reactive group-containing charge transporting material itself is excellent in the charge transporting performance and has a small number of polar groups disturbing the carrier transport, such as —OH and —NH—, and further, the material is linked with a styryl group having a π electron effective for the carrier transport by polymerization. Therefore, the residual strain is suppressed, and accordingly, formation of a structural trap capturing charges is suppressed.

However, one of the features of the specific reactive group-containing charge transporting material is high reactivity as well as a quick reaction process. Therefore, it is thought that if the reaction proceeds, it is easy to make a state where the specific reactive group-containing charge transporting materials are gathered closely to each other in a reaction field. On the other hand, it is thought that because the specific reactive group-containing charge transporting material move to the center of a reaction field from a distant part of the reaction field, an area where the specific reactive group-containing charge transporting material is rare easily occurs. Specifically, for example, it is thought that since in the case of using a thermal polymerization initiator for the reaction, the reaction proceeds from the radical species generated from the thermal polymerization initiator, a state where the specific reactive group-containing charge transporting materials densely gather in the radical species to be a reaction field is easily created, and an area where the specific reactive group-containing charge transporting materials are rare is easily generated at a position far from the radical species.

That is, the sparseness and denseness of the charge transport components is generated in the outermost surface layer. The sparse (non-dense) part obtained as a result thereof has few charge transporting components, and thus, a large energy barrier is generated with respect to a carrier passing through the part. As the reaction of the specific reactive group-containing charge transporting material progresses completely, the energy barrier of the sparse part increases. Further, it is thought that the energy barrier of the sparse part becomes manifest when the outermost surface layer having an increased volume is thickened. As a result, it is thought that when the energy barrier of this sparse part decreases, the electrical characteristics are further enhanced.

Therefore, it is thought that in the electrophotographic photoreceptor according to the present exemplary embodiment, when the specific reactive group-containing charge transporting materials are used for forming the outermost surface layer and the non-reactive charge transporting materials are used in combination therewith in the above amount, the non-reactive charge transporting materials move relatively freely even during the reaction of the specific reactive group-containing charge transporting material, and thus, is easily excluded from the reaction field. As a result, it is thought that in the outermost surface layer, the non-reactive charge transporting materials are in a state where they are frequently present in the area where the specific reactive group-containing charge transporting materials generated according to the reaction are rare. For this reason, it is thought that the non-reactive charge transporting materials effectively function to reduce the energy barrier. In addition, it is thought that the uneven distribution of the charge transporting materials is suppressed, and thus, the mechanical strength increases.

In particular, it is thought that since the specific reactive group-containing charge transporting material has an aromatic ring, when a compound having an aromatic ring (for example, a triarylamine derivative, a benzidine derivative, a stilbene derivative, and a hydrazone derivative) is applied as a non-reactive charge transporting material, the compatibility among the materials increases. Therefore, it is thought that dispersion of the non-reactive charge transporting materials at a high concentration in the outermost surface layer is achieved, and thus, the electrical characteristics and the mechanical strength are enhanced.

On the other hand, by the addition of the non-reactive charge transporting material, access between the reactive groups of the specific reactive group-containing charge transporting material is hindered, and thus, the reaction is easily suppressed, thereby causing reduction in the mechanical strength in some cases. For this reason, it is thought that by setting the amount of the non-reactive charge transporting material to the above range, and then controlling the weight of the specific reactive group-containing charge transporting material in the outermost surface layer after forming the outermost surface layer to the above range based on the weight of the outermost surface layer, a polymerization (or crosslinking) network of the specific reactive group-containing charge transporting material in the outermost surface layer is obtained, and thus, the mechanical strength is maintained.

As described above, it is contemplated that the electrophotographic photoreceptor according to the present exemplary embodiment has an increase in both of electrical characteristics and mechanical strength even when the outermost surface layer is thickened.

Further, it is contemplated that with an image forming apparatus (or process cartridge) including the electrophotographic photoreceptor according to the present exemplary embodiment, an image having high quality is maintained even when the image is repeatedly formed.

Further, the electrophotographic photoreceptor according to the present exemplary embodiment has a combination of electrical characteristics and mechanical strength, and the thickening of the outermost surface layer (for example, having a thickness of 7 μm or more) is achieved. Thus, the lifetime of the photoreceptor is increased. Since the lifetime of the photoreceptor is determined when the outermost surface layer is worn out, the thickening of the outermost surface layer is effective for a long lifetime.

Furthermore, when the electrophotographic photoreceptor may be used as charged by discharge, at which an electrical load and a load by a discharge gas (for example, ozone) cause deterioration of the constituent materials of the outermost surface layer, and as a result, the discharge product (for example, ionic materials such as ammonium nitrate) is easily adsorbed. Therefore, particularly, moisture is adsorbed under high humidity, the surface resistance on the outermost surface layer decreases, leading to latent image bleeding. As a result, the image deletion easily occurs. In order to suppress the occurrence, it is necessary that the outermost surface layer be worn moderately, thereby suppressing the latent image bleeding. This wear level is greatly affected by a charging type, a cleaning type, a toner shape, or the like, and significantly dependent on the systems, and thus, it is necessary to adjust the strength of the outermost surface layer. In this regard, with the electrophotographic photoreceptor according to the present exemplary embodiment, for example, by choosing the type and amount of reactive compounds before the reaction, the type and amount of non-reactive charge transporting material, and selection of a curing method, adjustment of the mechanical strength of the outermost surface layer is achieved. As a result, even when the image is repeatedly formed, an image having high image quality is maintained.

It is preferable for the electrophotographic photoreceptor according to the present exemplary embodiment to include the resin particles in the outermost surface layer. The reason therefor is not clear, but if the resin particles are included in the outermost surface layer, both of the electrical characteristics and the mechanical strength are easily increased. Particularly, if the resin particles (particularly fluorine resin particles) are included in the outermost surface layer, the surface smoothness, abrasion resistance, and detachability of the toner of the electrophotographic photoreceptor are improved.

For the electrophotographic photoreceptor according to the present exemplary embodiment, a lower layer in contact with the outermost surface layer is preferably configured to include a non-reactive charge transporting material and a polycarbonate copolymer having a solubility parameter as calculated by a Feders method of from 11.40 to 11.75.

Here, the outermost surface layer is formed by coating a coating liquid including the respective materials onto the photosensitive layer (for example, the charge transporting layer) which is a lower layer. However, according to the kind of the solvent used for the preparation of a coating liquid, when coating and forming the outermost surface layer, the binder resin of the photosensitive layer (for example, the charge transporting layer) which is a lower layer is swollen by the solvent of the coating liquid, and the components of the outermost surface layer and the lower layer are mixed, thus leading to reduction in the electrical characteristics and the mechanical strength in some cases.

In particular, in the case where the resin particles are included in the outermost surface layer, when the binder resin of the photosensitive layer which is a lower layer (for example, the charge transporting layer) is swollen, the resin particles may be unevenly distributed on the surface layer side of the outermost surface layer (that is, unevenly distributed at a high concentration) in some cases. If the resin particles are unevenly distributed (unevenly distributed at a high concentration) on the surface layer side of the outermost surface layer, for example, the ratio of the resin components in the surface layer part of the outermost surface layer is decreased and the abrasion resistance at the initial time of use is decreased. Further, the inside (in particular, the side of the lower layer) of the outermost surface layer has a low concentration of the resin particles, and therefore, when the electrophotographic photoreceptor is used for a long period of time, the outermost surface layer is abraded and reaches a low-concentration zone of the resin particles, cleaning failure occurs due to an increase in a load (torque) applied to a cleaning blade, which may deteriorate the image quality.

In this regard, for the lower layer (photosensitive layer (for example, the charge transporting layer)) in contact with the outermost surface layer, a polycarbonate copolymer having a solubility parameter as calculated by a Feders method of from 11.40 to 11.75 is applied as a binder resin. By doing this, the mixing of components of the outermost surface layer with the lower layer is suppressed, and thus, the electrical characteristics and the mechanical strength are easily increased.

In particular, in the case where the resin particles are included in the outermost surface layer, the uneven distribution of the resin particles to the surface layer side of the outermost surface layer is suppressed. That is, the resin particles in the outermost surface layer are easily in a uniformly dispersed state.

The reason therefor is not clear, but is thought to be that if a polycarbonate copolymer having a solubility parameter in the above range is included as a binder resin in the lower layer in contact with the outermost surface layer, the solubility of the polycarbonate copolymer in the solvent of the coating liquid is low when the outermost surface layer is formed, and thus, the binder resin is suppressed from being swollen by the solvent.

Hereinafter, the electrophotographic photoreceptor according to the present exemplary embodiment in the case where the outermost surface layer is a layer that functions as a protective layer will be described in detail with reference to the drawings. In the drawings, the same symbols are provided to the same or corresponding parts, and the overlapping explanations are omitted.

Figure 2:
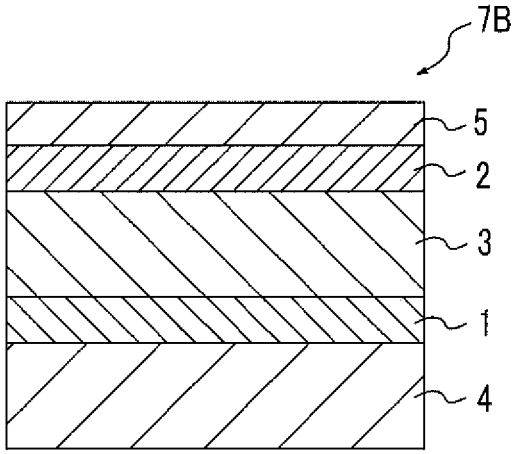
FIG. 2 is a schematic partial cross-sectional view showing another example of the layer configuration of the electrophotographic photoreceptor according to the present exemplary embodiment.
Figure 3:
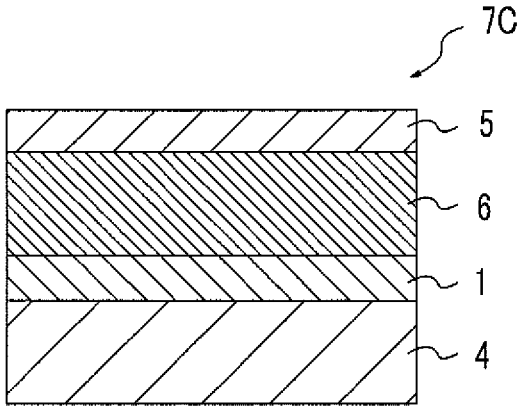
FIG. 3 is a schematic partial cross-sectional view showing still another example of the layer configuration of the electrophotographic photoreceptor according to the present exemplary embodiment.

FIG. 1 is a schematic cross-sectional view showing an example of the electrophotographic photoreceptor according to the present exemplary embodiment. FIGS. 2 and 3 are each a schematic cross-sectional view showing another example of the electrophotographic photoreceptor according to the present exemplary embodiment.

The electrophotographic photoreceptor 7A as shown in FIG. 1 is so-called a function separation type photoreceptor (or a laminated layer type photoreceptor), which has a structure including an undercoat layer 1 provided on a conductive substrate 4, and having a charge generating layer 2, a charge transporting layer 3, and a protective layer 5 formed in this order thereon. In the electrophotographic photoreceptor 7A, a photosensitive layer is constituted with the charge generating layer 2 and the charge transporting layer 3.

The electrophotographic photoreceptor 7B shown in FIG. 2 is a function separation type photoreceptor similar to the electrophotographic photoreceptor 7A shown in FIG. 1, in which the functions are separated into the charge generating layer 2 and the charge transporting layer 3.

The electrophotographic photoreceptor 7B shown in FIG. 2 has a structure including an undercoat layer 1 provided on a conductive substrate 4, and having a charge transporting layer 3, a charge generating layer 2, and a protective layer 5 in this order thereon. In the electrophotographic photoreceptor 7B, a photosensitive layer is constituted with the charge transporting layer 3 and the charge generating layer 2.

The electrophotographic photoreceptor 7C shown in FIG. 3 includes a charge generating material and a charge transporting material in the same layer (single-layer type photosensitive layer 6). The electrophotographic photoreceptor 7C shown in FIG. 3 has a structure including an undercoat layer 1 provided on a conductive substrate 4, and having a single-layer type photosensitive layer 6 and a protective layer 5 in this order thereon.

Furthermore, in each of the electrophotographic photoreceptors 7A, 7B, and 7C shown in FIGS. 1, 2, and 3, the protective layer 5 is the outermost surface layer which is positioned farthest from the conductive substrate 4, and the outermost surface layer is configured as described in the above.

In addition, an underlying layer 1 may or may not be provided in each of the electrophotographic photoreceptors shown in FIGS. 1, 2, and 3.

Hereinbelow, based on the electrophotographic photoreceptor 7A shown in FIG. 1 as a representative example, each of the elements will be described.

Protective Layer

The protective layer 5 (outermost surface layer) is an outermost surface layer in the electrophotographic photoreceptor 7A, which is constituted with a polymerized product or a crosslinked product of a composition including at least one selected from the specific reactive group-containing charge transporting materials and a non-reactive charge transporting material. That is, the protective layer 5 is configured to include a polymerized product or crosslinked product of at least one selected from specific reactive group-containing charge transporting materials and a non-reactive charge transporting material.

Moreover, as a curing method (polymerization/crosslinking method), radical polymerization by heat, light, radiation, or the like is carried out. Since unevenness of the film and occurrence of wrinkles are suppressed by adjusting the reaction not to proceed too quickly, it is preferable to carry out polymerization under the conditions in which generation of radicals occurs relatively slowly. From this viewpoint, thermal polymerization in which the polymerization rate is easily adjusted is suitable.

Further, in the protective layer 5 (outermost surface layer), the content of the non-reactive charge transporting material in the composition is from 5% by weight to 40% by weight based on the weight of the outermost surface layer, and the content of the unreacted reactive compound in the outermost surface layer after forming the outermost surface layer is 3% by weight or less based on the weight of the outermost surface layer.

Here, the content of the non-reactive charge transporting material is preferably from 5% by weight to 37% by weight, and more preferably from 7% by weight to 35% by weight, based on the weight of the protective layer 5 (outermost surface layer).

On the other hand, the content of the unreacted reactive compound in the protective layer 5 (outermost surface layer) after forming the protective layer 5 is preferably 3% by weight or less, and more preferably 2.5% by weight or less, based on the weight of the protective layer 5. Further, the lower limit is preferably 0.01% by weight or more.

The content of the unreacted reactive compound is measured by determining the weight of the reactive compound eluted in tetrahydrofuran (THF) from the protective layer 5 (outermost surface layer) after forming the outermost surface layer. Specifically, the content of the unreacted reactive compound after forming the outermost surface layer is determined by the measurement method shown in [Examples] below.

In addition, the content of the unreacted reactive compound after forming the outermost surface layer is adjusted by, for example, the kind and amount of the reactive compound before the reaction, the kind and amount of the non-reactive charge transporting material, and the curing method.

Specific Reactive Group-Containing Charge Transporting Material

The specific reactive group-containing charge transporting material is at least one selected from the reactive compounds represented by the formulae (I) and (II).

(I)

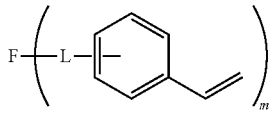

In the formula (I), F represents a charge transporting skeleton.

L represents a divalent linking group including two or more selected from the group consisting of an alkylene group, an alkenylene group, —C(═O)—, —N(R)—, —S—, and —O—. R represents a hydrogen atom, an alkyl group, an aryl group, or an aralkyl group.

m represents an integer of 1 to 8.

(II)

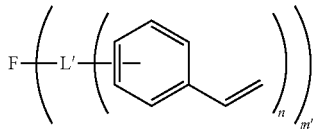

In the formula (II), F represents a charge transporting skeleton.

L' represents an (n+1)-valent linking group including two or more selected from the group consisting of a trivalent or tetravalent group derived from an alkane or an alkene, an alkylene group, an alkenylene group, —C(=O)—, —N(R)—, —S—, and —O—. R represents a hydrogen atom, an alkyl group, an aryl group, or an aralkyl group. Further, the trivalent or tetravalent group derived from an alkane or an alkene means a group formed by the removal of 3 or 4 hydrogen atoms from an alkane or an alkene. The same shall apply hereinafter.

m' represents an integer of 1 to 6. n represents an integer of 2 to 3.

In the formulae (I) and (II), F represents a charge transporting skeleton, that is, a structure having a charge transporting property, specifically, structures having a charge transporting property, such as a phthalocyanine compound, a phorphyrin compound, an azobenzene compound, a triarylamine compound, a benzidine compound, an arylalkane compound, an aryl-substituted ethylene compound, a stilbene compound, an anthracene compound, a hydrazone compound, a quinone compound, and a fluorenone compound.

In the formula (I), examples of the linking group represented by L include:

a divalent linking group having —C(=O)—O— inserted in an alkylene group, a divalent linking group having —C(=O)—N(R)— inserted in an alkylene group, a divalent linking group having —C(=O)—S— inserted in an alkylene group, a divalent linking group having —O— inserted in an alkylene group, a divalent linking group having —N(R)— inserted in an alkylene group, and a divalent linking group having —S— inserted in an alkylene group.

Furthermore, the linking group represented by L may have two groups of —C(=O)—O—, —C(=O)—N(R)—, —C(=O)—S—, —O—, or —S— inserted in an alkylene group.

In the formula (I), specific examples of the linking group represented by L include:

$*—(CH_2)_p—C(=O)—O—(CH_2)_q—$, $*—(CH_2)_p—O—C(=O)—(CH_2)_r—C(=O)—O—(CH_2)_q—$, $*—(CH_2)_p—C(=O)—N(R)—(CH_2)_q—$, $*—(CH_2)_p—C(=O)—S—(CH_2)_q—$, $*—(CH_2)_p—O—(CH_2)_q—$, $*—(CH_2)_p—N(R)—(CH_2)_q—$, $*—(CH_2)_p—S—(CH_2)_q—$, and $*—(CH_2)_p—O—(CH_2)_r—O—(CH_2)_q—$.

Here, in the linking group represented by L, p represents 0, or an integer of 1 to 6 (preferably 1 to 5). q represents an integer of 1 to 6 (preferably 1 to 5). r represents an integer of 1 to 6 (preferably 1 to 5).

Further, in the linking group represented by L, "*" represents a site linked to F.

On the other hand, in the formula (II), examples of the linking group represented by L' include:

an (n+1)-valent linking group having —C(=O)—O— inserted in an alkylene group linked in the branched shape, an (n+1)-valent linking group having —C(=O)—N(R)— inserted in an alkylene group linked in the branched shape, an (n+1)-valent linking group having —C(=O)—S— inserted in an alkylene group linked in the branched shape, an (n+1)-valent linking group having —O— inserted in an alkylene group linked in the branched shape, an (n+1)-valent linking group having —N(R)— inserted in an alkylene group linked in the branched shape, and an (n+1)-valent linking group having —S— inserted in an alkylene group linked in the branched shape.

Furthermore, the linkage represented by L' may have two groups of —C(=O)—O—, —C(=O)—N(R)—, —C(=O)—S—, —O—, or —S— inserted in an alkylene group linked in the branched shape.

In the formula (II), specific examples of the linking group represented by L' include:

$*—(CH_2)_p—CH[C(=O)—O—(CH_2)_q—]_2$, $*—(CH_2)_p—CH=C[C(=O)—O—(CH_2)_q—]_2$, $*—(CH_2)_p—CH[C(=O)—N(R)—(CH_2)_q—]_2$, $*—(CH_2)_p—CH[C(=O)—S—(CH_2)_q—]_2$, $*—(CH_2)_p—CH[(CH_2)_r—O—(CH_2)_q—]_2$, $*—(CH_2)_p—CH=C[(CH_2)_r—O—(CH_2)_q—]_2$, $*—(CH_2)_p—CH[(CH_2)_r—N(R)—(CH_2)_q—]_2$, $*—(CH_2)_p—CH[(CH_2)_r—S—(CH_2)_q—]_2$,

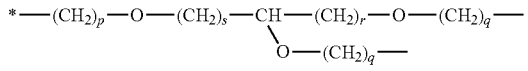

$*—(CH_2)_p—O—C[(CH_2)_r—O—(CH_2)_q—]_3$, and $*—(CH_2)_p—C(=O)—O—C[(CH_2)_r—O—(CH_2)_q—]_3$.

Here, in the linking group represented by L', p represents 0, or an integer of 1 to 6 (preferably 1 to 5). q represents an integer of 1 to 6 (preferably 1 to 5). r represents an integer of 1 to 6 (preferably 1 to 5). s represents an integer of 1 to 6 (preferably 1 to 5).

Further, in the linking group represented by L', "*" represents a site linked to F.

Among these, in the formula (II), the linking group represented by L' is preferably:

$*—(CH_2)_p—CH[C(=O)—O—(CH_2)_q—]_2$, $*—(CH_2)_p—CH=C[C(=O)—O—(CH_2)_q—]_2$, $*—(CH_2)_p—CH[(CH_2)_r—O—(CH_2)_q—]_2$, and $*—(CH_2)_p—CH=C[(CH_2)_r—O—(CH_2)_q—]_2$.

Specifically, the group (corresponding to a group represented by the formula (IIA-a)) linked to the charge transporting skeleton represented by F of the compound represented by the formula (II) may preferably be a group represented by the following formula (IIA-a1), (IIA-a2), (IIA-a3), or (IIA-a4).

(IIA-a1)

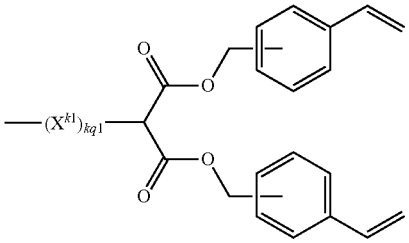

(IIA-a2)

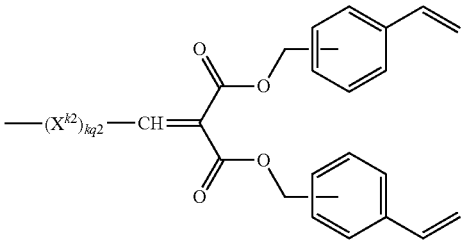

In the formula (IIA-a1) or (IIA-a2), $X^{k1}$ represents a divalent linking group. kq1 represents an integer of 0 or 1. $X^{k2}$ represents a divalent linking group. kq2 represents an integer of 0 or 1.

Here, examples of the divalent linking group represented by $X^{k1}$ and $X^{k2}$ include —$(CH_2)_p$— (provided that p represents an integer of 1 to 6, preferably 1 to 5). Examples of the divalent linking group include an alkyleneoxy group.

(IIA-a3)

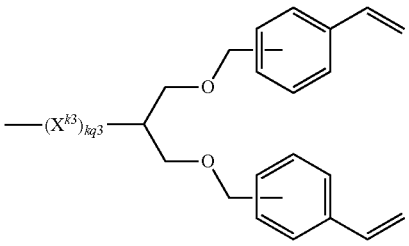

(IIA-a4)

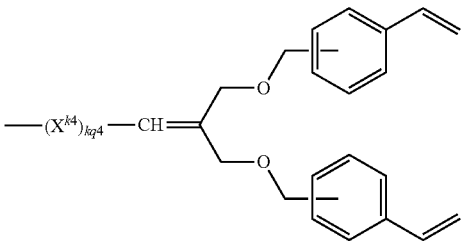

In the formula (IIA-a3) or (IIA-a4), $X^{k3}$ represents a divalent linking group. kq3 represents an integer of 0 or 1. $X^{k4}$ represents a divalent linking group. kq4 represents an integer of 0 or 1. Here, examples of the divalent linking group represented by $X^{k3}$ and $X^{k4}$ include —$(CH_2)_p$— (provided that p represents an integer of 1 to 6, preferably 1 to 5). Examples of the divalent linking group include an alkyleneoxy group.

In the formulae (I) and (II), in the linking groups represented by L and L', examples of the alkyl group represented by R of "—N(R)—" include linear or branched alkyl groups having 1 to 5 carbon atoms (preferably 1 to 4 carbon atoms), and specifically, a methyl group, an ethyl group, a propyl group, and a butyl group.

Examples of the aryl group represented by R of "—N(R)—" include aryl groups having 6 to 15 carbon atoms (preferably 6 to 12 carbon atoms), and specifically, a phenyl group, a tolyl group, a xylidyl group, and a naphthyl group.

Examples of the aralkyl group include aralkyl groups having 7 to 15 carbon atoms (preferably 7 to 14 carbon atoms), and specifically, a benzyl group, a phenethyl group, and a biphenylmethylene group.

In the formulae (I) and (II), m preferably represents an integer of 1 to 6.

m' preferably represents an integer of 1 to 6.

n preferably represents an integer of 2 to 3.

Next, suitable compounds of the reactive compounds represented by the formulae (I) and (II) will be described.

The reactive compounds represented by the formulae (I) and (II) are preferably reactive compounds having a charge transporting skeleton (structure having a charge transporting property) derived from a triarylamine compound as F.

Specifically, as the reactive compound represented by the formula (I), at least one compound selected from the reactive compounds represented by the formula (I-a), (I-b), (I-c), and (I-d) is suitable.

On the other hand, as the reactive compound represented by the formula (II), the reactive compound represented by the formula (II-a) is suitable.

Reactive Compound Represented by Formula (I-a) The reactive compound represented by the formula (I-a) will be described.

If the reactive compound represented by the formula (I-a) is applied as the specific reactive group-containing charge transporting material, the deterioration of the electrical characteristics due to the environmental change is easily suppressed. The reason therefor is not clear, but is thought to be as follows.

First, it may be thought that for the reactive compound having a (meth)acryl group used in the related art, the (meth)acryl group is highly hydrophilic with respect to the skeleton site exhibiting the charge transporting performance during the polymerization. As a result, a certain kind of layer separation state is formed, and thus, the hopping conduction is disturbed. Therefore, it is thought that the charge transporting film including a polymerized product or crosslinked product of a (meth)acryl group-containing reactive compound exhibits deterioration of the efficiency in the charge transport, and further, the partial moisture adsorption or the like causes a decrease in the environmental stability.

Meanwhile, the reactive compound represented by the formula (I-a) has a vinyl chain polymerizable group having low hydrophilicity, and further, has several skeletons exhibiting the charge transporting performance in one molecule, and the skeletons are linked to each other with a flexible linking group having no aromatic ring and conjugate bond such as a covalent double bond. It is thought that such a structure promotes efficient charge transporting performance and high strength, and suppresses the formation of the layer separation state during the polymerization. As a result, it is thought that the protective layer 5 (outermost surface layer) including the polymerized product or crosslinked product of the reactive compound represented by the formula (I-a) is excellent in both of the charge transporting performance and the mechanical strength, and further, the environment dependency (temperature and humidity dependency) of the charge transporting performance may be decreased.

As described above, it is thought that if the reactive compound represented by the formula (I-a) is applied, the deterioration of the electrical characteristics due to the environmental change is easily suppressed.

(I-a)

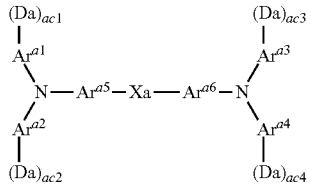

In the formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group formed by a combination of the groups selected from an alkylene group, —O—, —S—, and an ester group. Da represents a group represented by the following formula (IA-a). ac1 to ac4 each independently represent an integer of 0 to 2. Provided that, the total number of Da is 1 or 2.

(IA-a)

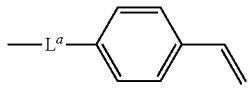

In the formula (IA-a), $L^a$ is represented by *—$(CH_2)_{an}$—O—$CH_2$— and represents a divalent linking group linked to a group represented by $Ar^{a1}$ to $Ar^{a4}$ at *. an represents an integer of 1 or 2.

Hereinafter, the details of the formula (I-a) will be described.

In the formula (I-a), the substituted or unsubstituted aryl groups represented by $Ar^{a1}$ to $Ar^{a4}$ are the same as or different from each other.

Here, examples of the substituents in the substituted aryl group, those other than "Da", include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom.

In the formula (I-a), $Ar^{a1}$ to $Ar^{a4}$ are preferably those represented by any one of the following formulae (1) to (7).

Furthermore, the following formulae (1) to (7) are described together with "-$(D)_c$", which totally refers to "-$(Da)_{ac1}$" to "-$(Da)_{ac1}$" that may be linked to each of $Ar^{a1}$ to $Ar^{a4}$.

(1)

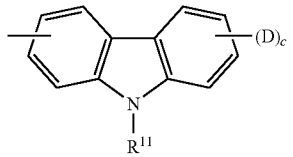

-continued (2)

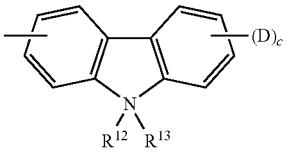

(3)

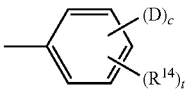

(4)

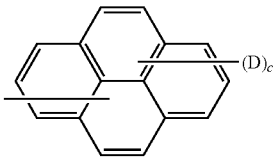

(5)

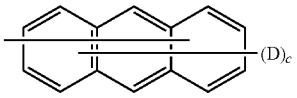

(6)

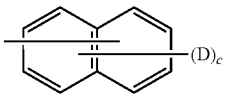

(7)

In the formulae (1) to (7), $R^{11}$ represents one selected from a group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^{12}$ and $R^{13}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. $R^{14}$'s each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. s represents 0 or 1. t represents an integer of 0 to 3. Z' represents a divalent organic linking group.

Here, in the formula (7), Ar is preferably one represented by the following formula (8) or (9).

(8)

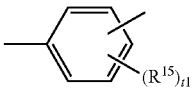

(9)

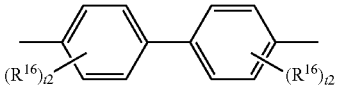

In the formulae (8) and (9), $R^{15}$ and $R^{16}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

Furthermore, in the formula (7), Z' is preferably one represented by any one of the following formulae (10) to (17).

(10) $-(CH_2)_{q1}-$

(11) $-(CH_2CH_2O)_{r1}-$ (12)

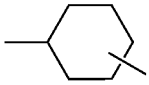

(13)

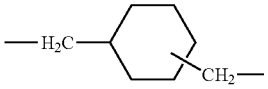

(14)

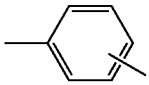

(15)

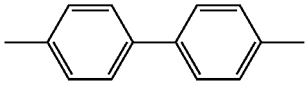

(16)

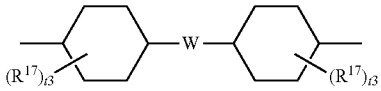

(17)

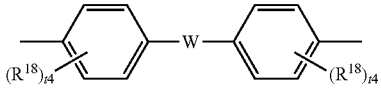

In the formulae (10) to (17), $R^{17}$ and $R^{18}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. W represents a divalent group. q1 and r1 each independently represent an integer of 1 to 10. t3 and t4 each represent an integer of 0 to 3.

In the formulae (16) to (17), W is preferably any one of the divalent groups represented by the following formulae (18) to (26). Provided that, in the formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$

-continued (24)

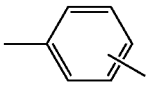

(25)

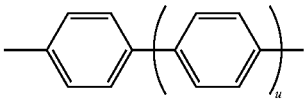

(26)

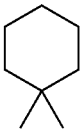

In the formula (I-a), in the substituted or unsubstituted arylene group represented by $Ar^{a5}$ and $Ar^{a6}$, examples of the arylene group include arylene groups formed by the removal of one hydrogen atom at a desired position from the aryl group exemplified in the description of $Ar^{a1}$ to $Ar^{a4}$.

Furthermore, examples of the substituent in the substituted arylene group are the same as those exemplified as the substituent other than "Da" in the substituted aryl group in the description of $Ar^{a1}$ to $Ar^{a4}$.

In the formula (I-a), the divalent linking group represented by Xa is an alkylene group, or a divalent group formed by the combination of the groups selected from alkylene group, —O—, —S—, and an ester group, and is a linking group including no aromatic ring and conjugated bond such as a conjugated double bond.

Specifically, examples of the divalent linking group represented by Xa include an alkylene group having 1 to 10 carbon atoms, as well as a divalent group formed by a combination of an alkylene group having 1 to 10 carbon atoms with a group selected from —O—, —S—, —O—C(=O)—, and —C(=O)—O—.

In addition, when the divalent linking group represented by Xa is an alkylene group, the alkylene group may have a substituent such as alkyl, alkoxy, and halogen, and two of these substituents may be bonded to have the structure such as the divalent linking group represented by the formula (26) described as the specific examples of W in the formulae (16) to (17).

Reactive Compound Represented by Formula (I-b)

The reactive compound represented by the formula (I-b) will be described.

If the reactive compound represented by the formula (I-b) is applied as the specific reactive group-containing charge transporting material, the abrasion of the protective layer 5 (outermost surface layer) is suppressed, and further, the generation of the uneven concentrations of the image is easily suppressed. The reason therefor is not clear, but is thought to be as follows.

First, when the bulky charge transporting skeleton and the polymerization site (styryl group) are structurally close to each other and thus rigid, it is difficult for polymerization sites to move, residual strain due to a curing reaction easily remains, and the charge transporting skeleton is deformed, and therefore, there occurs a change in the level of HOMO (highest occupied molecular orbital) in charge of carrier transport and as a result, a state where the energy distribution spreads (disorder in energy: large σ) is easily caused.

Meanwhile, through a methylene group or an ether group, it is easy to provide the molecular structure with flexibility and a small σ is easily obtained. Further, the methylene group or the ether group has a small dipole moment, as compared with an ester group, an amide group, or the like, and this effect contributes to a decrease in σ, thereby improving the electrical characteristics. Further, by providing the molecular structure with flexibility, the degree of freedom of the movement of the reactive site is increased and the reaction rate is improved, which is thought to yield a film having a high strength.

From these, a structure where a linking chain having sufficient flexibility is inserted between the charge transporting skeleton and the polymerization site is preferable.

Consequently, it is thought that the reactive compound represented by the formula (I-b) has an increased molecular weight of the molecule itself by the curing reaction, it becomes difficult for the weight center to move, and the degree of freedom of the styryl group is high. As a result, it is thought that the protective layer 5 (outermost surface layer) including a polymerized product or crosslinked product of the reactive compound represented by the formula (I-b) has excellent electrical characteristics and high strength.

From the above, if the reactive compound represented by the formula (I-b) is applied, the abrasion of the protective layer 5 (outermost surface layer) is suppressed, and further, the generation of the uneven concentrations of the image is easily suppressed.

(I-b)

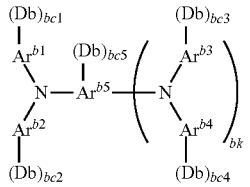

In the formula (I-b), $Ar^{b1}$ to $Ar^{b4}$ each independently represent a substituted or unsubstituted aryl group. $Ar^{b5}$ represents a substituted or unsubstituted aryl group, or a substituted or unsubstituted arylene group. Db represents a group represented by the following formula (IA-b). bc1 to bc5 each independently represent an integer of 0 to 2. bk represents 0 or 1. Provided that, the total number of Db is 1 or 2.

(IA-b)

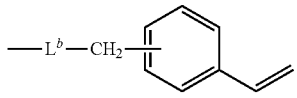

In the formula (IA-b), $L^b$ includes a group represented by $*—(CH_2)_{bn}—O—$ and represents a divalent linking group linked to a group represented by $Ar^{b1}$ to $Ar^{b5}$ at *. bn represents an integer of 3 to 6.

Hereinafter, the details of the formula (I-b) will be described.

In the formula (I-b), the substituted or unsubstituted aryl groups represented by $Ar^{b1}$ to $Ar^{b4}$ are the same as the substituted or unsubstituted aryl groups represented by $Ar^{a1}$ to $Ar^{a4}$ in the formula (I-a).

When bk is 0, $Ar^{b5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When bk is 1, $Ar^{b5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

Next, the details of the formula (IA-b) will be described.

In the formula (IA-b), examples of the divalent linking group represented by $L^b$ include:

$*—(CH_2)_{bp}—O—$, and $*—(CH_2)_{bp}—O—(CH_2)_{bq}—O—$.

Here, in the linking group represented by $L^b$, by represents an integer of 3 to 6 (preferably 3 to 5). bq represents an integer of 1 to 6 (preferably 1 to 5).

Further, in the linking group represented by $L^b$, "*" represents a site linked to a group represented by $Ar^{b1}$ to $Ar^{b5}$.

Reactive Compound Represented by Formula (I-c)

The reactive compound represented by the formula (I-c) will be described.

If the reactive compound represented by the formula (I-c) is applied as the specific reactive group-containing charge transporting material, it is difficult to generate scratches on the surface even when used repeatedly, and further, deterioration of the image quality is easily suppressed. The reason therefor is not clear, but is thought to be as follows.

First, it is thought that film shrinkage accompanying a polymerization reaction or a crosslinking reaction, or aggregation of the charge transporting structure, and the structure in the vicinity of a chain polymerizable group occur when an outermost surface layer including a polymerized product or crosslinked product of the reactive group-containing charge transporting material is formed. Therefore, it is thought that when a mechanic load is applied to an electrophotographic photoreceptor surface due to repeated use, the film itself is abraded or the chemical structure in the molecule is cut, and the film shrinkage or the aggregation state changes, the electrical characteristics as the electrophotographic photoreceptor changes, and thus, deterioration of the image quality occurs.

On the other hand, it is thought that since the reactive compound represented by the formula (I-c) has a styrene skeleton as the chain polymerizable group, the compatibility with an aryl group which is a main skeleton of the charge transporting material is favorable, and the film shrinkage or the aggregation of the charge transporting structure, and the aggregation of the structure in the vicinity of the chain polymerizable group due to the polymerization reaction or the crosslinking reaction is suppressed. As a result, it is thought that the electrophotographic photoreceptor including the protective layer 5 (outermost surface layer) including a polymerized product or crosslinked product of the reactive compound represented by the formula (I-c) suppresses deterioration of the image quality due to the repeated use.

In addition, it is thought that for the reactive compound represented by the formula (I-c), a charge transporting skeleton and a styrene skeleton are linked via a linking group including a specific group such as —C(═O)—, —N(R)—, and —S—, and thus, the interactions between the specific group and a nitrogen atom in the charge transporting skeleton, and between the specific groups, and the like occur, and as a result, it is also thought that the protective layer 5 (outermost surface layer) including a polymerized product or crosslinked product of the reactive compound represented by the formula (I-c) has a further improved strength.

As described above, it is thought that if the reactive compound represented by the formula (I-c) is applied, it is difficult to generate scratches on the surface even when used repeatedly, and further, the deterioration of the image quality is easily suppressed.

In addition, it is thought that a specific group such as —C(=O)—, —N(R)—, —S—, and the like causes deterioration of a charge transport property and deterioration of the image quality under the conditions of high humidity due to its polarity or hydrophilicity, but the reactive compound represented by the formula (I-c) has a styrene skeleton having higher hydrophobicity than (meth)acryl or the like as a chain polymerizable group, and thus, it is not likely to deteriorate the charge transporting property and deterioration of the image quality, such as development of the residual image (ghost) caused by the history of the previous cycle.

(I-c)

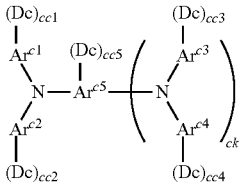

In the formula (I-c), $Ar^{c1}$ to $Ar^{c4}$ each independently represent a substituted or unsubstituted aryl group. $Ar^{c5}$ represents a substituted or unsubstituted aryl group, or a substituted or unsubstituted arylene group. Dc represents a group represented by the following formula (IA-c). cc1 to cc5 each independently represent an integer of 0 to 2. ck represents 0 or 1. Provided that, the total number of Dc is from 1 to 8.

(IA-c)

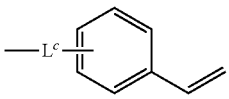

In the formula (IA-c), $L^c$ represents a divalent linking group including one or more groups selected from the group consisting of —C(=O)—, —N(R)—, —S—, or the groups formed by a combination of —C(=O)—, and —O—, —N(R)—, or —S—. R represents a hydrogen atom, an alkyl group, an aryl group, or an aralkyl group.

Hereinafter, the details of the formula (I-c) will be described.

In the formula (I-c), the substituted or unsubstituted aryl groups represented by $Ar^{c1}$ to $Ar^{c4}$ are the same as the substituted or unsubstituted aryl groups represented by $Ar^{a1}$ to $Ar^{a4}$ in the formula (I-a).

When ck is 0, $Ar^{c5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When ck is 1, $Ar^{c5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer 5 (outermost surface layer) having a higher strength, the total number of Dc is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups after forming the outermost surface layer is increased, and thus, the total number of Dc is preferably 7 or less, and more preferably 6 or less.

Next, the details of the formula (IA-c) will be described.

In the formula (IA-c), $L^C$ represents a divalent linking group including one or more groups (hereinafter also referred to as "specific linking groups") selected from the group consisting of —C(=O)—, —N(R)—, —S—, or the groups formed by a combination of —C(=O)—, and —O—, —N(R)—, or —S—.

Here, from the viewpoint of a balance of the strength and the polarity (hydrophilicity/hydrophobicity) of the protective layer 5 (outermost surface layer), the specific linking group is, for example, —C(=O)—, —N(R)—, —S—, —C(=O)—O—, —C(=O)—N(R)—, —C(=O)—S—, —O—C(=O)—O—, —O—C(=O)—N(R)—, preferably —N(R)—, —S—, —C(=O)—O—, —C(=O)—N(H)—, or —C(=O)—O—, and more preferably —C(=O)—O—.

Furthermore, examples of the divalent linking group represented by $L^c$ include divalent linking groups formed by the combination of the specific linking group with a residue of saturated hydrocarbon (including linear, branched, or cyclic ones) or aromatic hydrocarbon, and an oxygen atom, and in particular, divalent linking groups formed by the combination of the specific linking group with a residue of a linear saturated hydrocarbon and an oxygen atom.

The total number of the carbon atoms included in the divalent linking group represented by $L^c$ is, for example, from 1 to 20, and preferably from 2 to 10, from the viewpoint of the density of a styrene skeleton in the molecule and the chain polymerization reactivity.

In the formula (IA-c), specific examples of the divalent linking group represented by $L^c$ include:

$*—(CH_2)_{cp}—C(=O)—O—(CH_2)_{cq}—$, $*—(CH_2)_{cp}—O—C(=O)—(CH_2)_{cr}—C(=O)—O—(CH_2)_{cq}—$, $*—(CH_2)_{cp}—C(=O)—N(R)—(CH_2)_{cq}—$, $*—(CH_2)_{cp}—C(=O)—S—(CH_2)_{cq}—$, $*—(CH_2)_{cp}—N(R)—(CH_2)_{cq}—$, and $*—(CH_2)_{cp}—S—(CH_2)_{cq}—$.

Here, in the linking group represented by $L^c$, cp represents 0, or an integer of 1 to 6 (preferably 1 to 5). cq represents an integer of 1 to 6 (preferably 1 to 5). cr represents an integer of 1 to 6 (preferably 1 to 5).

Furthermore, in the linking group represented by $L^c$, "*" represents a site linked to a group represented by $Ar^{c1}$ to $Ar^{c5}$.

Among these, in the formula (IA-c), the divalent linking group represented by $L^c$ is preferably $*—(CH_2)_{cp}—C(=O)—O—CH_2—$. That is, the group represented by the formula (IA-c) is preferably a group represented by the following formula (IA-c1). Provided that, in the formula (IA-c1), cp1 represents an integer of 0 to 4.

(IA-c1)

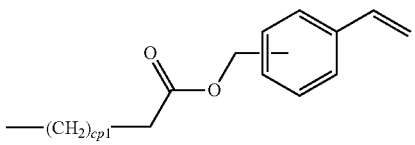

Reactive Compound Represented by Formula (I-d)

The reactive compound represented by the formula (I-d) will be described.

If the reactive compound represented by the formula (I-d) is applied as the specific reactive group-containing charge transporting material, the abrasion of the protective layer 5 (outermost surface layer) is suppressed, and further, the generation of the uneven concentrations of the image is easily suppressed. The reason therefor is not clear, but is thought to be the same as for the reactive compound represented by the formula (I-b).

Particularly, it is thought that since the reactive compound represented by the formula (I-d) has a total number of Dd of 3 to 8, larger than that of the formula (I-b), in the crosslinked product formed, a more highly crosslinked structure (crosslinked network) is easily formed, and the abrasion of the protective layer 5 (outermost surface layer) is more easily suppressed.

(I-d)

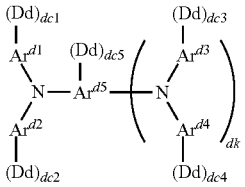

In the formula (I-d), $Ar^{d1}$ to $Ar^{d4}$ each independently represent a substituted or unsubstituted aryl group. $Ar^{d5}$ represents a substituted or unsubstituted aryl group, or a substituted or unsubstituted arylene group. Dd represents a group represented by the following formula (IA-d). dc1 to dc5 each independently represent an integer of 0 to 2. dk represents 0 or 1. Provided that, the total number of Dd is from 3 to 8.

(IA-d)

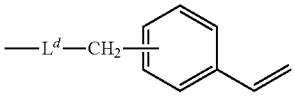

In the formula (IA-d), $L^d$ includes a group represented by $*—(CH_2)_{dn}—O—$, and represents a divalent linking group linked to a group represented by $Ar^{d1}$ to $Ar^{d5}$ at *. do represents an integer of 1 to 6.

Hereinafter, the details of the formula (I-d) will be described.

In the formula (I-d), the substituted or unsubstituted aryl groups represented by $Ar^{d1}$ to $Ar^{d4}$ are the same as the substituted or unsubstituted aryl groups represented by $Ar^{a1}$ to $Ar^{a4}$ in the formula (I-a).

When dk is 0, $Ar^{d5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When dk is 1, $Ar^{d5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

The total number of Dd is preferably 4 or more, from the viewpoint of obtaining a protective layer 5 (outermost surface layer) having a higher strength.

Next, the details of the formula (IA-d) will be described.

In the formula (IA-d), examples of the divalent linking group represented by $L^d$ include:

$*—(CH_2)_{dp}—O—$, and $*—(CH_2)_{dp}—O—(CH_2)_{dq}—O—$.

Here, in the linking group represented by $L^d$, dp represents an integer of 1 to 6 (preferably 1 to 5). dq represents an integer of 1 to 6 (preferably 1 to 5).

Furthermore, in the linking group represented by $L^d$, "*" represents a site linked to a group represented by $Ar^{d1}$ to $Ar^{d5}$.

Reactive Compound Represented by Formula (II-a)

The reactive compound represented by the formula (II-a) will be described.

When the reactive compound represented by the formula (II) (in particular, the formula (II-a)) is applied as the specific reactive group-containing charge transporting material, the deterioration of the electrical characteristics is easily suppressed even when used repeatedly for a long period of time. The reason therefor is not clear, but is thought to be as follows.

First, the reactive compound represented by the formula (II) (in particular, the formula (II-a)) is a compound having 2 or 3 chain polymerizable reactive groups (styrene groups) via one linking group from the charge transporting skeleton.

Consequently, it is thought that the reactive compound represented by the formula (II) (in particular, the formula (II-a)) hardly causes strain in the charge transporting skeleton when polymerized or crosslinked by the presence of the linking group while maintaining high curing degrees and number of crosslinked moieties, and excellent charge transporting performance is also easily satisfied with a high curing degree.

Furthermore, the charge transporting compound having a (meth)acryl group, which has been used in the related art, easily causes strain as described above, the reactive site has high hydrophilicity, and the charge transporting site has high hydrophobicity, and as a result, a microscopic phase separation (microphase separation) easily occurs. However, it is thought that the reactive compound represented by the formula (II) (in particular, the formula (II-a)) has a styrene group as a reactive group, and further, it has a structure having a linking group that hardly causes strain in the charge transporting skeleton when cured (crosslinked), the reactive site and the charge transporting site are both hydrophobic, and the phase separation hardly occurs, and as a result, efficient charge transporting performance and high strength are promoted. As a result, it is thought that the protective layer 5 (outermost surface layer) including the polymer or crosslinked form of the reactive compound represented by the formula (II) (in particular, the formula (II-a)) has excellent mechanical strength as well as superior charge transporting performance (electrical characteristics).

As a result, if the reactive compound represented by the formula (II) (in particular, the formula (II-a)) is applied, it is thought that the deterioration of the electrical characteristics even when used repeatedly for a long period of time is easily suppressed.

(II-a)

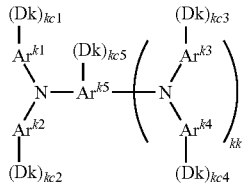

In the formula (II-a), $Ar^{k1}$ to $Ar^{k4}$ each independently represent a substituted or unsubstituted aryl group. $Ar^{k5}$ represents a substituted or unsubstituted aryl group, or a substituted or unsubstituted arylene group. Dk represents a group represented by the following formula (IIA-a). kc1 to kc5 each independently represent an integer of 0 to 2. kk represents 0 or 1. Provided that, the total number of Dk is from 1 to 8.

(IIA-a)

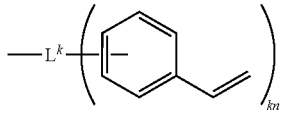

In the formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—. R represents a hydrogen atom, an alkyl group, an aryl group, or an aralkyl group. kn represents an integer of 2 to 3.

Hereinafter, the details of the formula (II-a) will be described.

In the formula (II-a), the substituted or unsubstituted aryl groups represented by $Ar^{k1}$ to $Ar^{k4}$ are the same as the substituted or unsubstituted aryl groups represented by $Ar^{a1}$ to $Ar^{a4}$ in the formula (I-a).

When kk is 0, $Ar^{k5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When kk is 1, $Ar^{k5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer 5 (outermost surface layer) having a higher strength, the total number of Dk is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups after forming the outermost surface layer is increased, and thus, the total number of Dk is preferably 7 or less, and more preferably 6 or less.

Next, the details of the formula (IIA-a) will be described.

In the formula (IIA-a), the (kn+1)-valent linking group represented by $L^k$ is the same as, for example, the (n+1)-valent linking group represented by L' in the formula (II-a).

Next, the specific example of the specific reactive group-containing charge transporting material are shown.

Specifically, specific examples of the charge transporting skeleton F (for example, a site corresponding to the skeleton excluding Da in the formula (I-a) and Dk in the formula (II-a)) of the formulae (I) and (II), and specific examples of the functional group linked to the charge transporting skeleton F (for example, the site corresponding to Da in the formula (I-a) and Dk in the formula (II-a)), as well as specific examples of the reactive compounds represented by the formulae (I) and (II) are shown below, but are not limited thereto.

Furthermore, the "*" moiety of the specific examples of the charge transporting skeleton F of the formulae (I) and (II) means that the "*" moiety of the functional group linked to the charge transporting skeleton F is linked.

That is, for example, the exemplary compound (I-b)-1 is shown as a specific example of the charge transporting skeleton F: (M1)-1 and a specific example of the functional group: (R2)-1, but the specific structures are shown as the following structures.

(I-b)-1

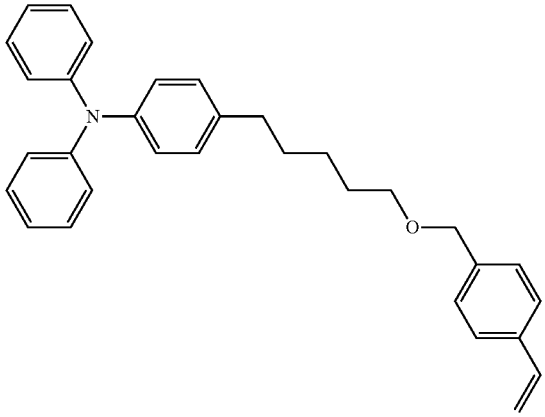

First, specific examples of the charge transporting skeleton F are shown below.

(M1)-1

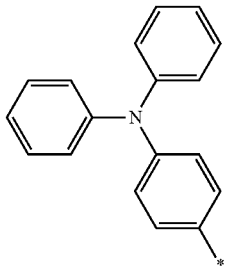

(M1)-2

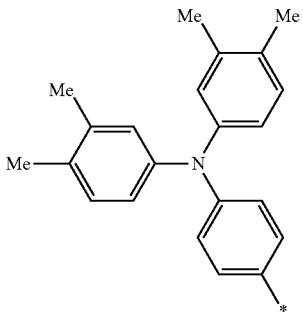

-continued
(M1)-3
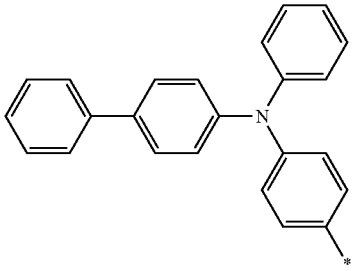
(M1)-4
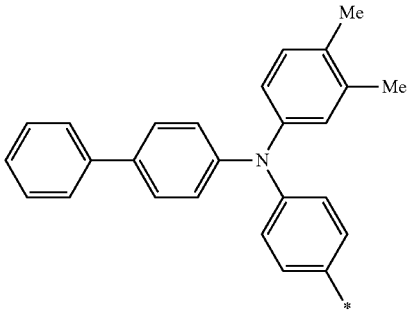
(M1)-5
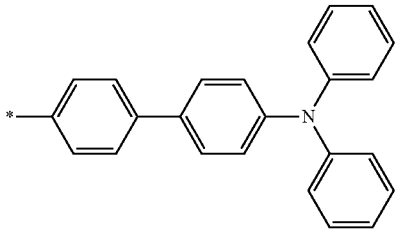
(M1)-6
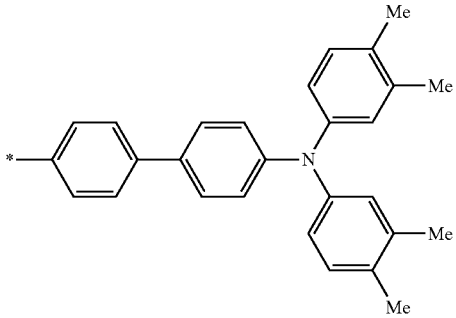
(M1)-7
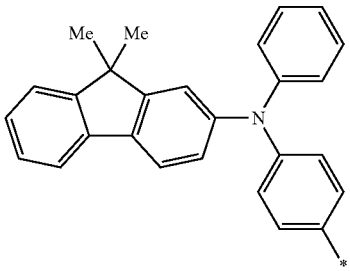
-continued
(M1)-8
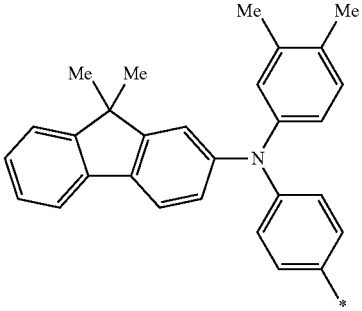
(M1)-9
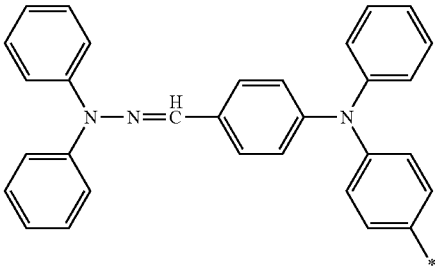
(M1)-10
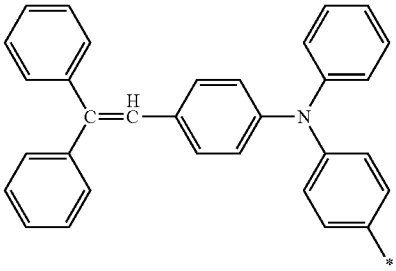
(M1)-11
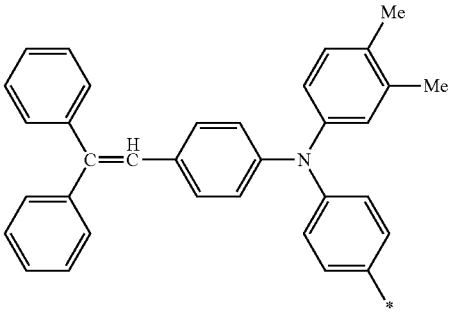
(M1)-12
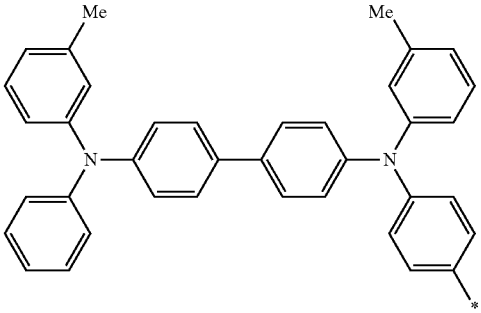

-continued
(M1)-13
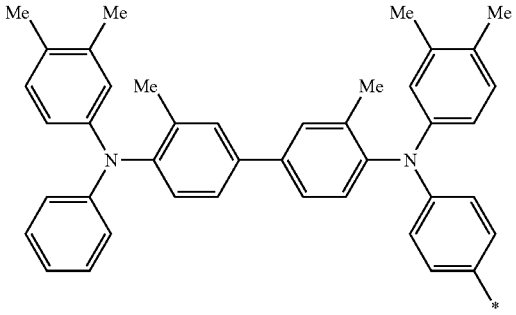
(M1)-14
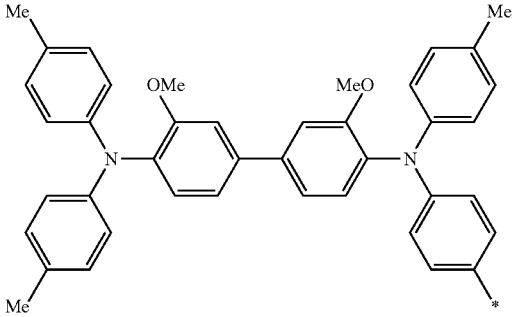
(M1)-15
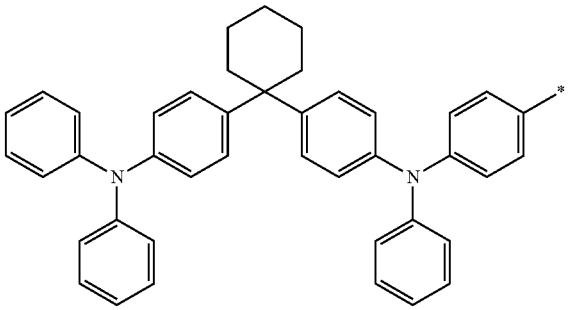
(M1)-16
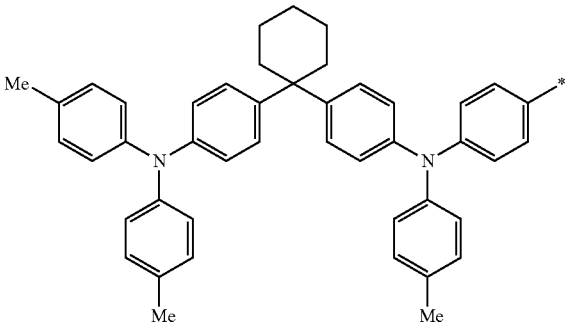
(M1)-17
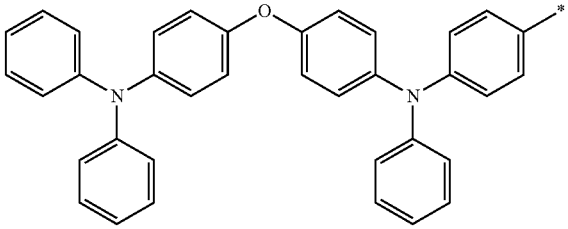
-continued
(M1)-18
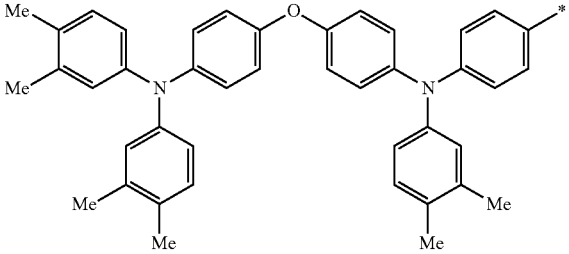
(M1)-19
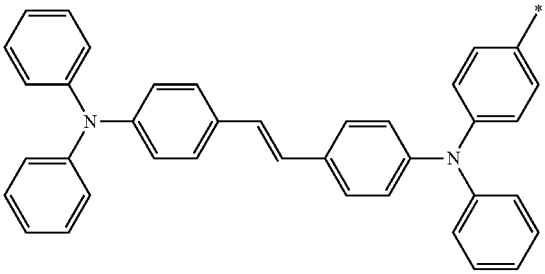
(M1)-20
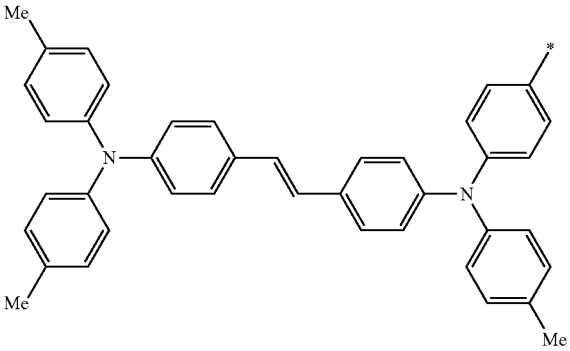
(M1)-21
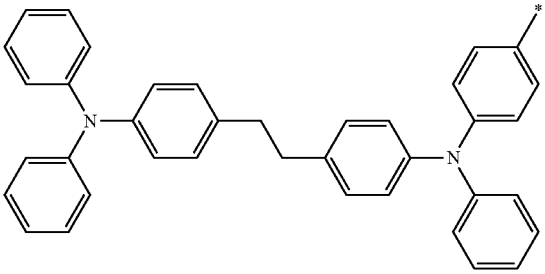
(M1)-22
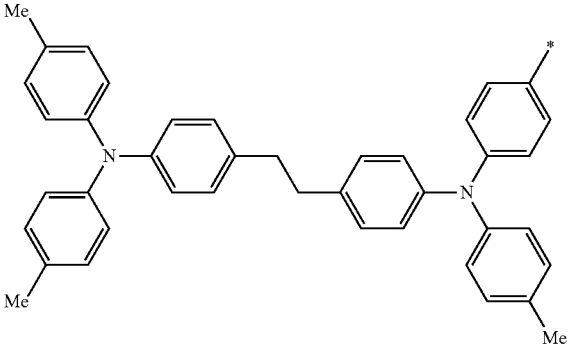

-continued
(M2)-1
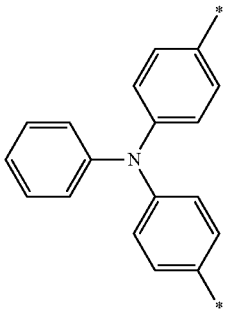
(M2)-2
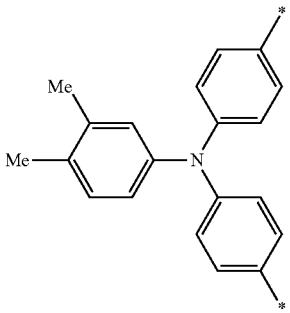
(M2)-3
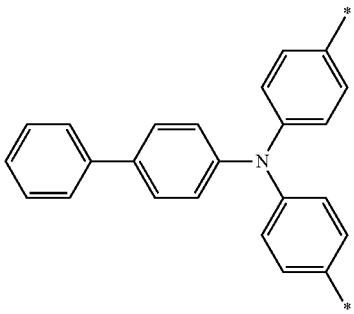
(M2)-4
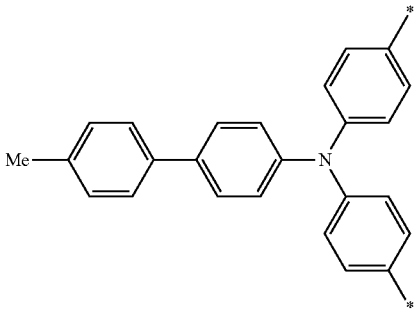
(M2)-5
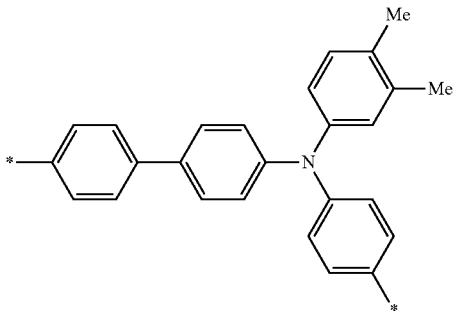
-continued
(M2)-6
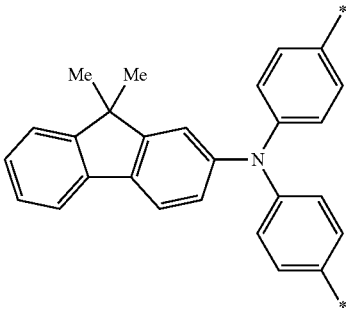
(M2)-7
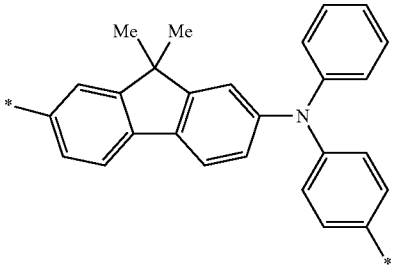
(M2)-8
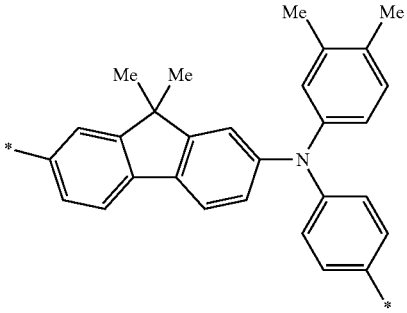
(M2)-9
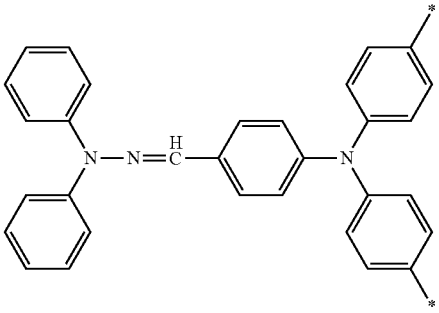
(M2)-10
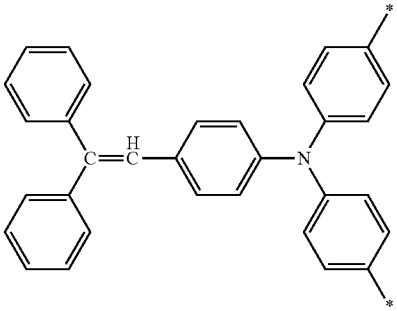

-continued
(M2)-11
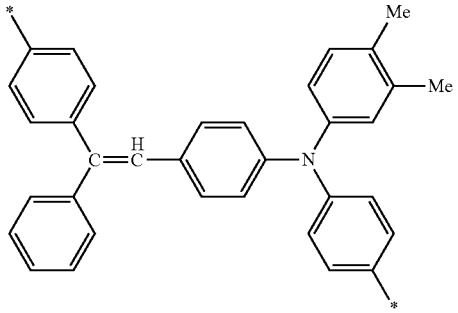
(M2)-12
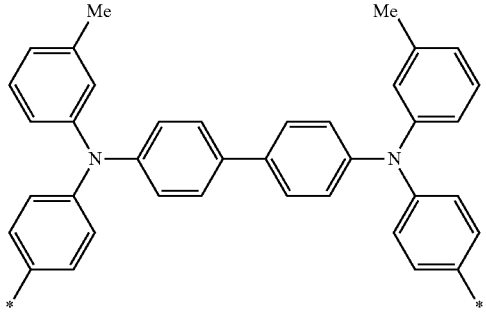
(M2)-13
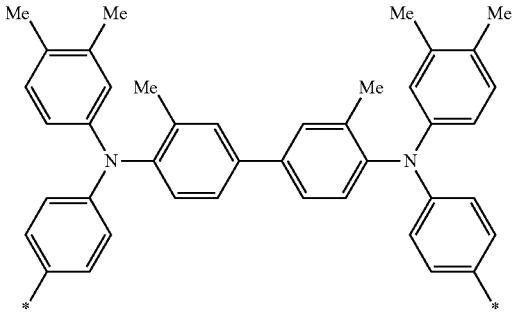
(M2)-14
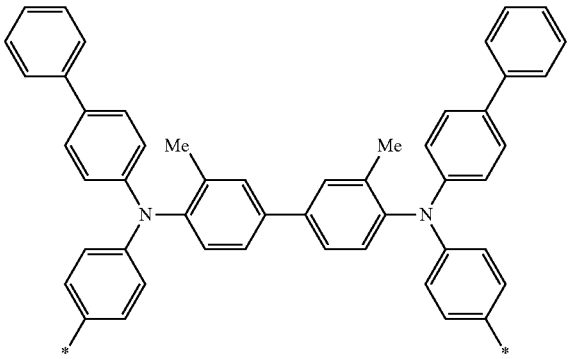
-continued
(M2)-15
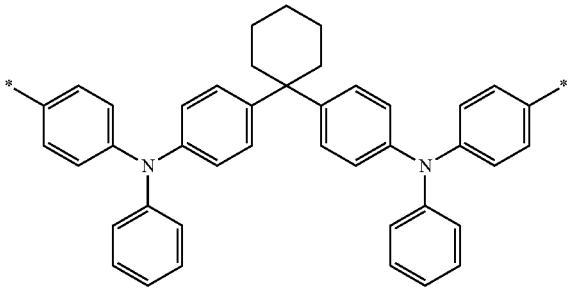
(M2)-16
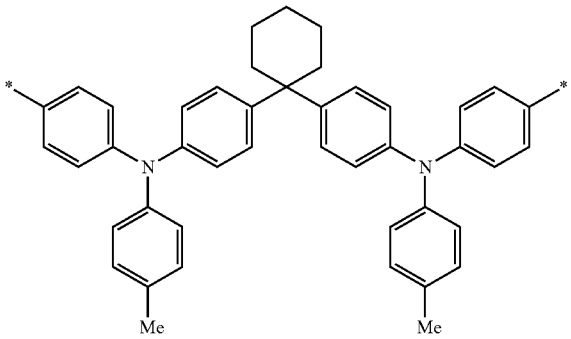
(M2)-17
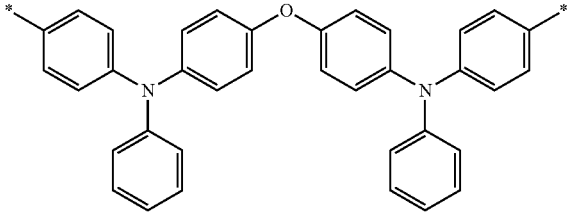
(M2)-18
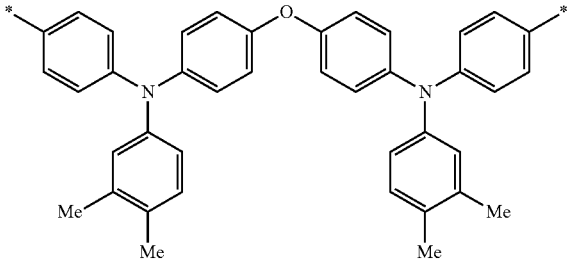
(M2)-19
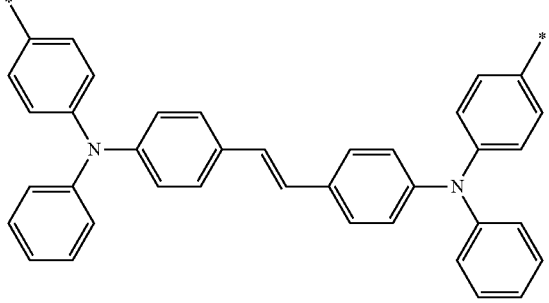

-continued
(M2)-20
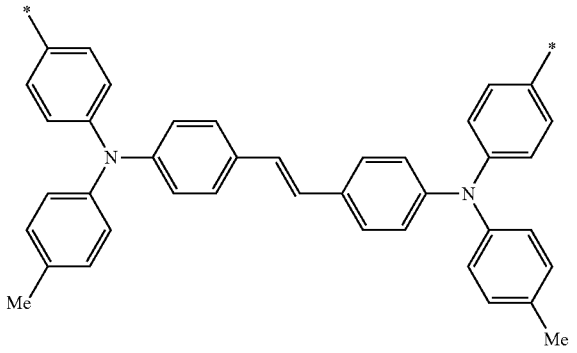
(M2)-21
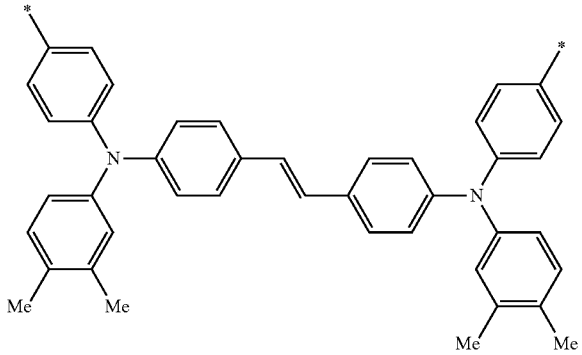
(M2)-22
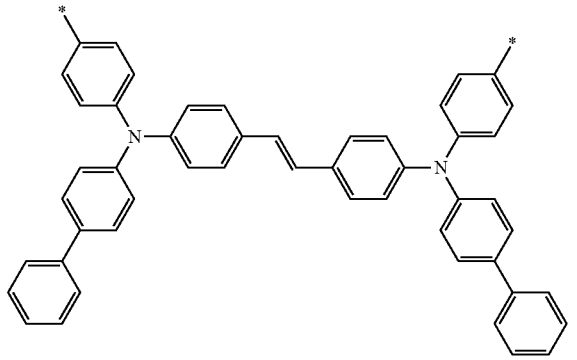
(M2)-23
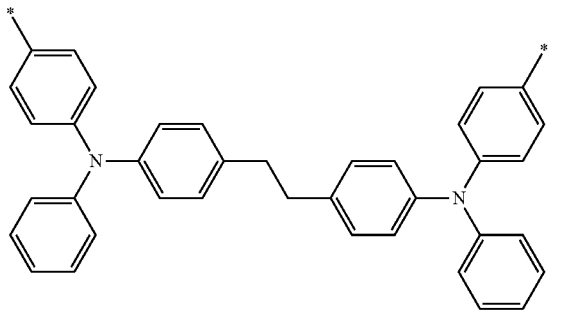
-continued
(M2)-24
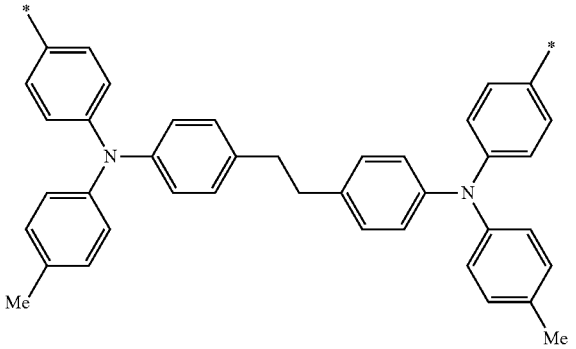
(M2)-25
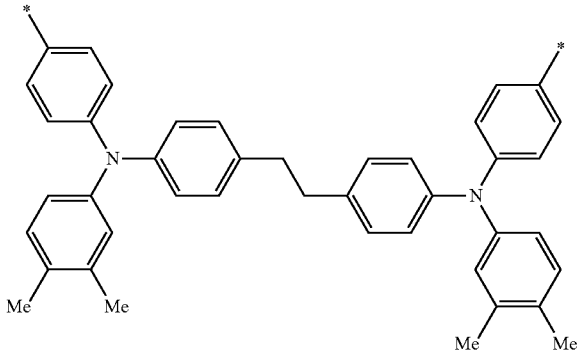
(M2)-26
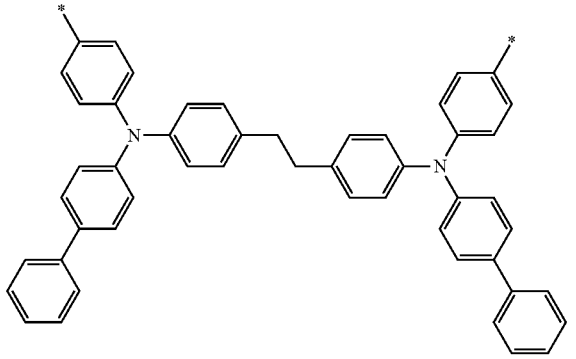
(M2)-27
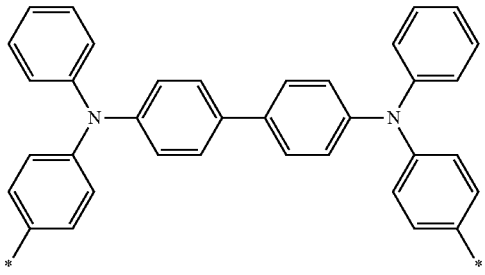

-continued
(M3)-1
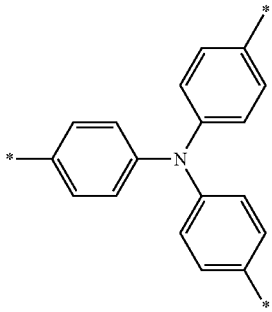
(M3)-2
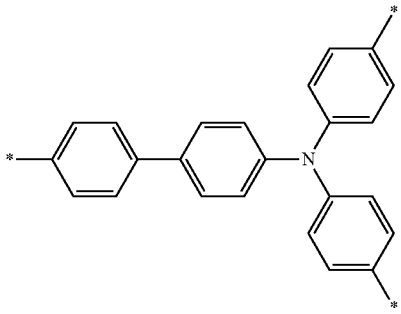
(M3)-3
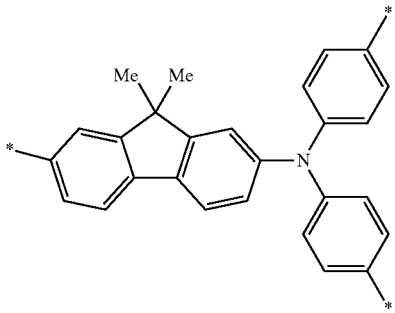
(M3)-4
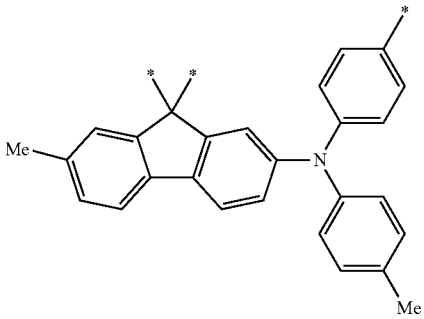
(M3)-5
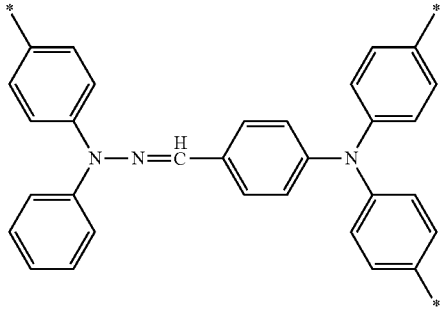
-continued
(M3)-6
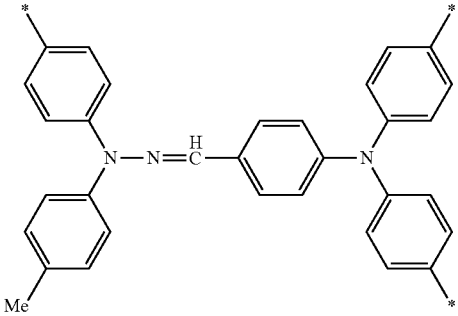
(M3)-7
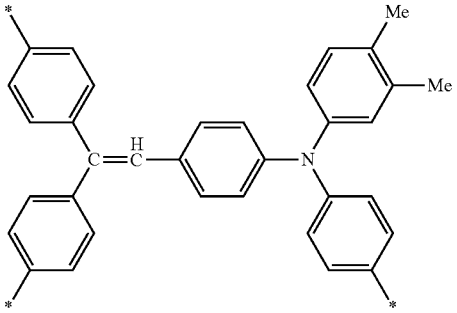
(M3)-8
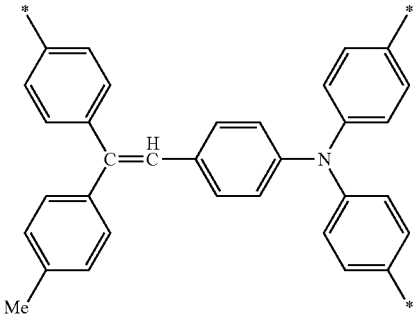
(M3)-9
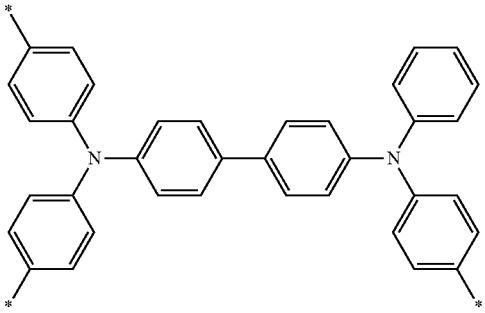
(M3)-10
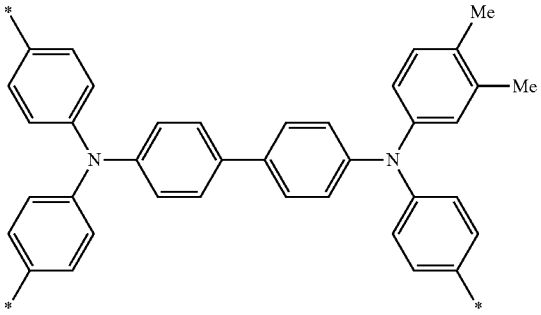

-continued
(M3)-11
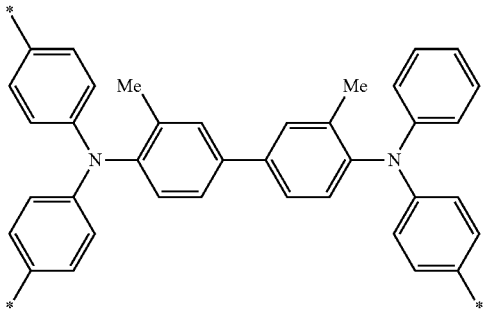
(M3)-12
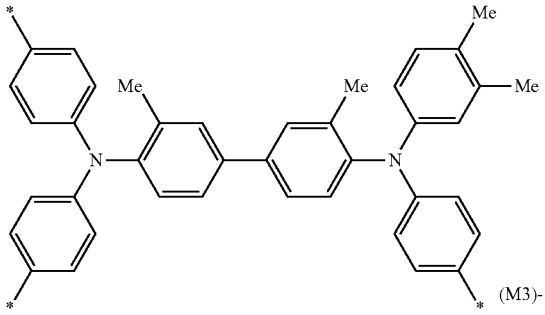
(M3)-13
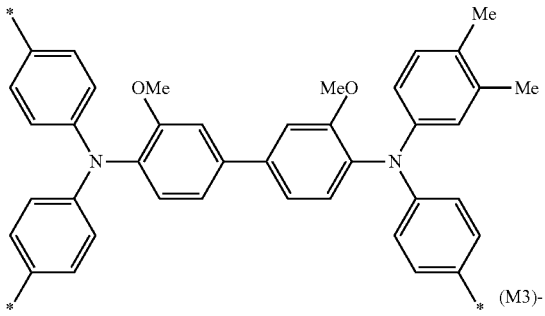
(M3)-14
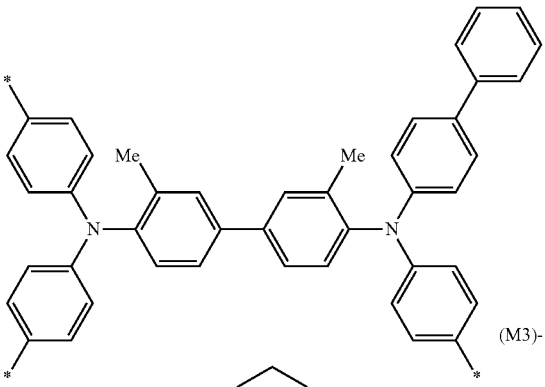
(M3)-15
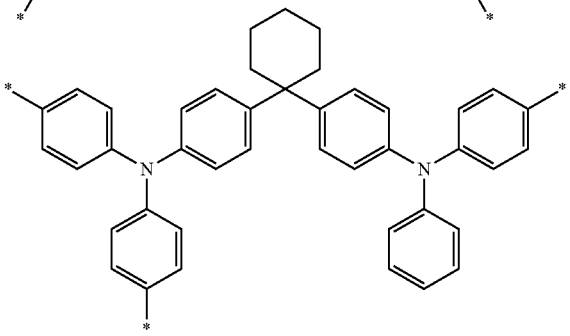
-continued
(M3)-16
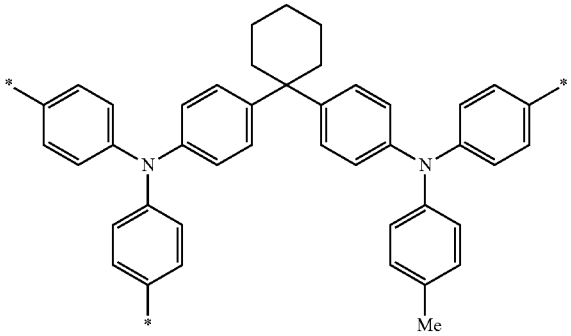
(M3)-17
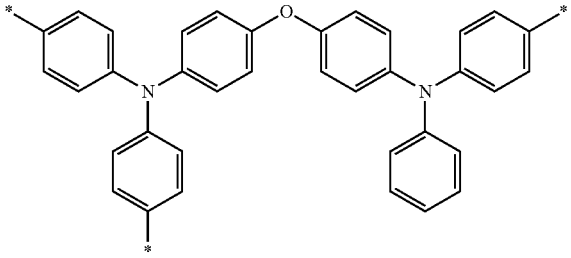
(M3)-18
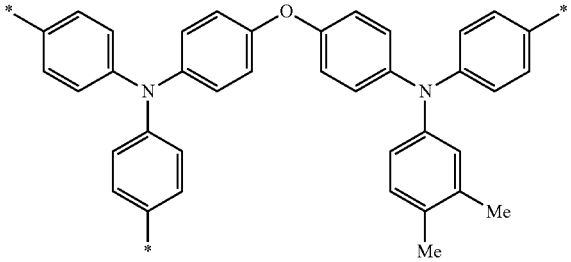
(M3)-19
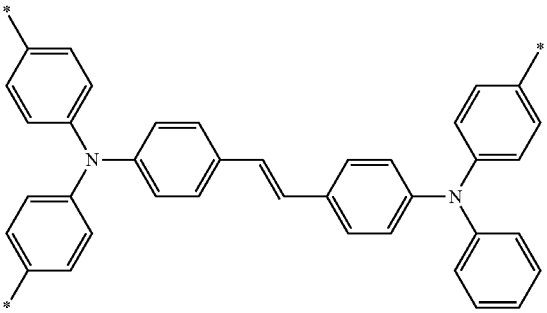
(M3)-20
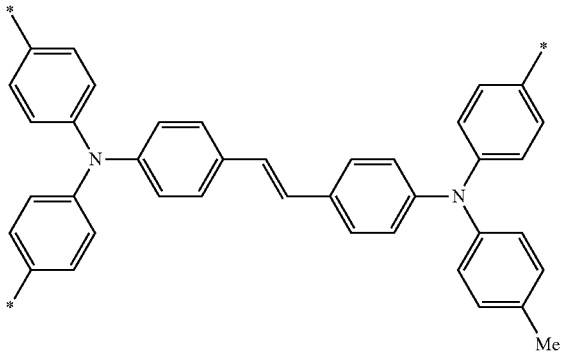

-continued
(M3)-21
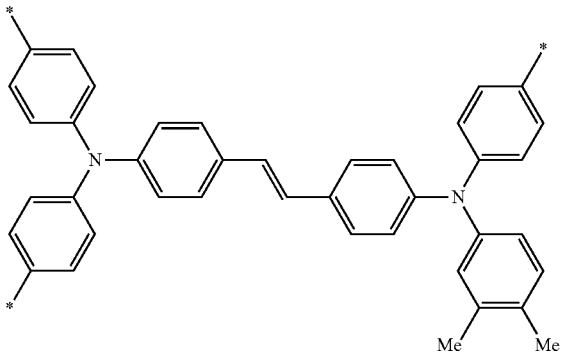
(M3)-22
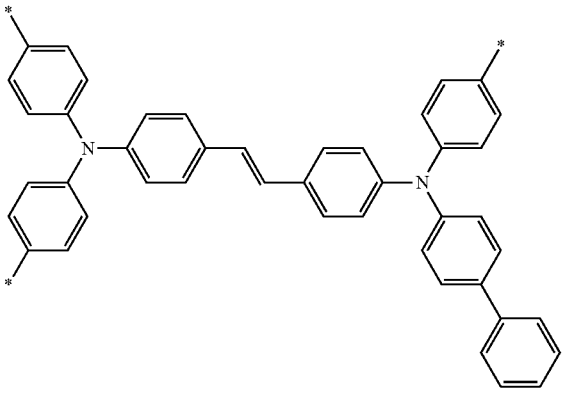
(M3)-23
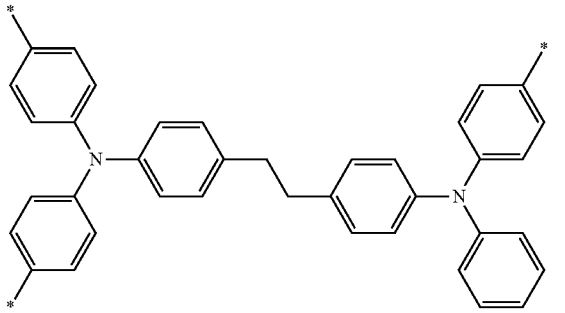
(M3)-24
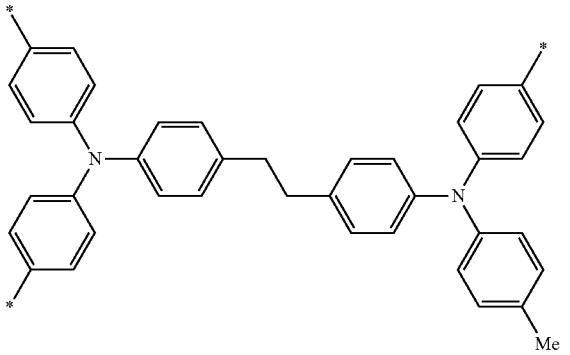
-continued
(M3)-25
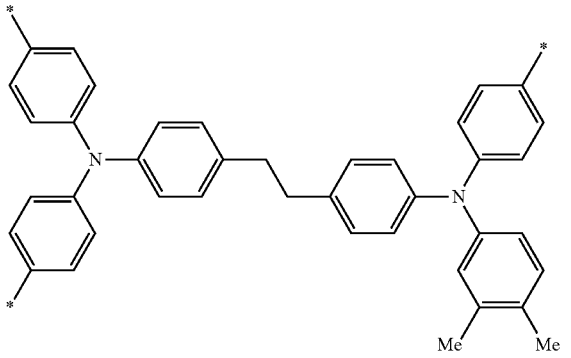
(M3)-26
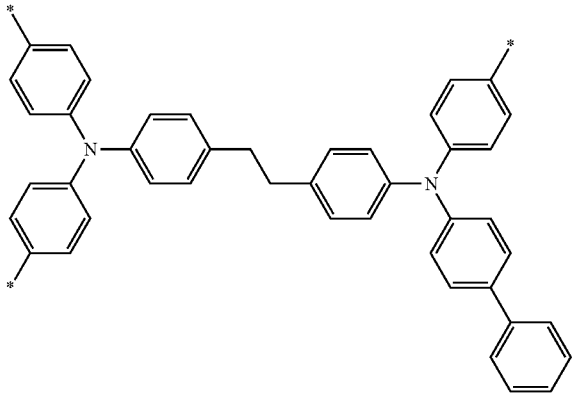
(M4)-1
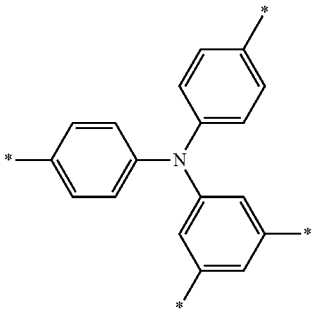
(M4)-2
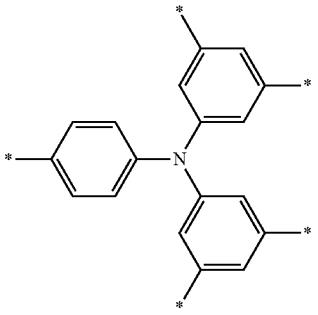

-continued
(M4)-3
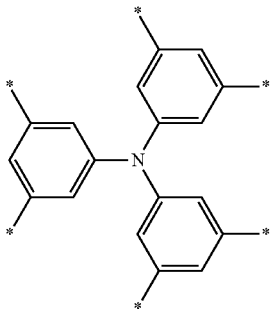
(M4)-4
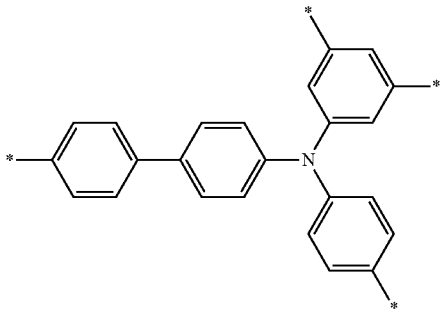
(M4)-5
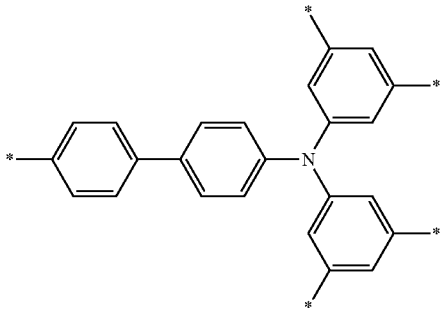
(M4)-6
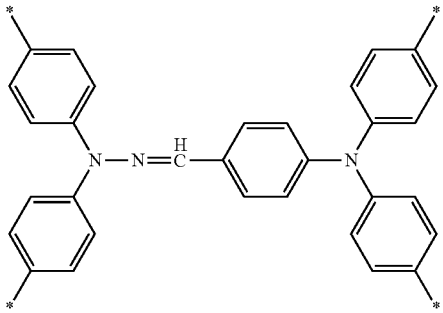
(M4)-7
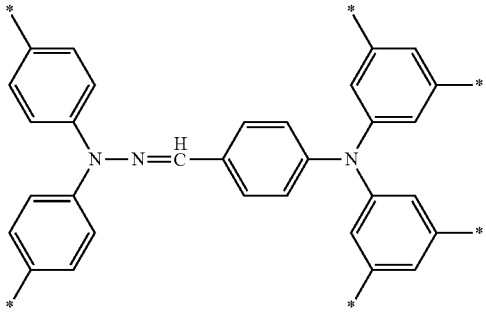
-continued
(M4)-8
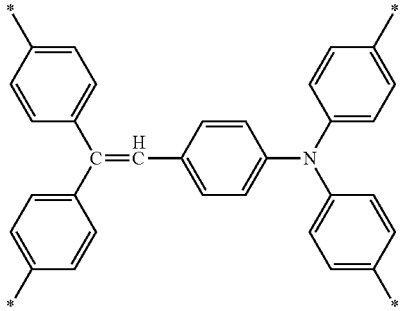
(M4)-9
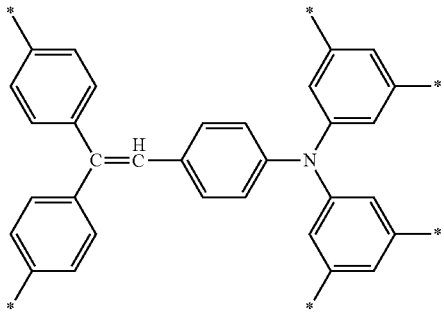
(M4)-10
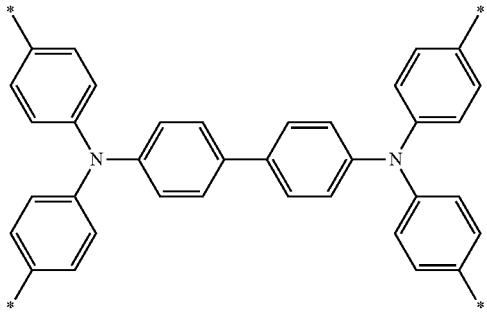
(M4)-11
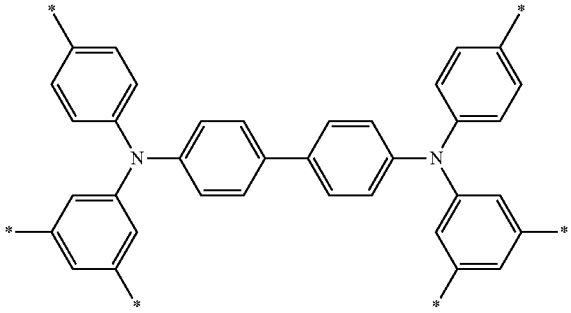
(M4)-12
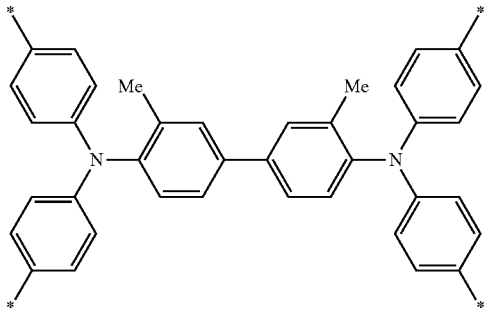

-continued
(M4)-13
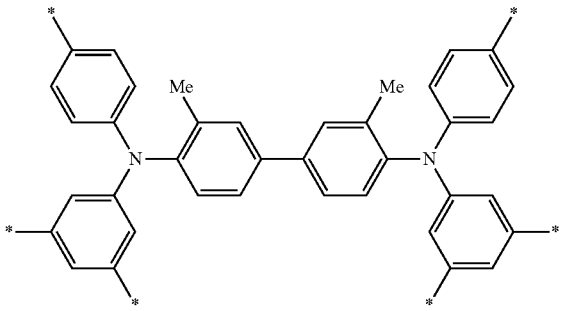
(M4)-14
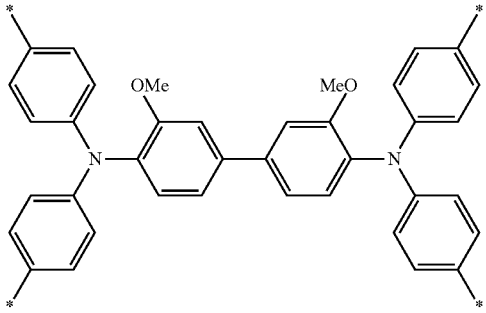
(M4)-15
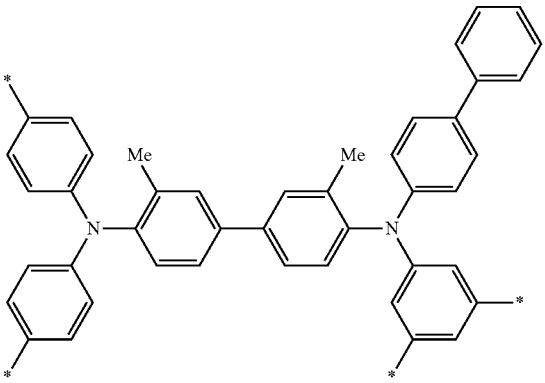
(M4)-16
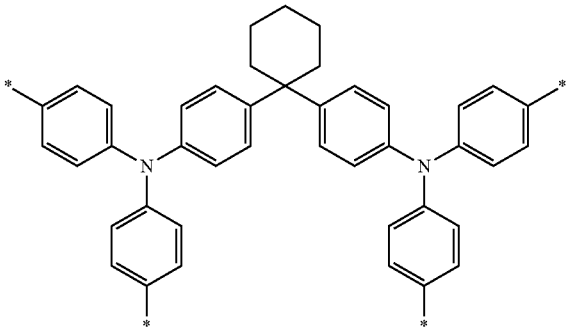
-continued
(M4)-17
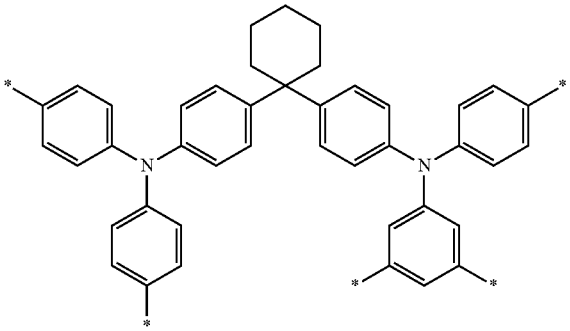
(M4)-18
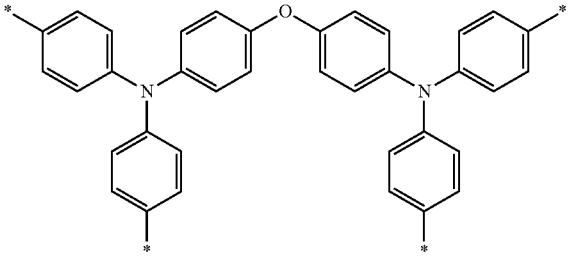
(M4)-19
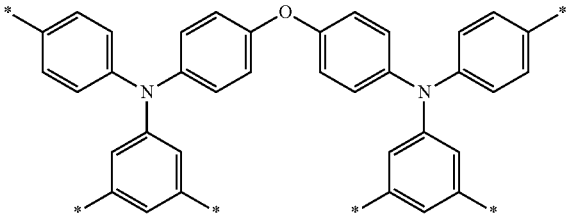
(M4)-20
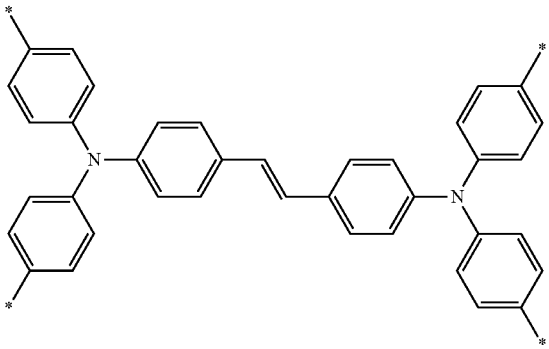
(M4)-21
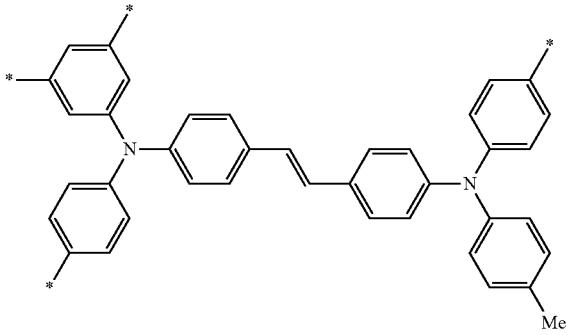

-continued
(M4)-22
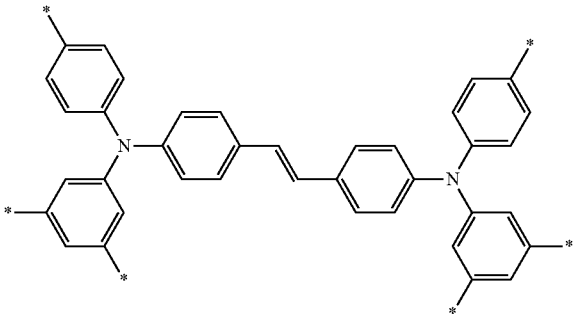
(M4)-23
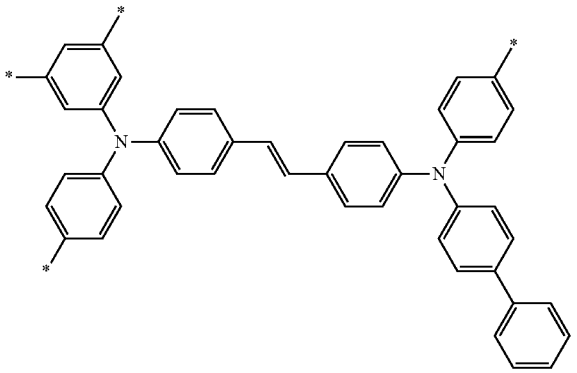
(M4)-24
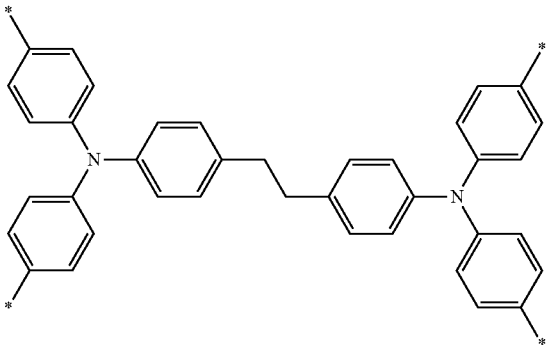
(M4)-25
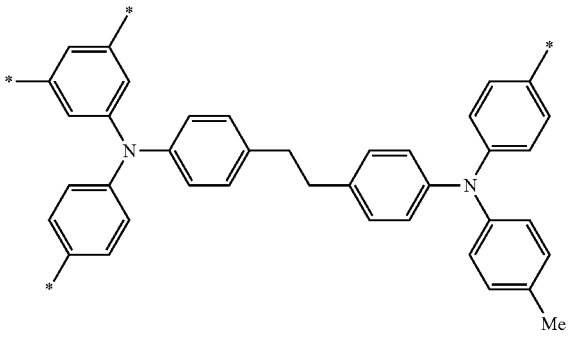
-continued
(M4)-26
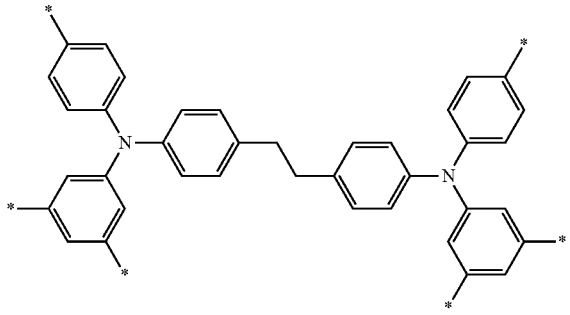
(M4)-27
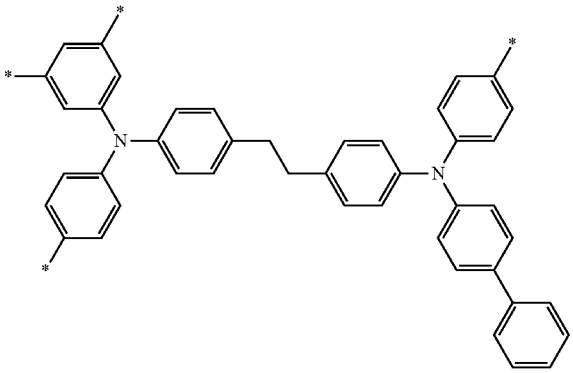
(M4)-28
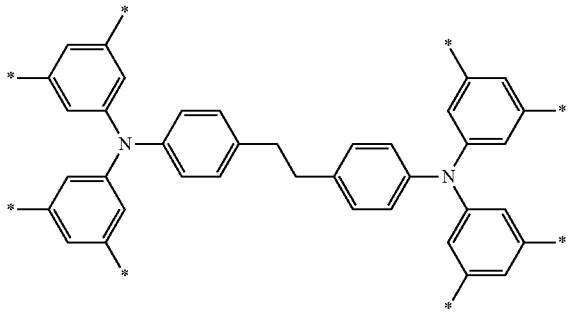
Next, specific examples of the functional group linked to the charge transporting skeleton F are shown.
(R1)-1
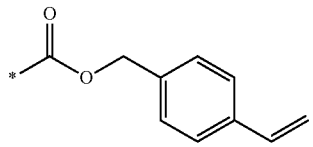
(R1)-2
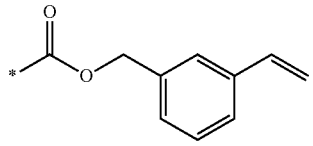

-continued
(R1)-3
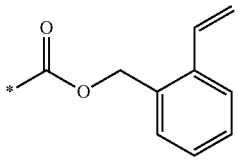
(R1)-4
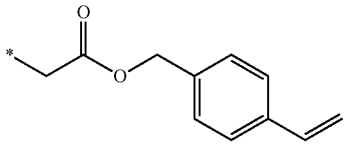
(R1)-5
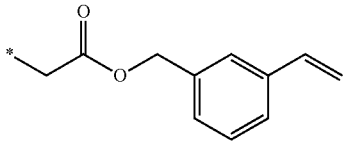
(R1)-6
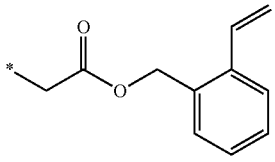
(R1)-7
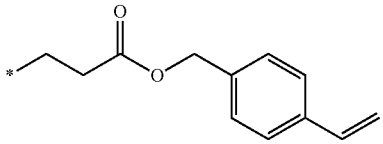
(R1)-8
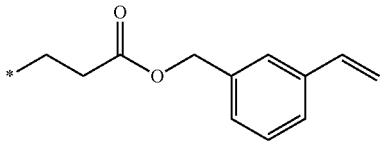
(R1)-9
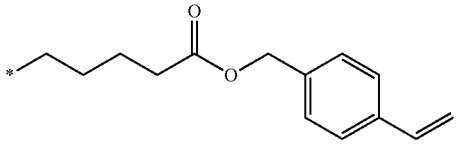
(R1)-10
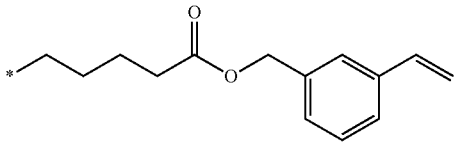
(R1)-11
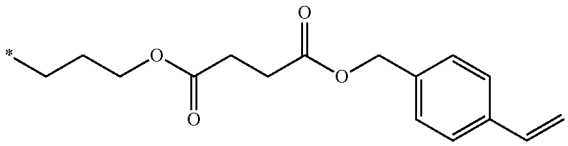
(R1)-12
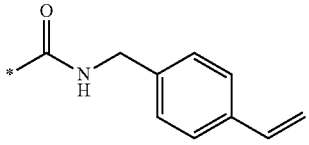
-continued
(R1)-13
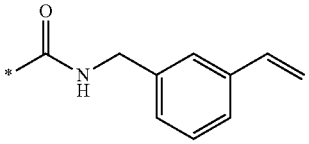
(R1)-14
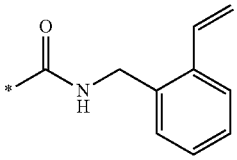
(R1)-15
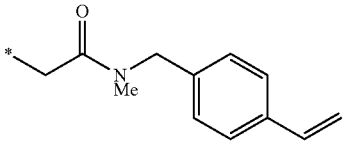
(R1)-16
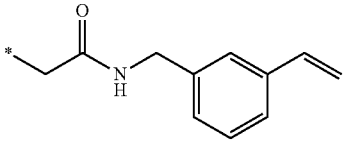
(R1)-17
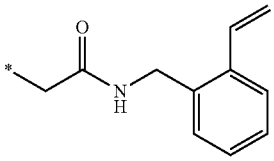
(R1)-18
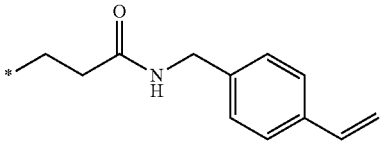
(R1)-19
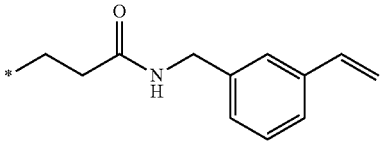
(R1)-20
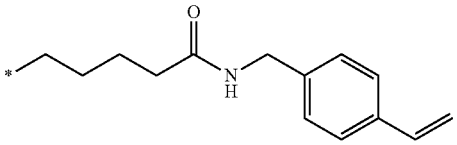
(R1)-21
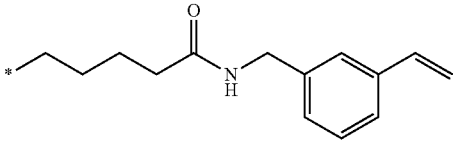
(R1)-22
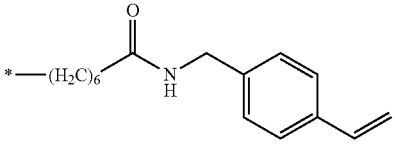

-continued
(R1)-23
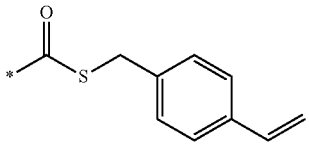
(R1)-24
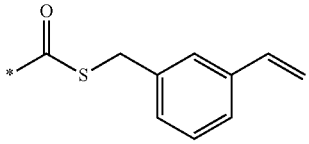
(R1)-25
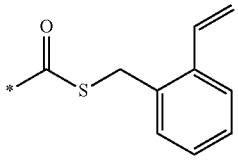
(R1)-26
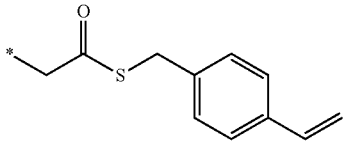
(R1)-27
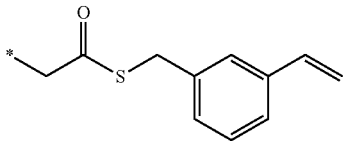
(R1)-28
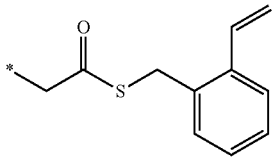
(R1)-29
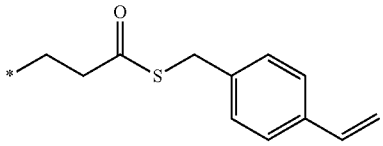
(R1)-30
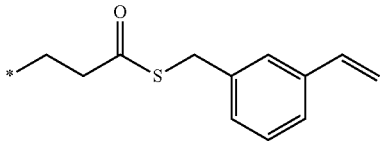
(R1)-31
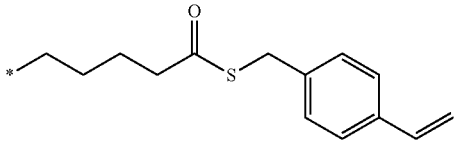
(R1)-32
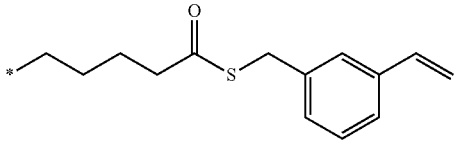
-continued
(R1)-33
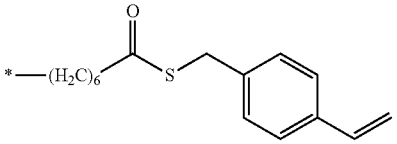
(R1)-34
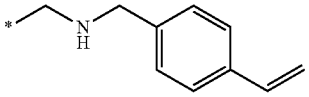
(R1)-35
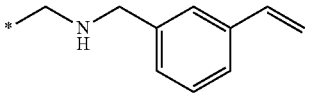
(R1)-36
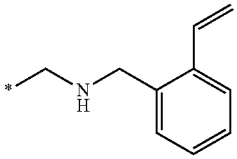
(R1)-37
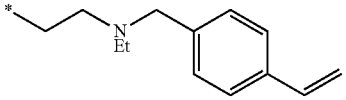
(R1)-38
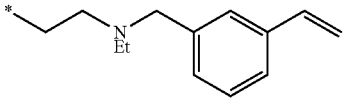
(R1)-39
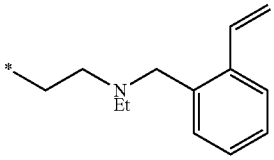
(R1)-40
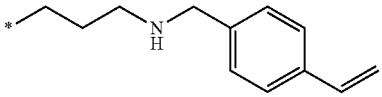
(R1)-41
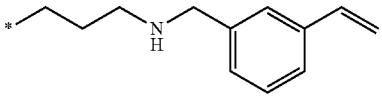
(R1)-42
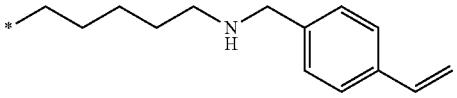
(R1)-43
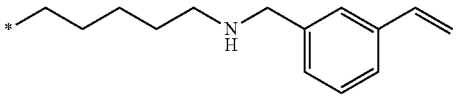
(R1)-44
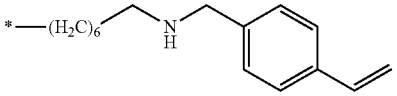
(R1)-45
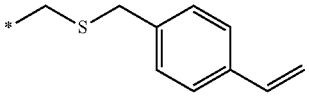

-continued
(R1)-46
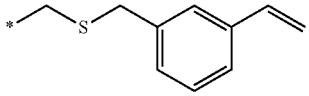
(R1)-47
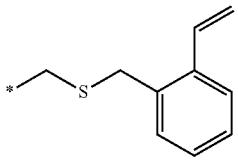
(R1)-48
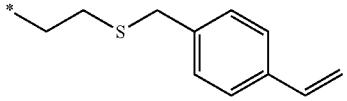
(R1)-49
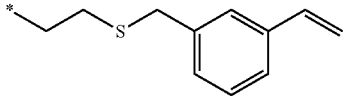
(R1)-50
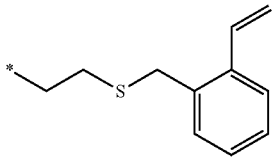
(R1)-51
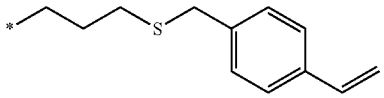
(R1)-52
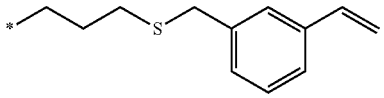
(R1)-53
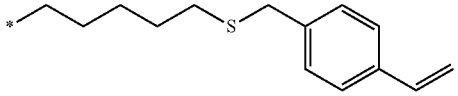
(R1)-54
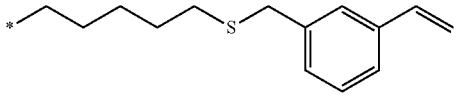
(R1)-55
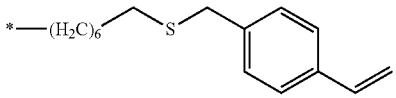
(R2)-1
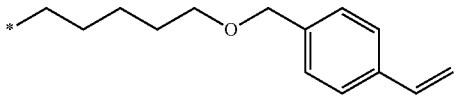
(R2)-2
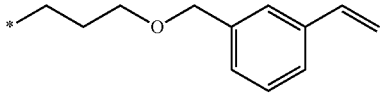
(R2)-3
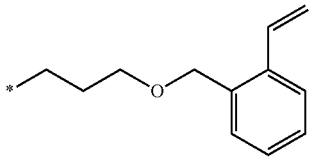
-continued
(R2)-4
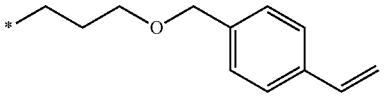
(R2)-5
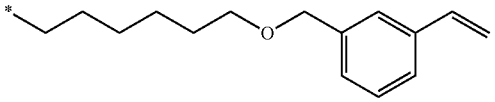
(R2)-6
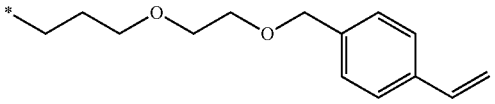
(R2)-7
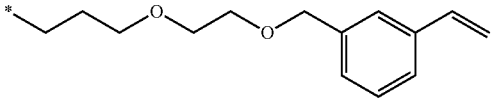
(R2)-8
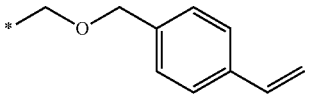
(R2)-9
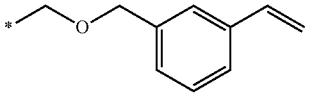
(R2)-10
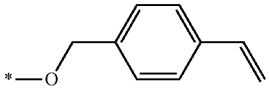
(R2)-11
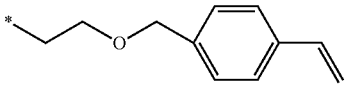
(R3)-1
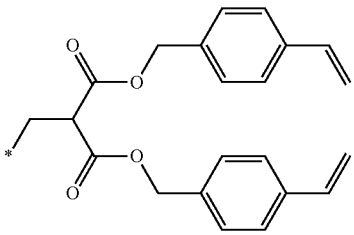
(R3)-2
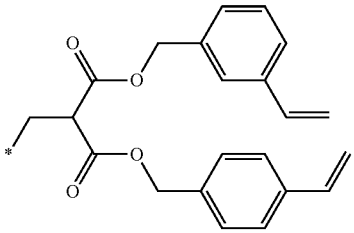

-continued
(R3)-3
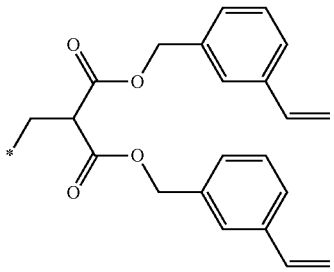
(R3)-4
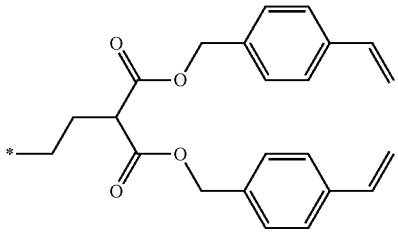
(R3)-5
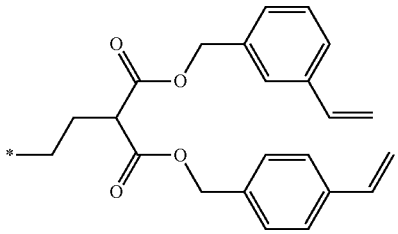
(R3)-6
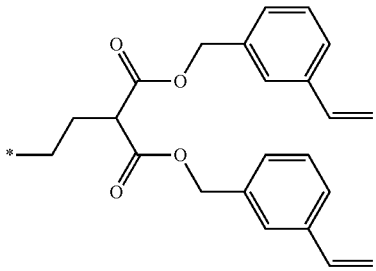
(R3)-7
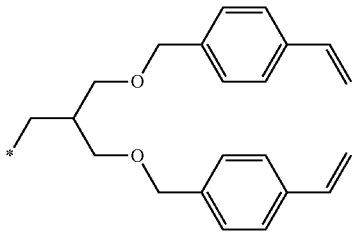
(R3)-8
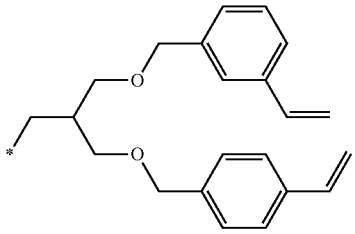
-continued
(R3)-9
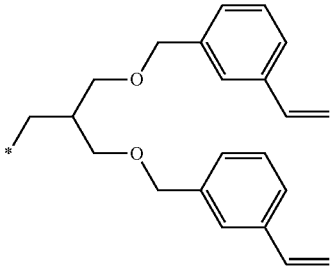
(R3)-10
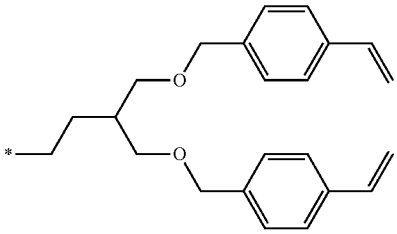
(R3)-11
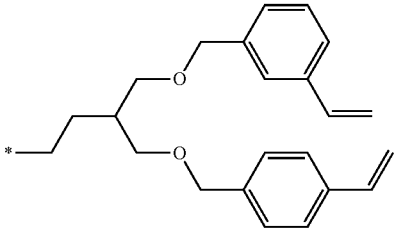
(R3)-12
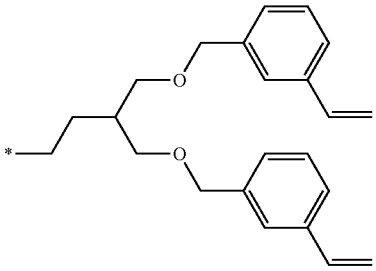
(R3)-13
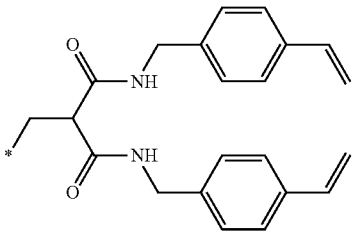
(R3)-14
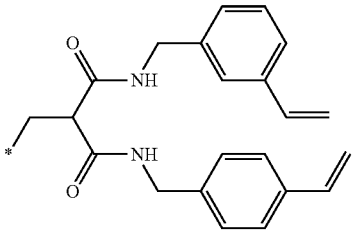

-continued
(R3)-15
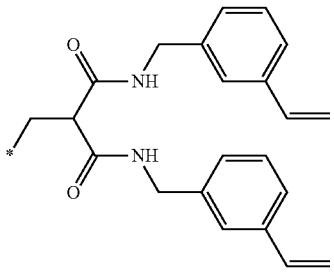
(R3)-16
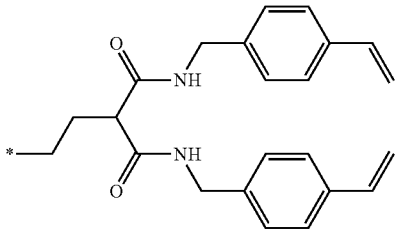
(R3)-17
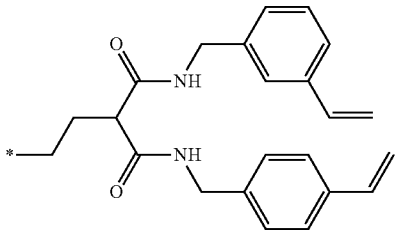
(R3)-18
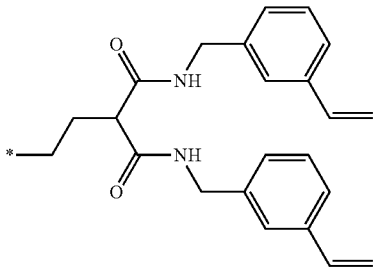
(R3)-19
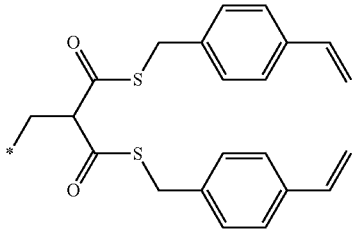
(R3)-20
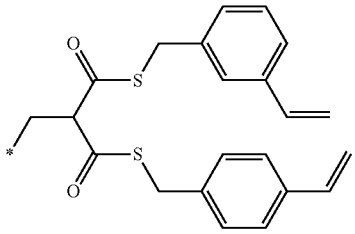
-continued
(R3)-21
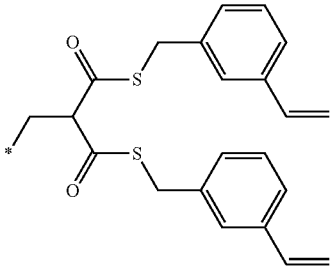
(R3)-22
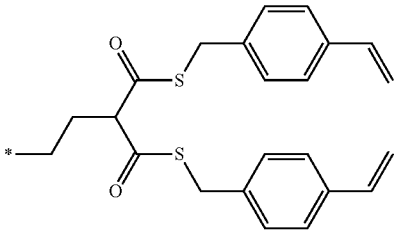
(R3)-23
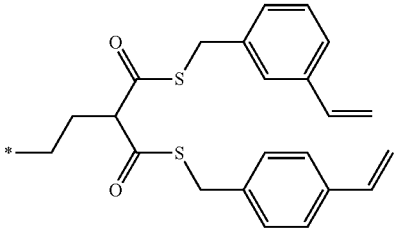
(R3)-24
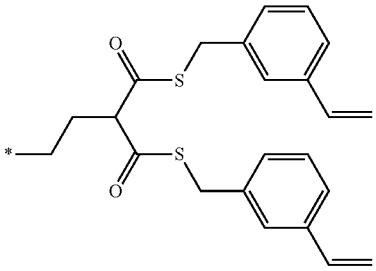
(R3)-25
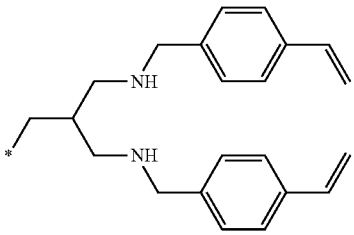
(R3)-26
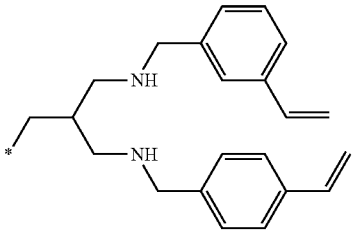

-continued
(R3)-27
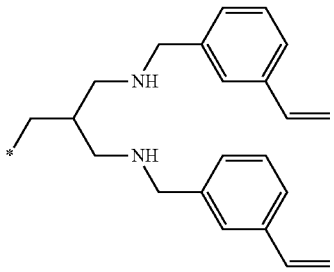
(R3)-28
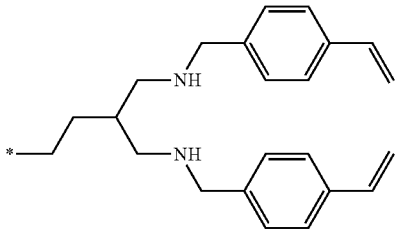
(R3)-29
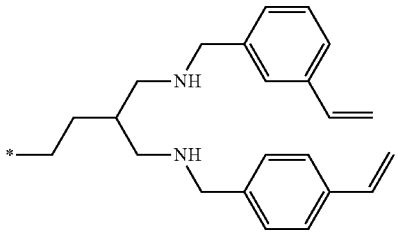
(R3)-30
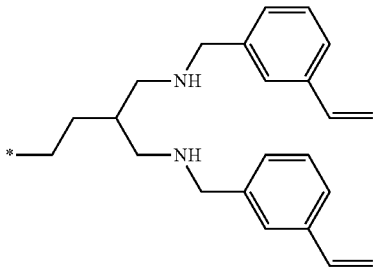
(R3)-31
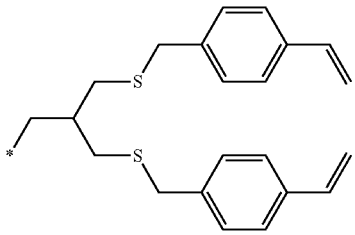
(R3)-32
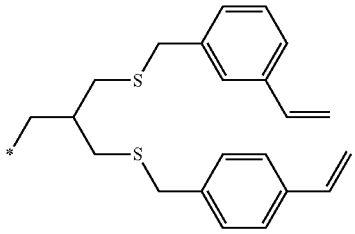
-continued
(R3)-33
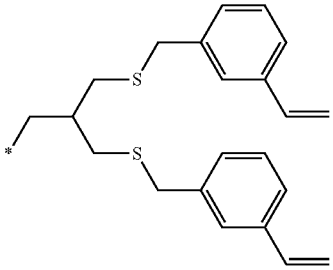
(R3)-34
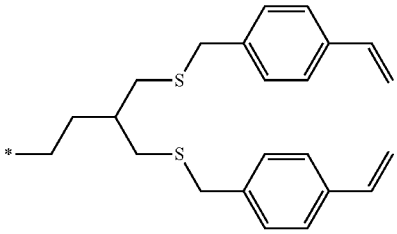
(R3)-35
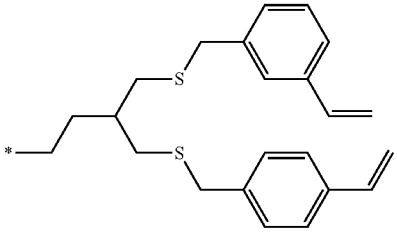
(R3)-36
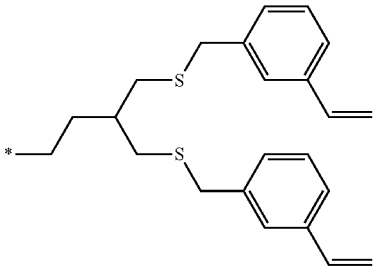
(R3)-37
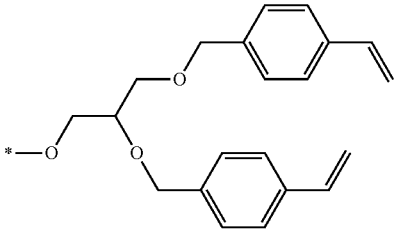
(R3)-38
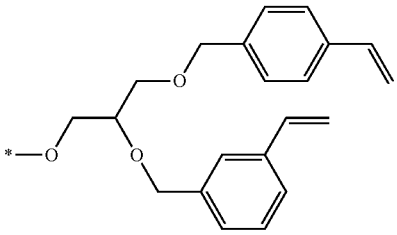

-continued
(R3)-39
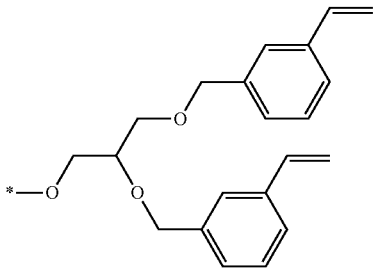
(R3)-40
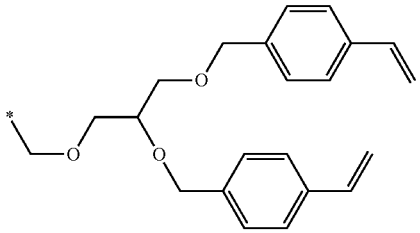
(R3)-41
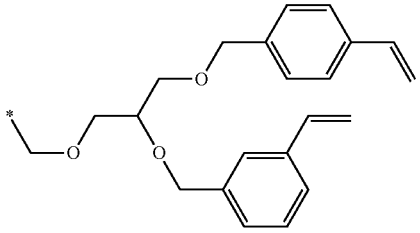
(R3)-42
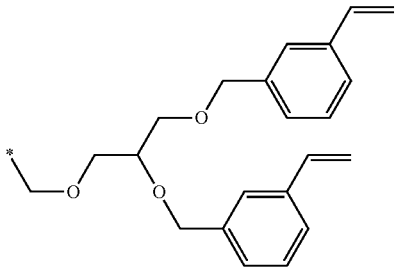
(R3)-43
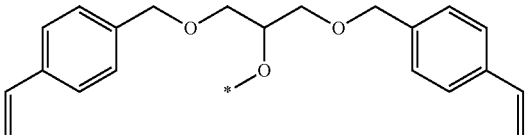
(R3)-44
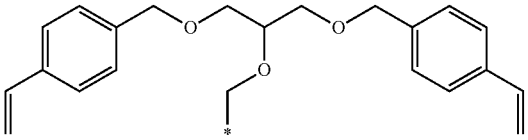
-continued
(R3)-45
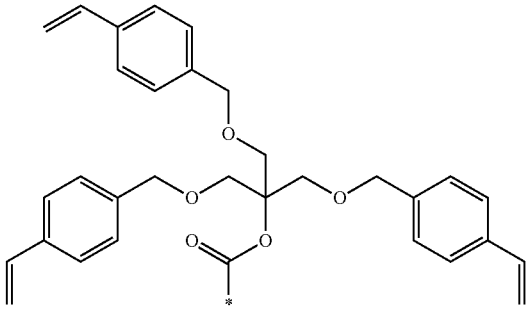
(R3)-46
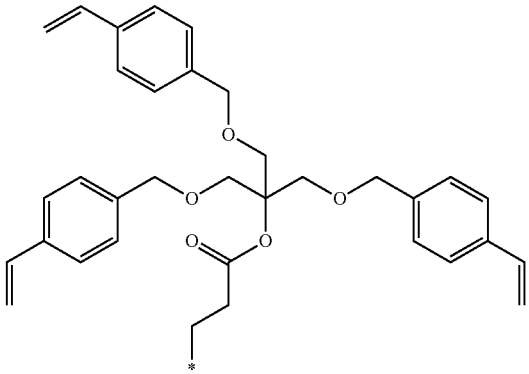
(R3)-47
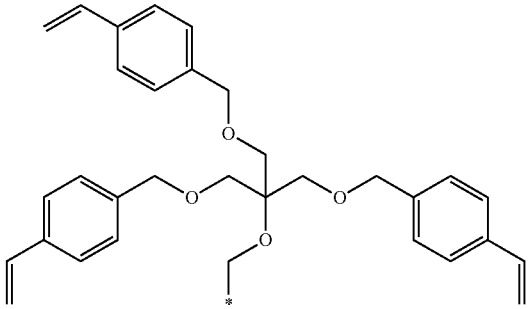
(R3)-48
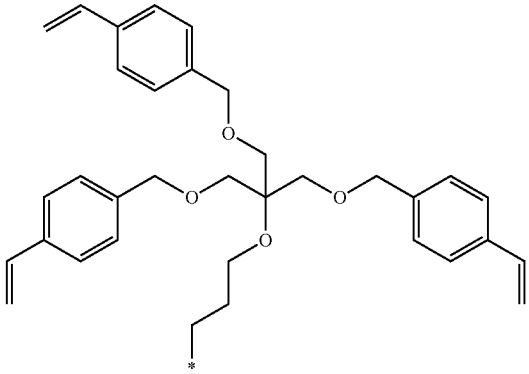

-continued (R4)-1

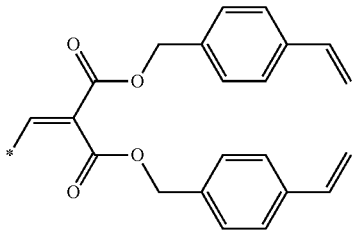

(R4)-2

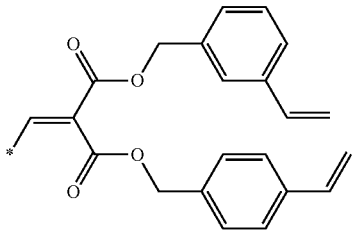

(R4)-3

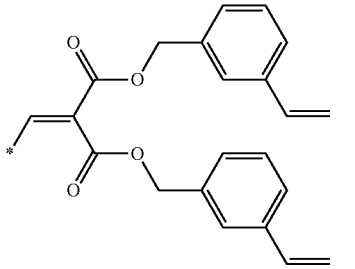

(R4)-4

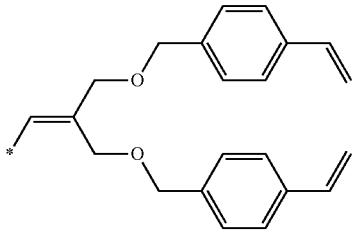

(R4)-5

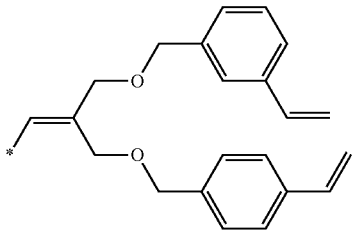

(R4)-6

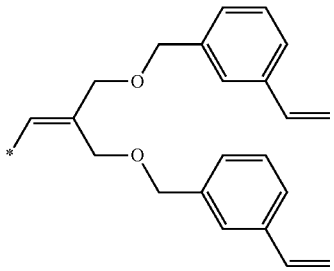

Next, specific examples of the compound represented by the formula (I), specifically the formula (I-a) are shown below.

Specific Examples of Formula (I) [Formula (I-a)]

| Exemplary compound | Charge transporting skeleton F | Functional group |
|---|---|---|
| (I-a)-1 | (M1)-15 | (R2)-8 |
| (I-a)-2 | (M1)-15 | (R2)-9 |
| (I-a)-3 | (M1)-15 | (R2)-10 |
| (I-a)-4 | (M1)-16 | (R2)-8 |
| (I-a)-5 | (M1)-17 | (R2)-8 |
| (I-a)-6 | (M1)-17 | (R2)-9 |
| (I-a)-7 | (M1)-17 | (R2)-10 |
| (I-a)-8 | (M1)-18 | (R2)-8 |
| (I-a)-9 | (M1)-18 | (R2)-9 |
| (I-a)-10 | (M1)-18 | (R2)-10 |
| (I-a)-11 | (M1)-19 | (R2)-8 |
| (I-a)-12 | (M1)-21 | (R2)-8 |
| (I-a)-13 | (M1)-22 | (R2)-8 |
| (I-a)-14 | (M2)-15 | (R2)-8 |
| (I-a)-15 | (M2)-15 | (R2)-9 |
| (I-a)-16 | (M2)-15 | (R2)-10 |
| (I-a)-17 | (M2)-16 | (R2)-8 |
| (I-a)-18 | (M2)-17 | (R2)-8 |
| (I-a)-19 | (M2)-23 | (R2)-8 |
| (I-a)-20 | (M2)-23 | (R2)-9 |
| (I-a)-21 | (M2)-23 | (R2)-10 |
| (I-a)-22 | (M2)-24 | (R2)-8 |
| (I-a)-23 | (M2)-24 | (R2)-9 |
| (I-a)-24 | (M2)-24 | (R2)-10 |
| (I-a)-25 | (M2)-25 | (R2)-8 |
| (I-a)-26 | (M2)-25 | (R2)-9 |
| (I-a)-27 | (M2)-25 | (R2)-10 |
| (I-a)-28 | (M2)-26 | (R2)-8 |
| (I-a)-29 | (M2)-26 | (R2)-9 |
| (I-a)-30 | (M2)-26 | (R2)-10 |
| (I-a)-31 | (M2)-21 | (R2)-11 |

Next, specific examples of the compound represented by the formula (I), specifically the formula (I-b), are shown below.

Specific Examples of Formula (I) [Formula (I-b)]

| Exemplary compound | Charge transporting skeleton F | Functional group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |

-continued

| Exemplary compound | Charge transporting skeleton F | Functional group |
|---|---|---|
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by the formula (I), specifically the formula (I-c), are shown below.

Specific Examples of Formula (I) [Formula (I-c)]

| Exemplary compound | Charge transporting skeleton F | Functional group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-25 | (R1)-1 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |

Specific Examples of Formula (I) [Formula (I-c)]

| Exemplary compound | Charge transporting skeleton F | Functional group |
|---|---|---|
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |

-continued

| Exemplary compound | Charge transporting skeleton F | Functional group |
|---|---|---|
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-4 |
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |

Specific Examples of Formula (I) [Formula (I-c)]

| Exemplary compound | Charge transporting skeleton F | Functional group |
|---|---|---|
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-25 | (R1)-15 |
| (I-c)-72 | (M1)-22 | (R1)-15 |
| (I-c)-73 | (M2)-2 | (R1)-15 |
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |
| (I-c)-80 | (M2)-10 | (R1)-45 |
| (I-c)-81 | (M2)-13 | (R1)-45 |
| (I-c)-82 | (M2)-13 | (R1)-45 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |

Specific Examples of Formula (I) [Formula (I-c)]

| Exemplary compound | Charge transporting skeleton F | Functional group |
|---|---|---|
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |

-continued

| Exemplary compound | Charge transporting skeleton F | Functional group |
|---|---|---|
| (I-c)-100 | (M4)-3 | (R1)-45 |
| (I-c)-101 | (M4)-8 | (R1)-15 |
| (I-c)-102 | (M4)-8 | (R1)-15 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-45 |
| (I-c)-112 | (M4)-24 | (R1)-45 |
| (I-c)-113 | (M4)-24 | (R1)-15 |
| (I-c)-114 | (M4)-24 | (R1)-15 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |

Next, specific examples of the compound represented by the formula (I), specifically the formula (I-d), are shown below.

Specific Examples of Formula (I) [Formula (I-d)]

| Exemplary compound | Charge transporting skeleton F | Functional group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |
| (I-d)-14 | (M4)-3 | (R2)-4 |
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |

Specific Examples of Formula (I) [Formula (I-d)]

| Exemplary compound | Charge transporting skeleton F | Functional group |
|---|---|---|
| (I-d)-31 | (M3)-1 | (R2)-8 |
| (I-d)-32 | (M3)-1 | (R2)-9 |
| (I-d)-33 | (M3)-2 | (R2)-8 |
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by the formula (II), specifically the formula (II-a), are shown below.

Specific Examples of Formula (II) [Formula (II-a)]

| Exemplary compound | Charge transporting skeleton F | Functional group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |
| (II)-29 | (M1)-22 | (R3)-6 |
| (II)-30 | (M1)-22 | (R3)-9 |

Specific Examples of Formula (II) [Formula (II-a)]

| Exemplary compound | Charge transporting skeleton F | Functional group |
|---|---|---|
| (II)-31 | (M2)-2 | (R3)-1 |
| (II)-32 | (M2)-2 | (R3)-3 |

-continued

| Exemplary compound | Charge transporting skeleton F | Functional group |
|---|---|---|
| (II)-33 | (M2)-2 | (R3)-7 |
| (II)-34 | (M2)-2 | (R3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |

Specific Examples of Formula (II) [Formula (II-a)]

| Exemplary compound | Charge transporting skeleton F | Functional group |
|---|---|---|
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |

Specific Examples of Formula (II) [Formula (II-a)]

| Exemplary compound | Charge transporting skeleton F | Functional group |
|---|---|---|
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13 |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R3)-33 |
| (II)-114 | (M1)-11 | (R3)-33 |
| (II)-115 | (M1)-11 | (R3)-33 |
| (II)-116 | (M1)-11 | (R3)-33 |
| (II)-117 | (M1)-11 | (R3)-33 |
| (II)-118 | (M1)-16 | (R3)-13 |
| (II)-119 | (M1)-22 | (R3)-15 |
| (II)-120 | (M1)-22 | (R3)-47 |

Specific Examples of Formula (II) [Formula (II-a)]

| Exemplary compound | Charge transporting skeleton F | Functional group |
|---|---|---|
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |
| (II)-127 | (M2)-3 | (R3)-21 |
| (II)-128 | (M2)-3 | (R3)-28 |
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |

-continued

| Exemplary compound | Charge transporting skeleton F | Functional group |
|---|---|---|
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |

Specific Examples of Formula (II) [Formula (II-a)]

| Exemplary compound | Charge transporting skeleton F | Functional group |
|---|---|---|
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |

-continued

| Exemplary compound | Charge transporting skeleton F | Functional group |
|---|---|---|
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |
| (II)-177 | (M4)-9 | (R3)-36 |
| (II)-178 | (M4)-9 | (R3)-37 |
| (II)-179 | (M4)-9 | (R3)-15 |
| (II)-180 | (M4)-9 | (R3)-47 |
| (II)-181 | (M2)-27 | (R4)-1 |
| (II)-182 | (M2)-27 | (R4)-4 |
| (II)-183 | (M2)-27 | (R3)-7 |
| (II)-184 | (M2)-27 | (R3)-7 |

The specific reactive group-containing charge transporting material (in particular, the reactive compound represented by the formula (I)) is synthesized in the following manner, for example.

That is, the specific reactive group-containing charge transporting material is synthesized by, for example, etherification of a carboxylic acid as a precursor, or an alcohol with chloromethylstyrene or the like corresponding thereto.

An example of the synthesis route for the exemplary compound (I-d)-22 of the specific reactive group-containing charge transporting material is shown below.

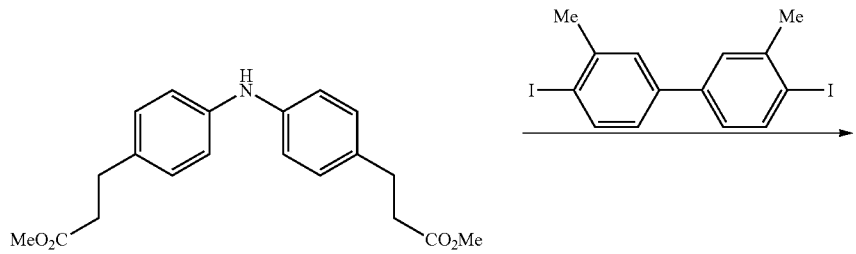

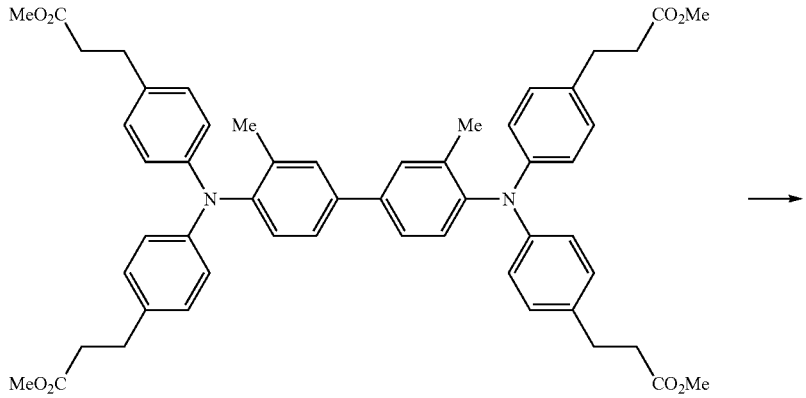

-continued

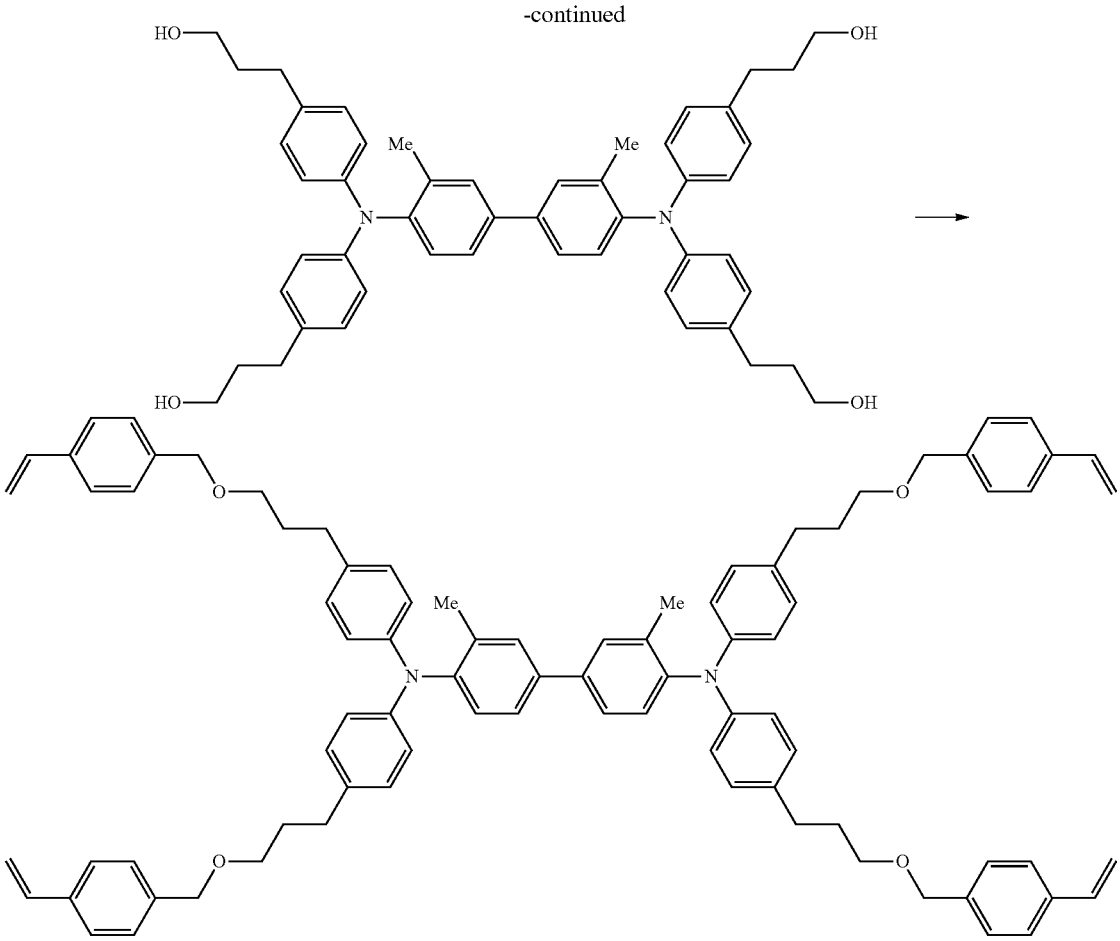

A carboxylic acid of the arylamine compound is obtained by subjecting an ester group of the arylamine compound to hydrolysis using, for example, a basic catalyst (NaOH, $K_2CO_3$, and the like) and an acidic catalyst (for example, phosphoric acid, sulfuric acid, and the like) as described in Experimental Chemistry Lecture, $4^{th}$ Ed., Vol. 20, p. 51, or the like.

Here, examples of the solvent include various types of the solvents, and an alcohol solvent such as methanol, ethanol, and ethylene glycol, or a mixture thereof with water may be preferably used.

Incidentally, in the case where the solubility of the arylamine compound is low, methylene chloride, chloroform, toluene, dimethylsulfoxide, ether, tetrahydrofuran, or the like may be added.

The amount of the solvent is not particularly limited, but it may be, for example, from 1 part by weight to 100 parts by weight, and preferably from 2 parts by weight to 50 parts by weight, based on 1 part by weight of the ester group-containing arylamine compound.

The reaction temperature is set to be, for example, in a range of room temperature (for example, 25° C.) to the boiling point of the solvent, and in terms of the reaction rate, preferably 50° C. or higher.

The amount of the catalyst is not particularly limited, but may be, for example, from 0.001 part by weight to 1 part by weight, and preferably from 0.01 part by weight to 0.5 part by weight, based on 1 part by weight of the ester group-containing arylamine compound.

After the hydrolysis reaction, in the case where the hydrolysis is carried out with a basic catalyst, the produced salt is neutralized with an acid (for example, hydrochloric acid) to be free. Further, after sufficiently washing with water, the product is dried and used, or may be, if necessary, purified by recrystallization with a suitable solvent such as methanol, ethanol, toluene, ethyl acetate, and acetone, and then dried and used.

Furthermore, the alcohol form of the arylamine compound is synthesized by reducing an ester group of the arylamine compound to a corresponding alcohol using aluminum lithium hydride, sodium borohydride, or the like as described in, for example, Experimental Chemistry Lecture, $4^{th}$ Ed., Vol. 20, P. 10, or the like.

For example, in the case of introducing a reactive group with an ester bond, ordinary esterification in which a carboxylic acid of the arylamine compound and hydroxymethylstyrene are dehydrated and condensed using an acid catalyst, or a method in which a carboxylic acid of the arylamine compound and halogenated methylstyrene are condensed using a base such as pyridine, piperidine, triethylamine, dimethylaminopyridine, trimethylamine, DBU, sodium hydride, sodium hydroxide, and potassium hydroxide may be used, but the method using halogenated methylstyrene is suitable since it suppresses by-products.

The halogenated methylstyrene may be added in an amount of 1 equivalent or more, preferably 1.2 equivalents or more, and more preferably 1.5 equivalents or more, based on the acid of the carboxylic acid of the arylamine compound, and the base may be added in an amount of from 0.8 equivalent to 2.0 equivalents, and preferably from 1.0 equivalent to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the carboxylic acid of the arylamine compound.

The reaction temperature is not particularly limited. After completion of the reaction, the reaction liquid may be poured into water, extracted with a solvent such as toluene, hexane, and ethyl acetate, washed with water, and if necessary, purified using an adsorbent such as activated carbon, silica gel, porous alumina, and activated white clay.

Furthermore, in the case of introduction with an ether bond, a method in which an alcohol of an arylamine compound and a halogenated methylstyrene are condensed using a base such as pyridine, piperidine, triethylamine, dimethylaminopyridine, trimethylamine, DBU, sodium hydride, sodium hydroxide, and potassium hydroxide may be preferably used.

The halogenated methylstyrene may be added in an amount of 1 equivalent or more, preferably 1.2 equivalents or more, and more preferably 1.5 equivalents or more, based on the alcohol of the arylamine compound, and the base may be used in an amount of from 0.8 equivalent to 2.0 equivalents, and preferably from 1.0 equivalents to 1.5 equivalents, based on the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, based on 1 part by weight of the alcohol of the arylamine compound.

The reaction temperature is not particularly limited. After completion of the reaction, the reaction liquid is poured into water, extracted with a solvent such as toluene, hexane, and ethyl acetate, washed with water, and if necessary, purification may be carried out using an adsorbent such as activated carbon, silica gel, porous alumina, and activated white clay.

The specific reactive group-containing charge transporting material (in particular, the reactive compound represented by the formula (II)) is synthesized using, for example, the general method for synthesizing a charge transporting material as shown below (formylation, esterification, etherification, or hydrogenation).

Formylation: a reaction which is suitable for introducing a formyl group into an aromatic compound, a heterocyclic compound, and an alkene, each having an electron donating group. DMF and phosphorous oxytrichloride are generally used and is commonly carried out at a reaction temperature from room temperature (for example, 25° C.) to 100° C.

Esterification: A condensation reaction of an organic acid with a hydroxyl group-containing compound such as an alcohol and a phenol. A method in which a dehydrating agent coexists or water is excluded from the system to move the equilibrium toward the ester side is preferably used.

Etherification: A Williamson synthesis method in which an alkoxide and an organic halogen compound are condensed is general.

Hydrogenation: A method in which hydrogen is reacted with an unsaturated bond using various catalysts.

The content of the specific reactive group-containing charge transporting material (content in the composition) is preferably, for example, from 60% by weight to 95% by weight or less, and more preferably from 65% by weight to 93% by weight or less, based on the weight of the protective layer 5 (outermost surface layer).

Non-Reactive Charge Transporting Material

As the non-reactive charge transporting material, a known charge transporting material may be used, and specific examples thereof include electron transporting compounds including quinone compounds such as p-benzoquinone, chloranil, bromanil, and anthraquinone; tetracyanoquinodimethane compounds; fluorenone compounds such as 2,4,7-trinitrofluorenone, xanthone compounds, benzophenone compounds, cyanovinyl compounds, and ethylene compounds; and hole transporting compounds including triarylamine compounds, benzidine compounds, arylalkane compounds, aryl-substituted ethylene compounds, stilbene compounds, anthracene compounds, and hydrazone compounds.

These charge transporting materials may be used singly or in combination of two or more kinds thereof, but are not limited thereto.

These non-reactive charge materials preferably have an aromatic ring, whereby the electrical characteristics and the mechanical strength of the protective layer 5 (outermost surface layer) are easily improved.

Among these, from the viewpoint of the electrical characteristics and the mechanical strength of the protective layer 5 (outermost surface layer), a triaryl amine derivative represented by the formula (a-1) and a benzidine derivative represented by the formula (a-2) are preferable.

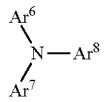

(a-1)

In the formula (a-1), $Ar^6$, $Ar^7$, and $Ar^8$ each independently represent a substituted or unsubstituted aryl group, $—C_6H_4—C(R^{10})=C(R^{11})(R^{12})$ or $—C_6H_4—CH=CH—CH=C(R^{13})(R^{14})$. $R^{10}$, $R^{11}$, $R^{12}$, $R^{13}$, and $R^{14}$ each independently represent a hydrogen atom, a substituted or unsubstituted alkyl group, or a substituted or unsubstituted aryl group.

Here, examples of the substituents of the respective groups include a halogen atom, an alkyl group having 1 to 5 carbon atoms, an alkoxy group having 1 to 5 carbon atoms, or a substituted amino group substituted with an alkyl group having 1 to 3 carbon atoms.

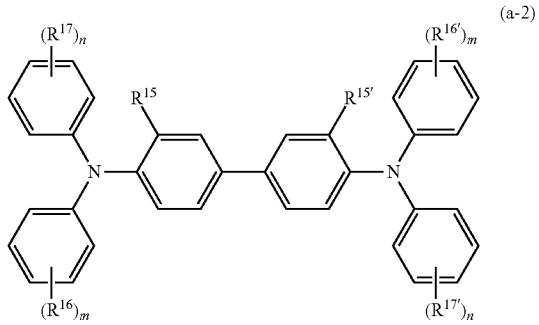

In the formula (a-2), $R^{15}$ and $R^{15'}$ each independently represent a hydrogen atom, a halogen atom, an alkyl group having 1 to 5 carbon atoms, or an alkoxy group having 1 to 5 carbon atoms. $R^{16}$, $R^{16'}$, $R^{17}$, and $R^{17'}$ each independently represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{18})=C(R^{19})(R^{20})$, or $—CH=CH—CH=C(R^{21})(R_{22})$, and $R^{18}$, $R^{19}$, $R^{20}$, $R^{21}$ and $R^{22}$ each independently represent a hydrogen atom, a substituted or unsubstituted alkyl group, or a substituted or unsubstituted aryl group. m and n each independently represent an integer of 0 to 2.

Here, among the triarylamine derivatives each represented by the formula (a-1) and the benzidine derivatives each represented by the formula (a-2), in particular, triarylamine derivatives each having "$—C_6H_4—CH=CH—CH=C(R^{13})(R^{14})$" and benzidine derivatives each having "$—CH=CH—CH=C(R^{21})(R^{22})$" are preferable since they are excellent from the viewpoints of charge mobility, adhesiveness to a lower layer in contact with the protective layer 5 (outermost surface layer), resistance to the residual image that occurs owing to the remaining history of a previous images (hereinafter also referred to as a "ghost"), and others.

Resin Particles

Examples of the resin particles include fluorine resin particles.

As the resin particles, fluorine resin particles are preferable, and among those, at least one selected from an ethylene tetrafluoride resin, an ethylene trifluorochloride resin, an ethylenepropylene hexafluoride resin, a vinyl fluoride resin, a vinylidene fluoride resin, an ethylene dichlorodifluoride resin, and a copolymer thereof is preferable. Further, among these fluorine resin particles, an ethylene tetrafluoride resin and a vinylidene fluoride resin are particularly preferable.

In addition, in order to disperse the resin particles in the coating liquid, various dispersants may be used in combination.

The average primary particle size of the resin particles is preferably from 0.05 μm to 1 μm, and more preferably from 0.1 μm to 0.5 μm.

The average particle size of the resin particles refers to a value measured using a laser diffraction type particle size distribution measurement device LA-700 (manufactured by Horiba, Ltd.).

The content of the resin particles is preferably from 0.1% by weight to 40% by weight, and more preferably from 1% by weight to 30% by weight, based on the weight of the protective layer 5 (outermost surface layer).

Other Additives

The film constituting the protective layer 5 (outermost surface layer) may use a compound having an unsaturated bond in combination.

The compound having an unsaturated bond may be any one of a monomer, an oligomer, and a polymer, and may further have a charge transporting skeleton.

Examples of the compound having an unsaturated bond, which has no charge transporting skeleton, include the following compounds.

Specifically, as the monofunctional monomers, for example, isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and styrene are exemplified.

Examples of the difunctional monomers include diethylene glycol di(meth)acrylate, polyethylene glycol di(meth) acrylate, polypropylene glycol di(meth)acrylate, neopentyl glycol di(meth)acrylate, 1,6-hexanediol di(meth)acrylate, divinylbenzene, and diallyl phthalate.

Examples of the trifunctional monomers include trimethylolpropane tri(meth)acrylate, pentaerythritol tri(meth)acrylate, aliphatic tri(meth)acrylate, and trivinylcyclohexane.

Examples of the tetrafunctional monomers include pentaerythritol tetra(meth)acrylate, ditrimethylolpropane tetra (meth)acrylate, aliphatic tetra(meth)acrylate.

Examples of the pentafunctional or higher functional monomers include (meth)acrylates having a polyester skeleton, a urethane skeleton, and a phosphazene skeleton, in addition to dipentaerythritol penta(meth)acrylate, dipentaerythritol hexa(meth)acrylate.

Furthermore, examples of the reactive polymer include those disclosed in, for example, JP-A-5-216249, JP-A-5-323630, JP-A-11-52603, JP-A-2000-264961, and JP-A-2005-2291.

In the case where compounds having unsaturated bonds containing no charge transporting components are used, these are used singly or as a mixture of two or more kinds thereof. In the case where compounds having unsaturated bonds containing no charge transporting components are used to form the outermost surface layer of the electrophotographic photoreceptor, they are used in the amount of preferably 60% by weight or less, more preferably 55% by weight or less, and even more preferably 50% by weight or less, based on the total solid content of the composition used so as to form the protective layer 5 (outermost surface layer).

Meanwhile, examples of the compound having an unsaturated bond, which has a charge transporting skeleton, include the following compounds.

Compound Having Chain Polymerizable Functional Group (Chain Polymerizable Functional Group Other Than Styryl Group) and Charge Transporting Skeleton in the Same Molecule The chain polymerizable functional group in the compound having a chain polymerizable functional group and a charge transporting skeleton in the same molecule is not particularly limited as long as it is a functional group that is capable of radical polymerization, and it is, for example, a functional group having at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the chain polymerizable functional group is preferably a group containing at least one selected from a vinyl group, a styryl group, an acryloyl group, a methacryloyl group, and derivatives thereof.

Furthermore, the charge transporting skeleton in the compound having a chain polymerizable functional group and a charge transporting skeleton in the same molecule is not particularly limited as long as it has a known structure in electrophotographic photoreceptor, and it is, for example, a skeleton derived from a nitrogen-containing hole transporting compound such as a triarylamine compound, a benzidine compound, and a hydrazone compound, and includes structures having conjugation with nitrogen atoms. Among these, a triarylamine skeleton is preferable.

The compound having the chain polymerizable functional group and the charge transporting skeleton in the same molecule may be the polymer described in the paragraphs [0132] to [0155] of JP-A-2012-159521.

The film constituting the protective layer 5 (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, silicon-containing compound or a fluorine-containing compound having a radically polymerizable group may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in a desired amount, but the amount of the fluorine-containing compound is preferably 0.25 time or less by weight, based on the compound containing no fluorine from the viewpoint of the film formability of the crosslinked film. In addition, a reactive fluorine compound disclosed in JP-A-2001-166510 or the like may be mixed.

Examples of the radically polymerizable group-containing silicon compound and fluorine-containing compound include the compounds described in JPA-2007-11005.

A deterioration inhibitor is preferably added to the film constituting the protective layer 5 (outermost surface layer). Preferable examples of the deterioration inhibitor include hindered phenol deterioration inhibitors and hindered amine deterioration inhibitors, and known antioxidants such as organic sulfur antioxidants, phosphite antioxidants, dithiocarbamate antioxidants, thiourea antioxidants, and benzimidazole antioxidants may be used.

The amount of the deterioration inhibitor to be added is preferably 20% by weight or less, and more preferably 10% by weight or less.

Examples of the hindered phenol antioxidant include IRGANOX 1076, IRGANOX 1010, IRGANOX 1098, IRGANOX 245, IRGANOX 1330, and IRGANOX 3114 (all manufactured by Ciba Japan), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by Ciba Japan), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (all manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Electroconductive particles, organic particles, or inorganic particles other than the resin particles may be added to the film constituting the protective layer 5 (outermost surface layer).

By way of an example of the particles, silicon-containing particles may be mentioned. The silicon-containing particles are particles having silicon as a constituent element contained therein. Specific examples thereof include colloidal silica and silicone particles. The colloidal silica used as the silicon-containing particles is selected from those obtained by dispersing silica having an average particle size of preferably from 1 nm to 100 nm, and more preferably from 10 nm to 30 nm, in an acidic or alkaline aqueous dispersion or in an organic solvent such as an alcohol, a ketone, and an ester. As the particles, commercially available ones may be used.

The solid content of the colloidal silica in the protective layer 5 (outermost surface layer) is not particularly limited, but it is used in an amount in the range of 0.1% by weight to 50% by weight, and preferably from 0.1% by weight to 30% by weight, based on the total solid content of the protective layer 5.

The silicone particles used as the silicon-containing particles are selected from silicone resin particles, silicone rubber particles, and treated silica particles whose surfaces have been treated with silicone, and commercially available silicone particles may be used.

These silicone particles are spherical, and the average particle size is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, based on the total amount of the total solid content of the protective layer 5 (outermost surface layer).

In addition, examples of other particles include particles including fluorine resins and resins formed by the copolymerization of monomers having hydroxyl groups, and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Further, various known dispersant materials may be used to disperse the particles.

Oils such as a silicone oil may be added to the film constituting the protective layer 5 (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

A metal, a metal oxide, carbon black, or the like may be added to the film constituting the protective layer (outermost surface layer). Examples of the metal include aluminum, zinc, copper, chromium, nickel, silver and stainless steel, and resin particles having any of these metals deposited on the surface thereof. Examples of the metal oxide include zinc oxide, titanium oxide, tin oxide, antimony oxide, indium oxide, bismuth oxide, indium oxide on which tin has been doped, tin oxide having antimony or tantalum doped thereon, and zirconium oxide having antimony doped thereon.

These may be used singly or in combination of two or more kinds thereof. When two or more kinds are used in combination, they may be simply mixed, or formed into a solid solution or a fusion to be mixed. The average particle size of the electroconductive particles is 0.3 μm or less, and particularly preferably 0.1 μm or less.

Composition

The composition used to form the protective layer 5 (outermost surface layer) is preferably prepared as a coating liquid for forming a protective layer, including the respective components dissolved or dispersed in the solvent.

The coating liquid for forming a protective layer may be solvent-free, or may be, if necessary, a singular solvent or a mixed solvent of aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethylether, and alcohol solvents such as isopropyl alcohol and butanol.

Furthermore, when the above-described components are reacted with each other to obtain a coating liquid, the respective components may be simply mixed and dissolved, but alternatively, the components may be preferably warmed under the conditions of a temperature of room temperature (20° C.) to 100° C., and more preferably from 30° C. to 80° C., and a time of preferably from 10 minutes to 100 hours, and more preferably from 1 hour to 50 hours. Further, it is also preferable to irradiate ultrasonic waves.

Preparation of Protective Layer 5

The coating liquid for forming the protective layer is coated on a coating surface (in the case of the exemplary embodiment shown in FIG. 1, the charge transporting layer 3), by an ordinary method such as a blade coating method, a wire bar coating method, an extrusion coating method, a spray coating method, a dipping coating method, a bead coating method, an air knife coating method, a curtain coating method, and an ink jet coating method.

Thereafter, light, an electron beam, or heat is applied to the coating film thus obtained to induce radical polymerization, and thus, polymerize and cure the coating film.

For the curing method, heat, light, radiation, or the like is used. In the case where polymerization and curing are carried out using heat and light, a polymerization initiator is not necessarily required, but a photocuring catalyst or a thermal polymerization initiator may be used. As the photocuring catalyst and the thermal polymerization initiator, a known photocuring catalyst or thermal polymerization initiator is used. As the radiation, an electron beam is preferable.

Electron Beam Curing

In the case of using electron beam, the accelerating voltage is preferably 300 kV or less, and more preferably 150 kV or less. Further, the radiation dose is preferably in the range of 1 Mrad to 100 Mrad, and more preferably in the range of 3 Mrad to 50 Mrad. If the accelerating voltage is 300 kV or less, the damage of electron beam irradiation to the photoreceptor characteristics is suppressed. Further, if the radiation dose is 1 Mrad or more, the crosslinking is carried out, and, the radiation dose of 100 Mrad or less suppresses deterioration of the photoreceptor.

The irradiation is carried out in an inert gas atmosphere such as nitrogen and argon, at an oxygen concentration of 1000 ppm or less, and preferably 500 ppm or less, and furthermore, heating may be carried out during the irradiation or after the irradiation, at a temperature of 50° C. to 150° C.

Photocuring

As a light source, a high pressure mercury lamp, a low pressure mercury lamp, a metal halide lamp, or the like is used, and a suitable wavelength may be selected by using a filter such as a band-pass filter. The irradiation time and the light intensity may be freely selected, but, for example, the illumination (365 nm) is preferably from 300 mW/cm$^2$ to 1000 mW/cm$^2$, and for example, in the case of irradiating with UV light at 600 mW/cm$^2$, the duration of the irradiation may be from 5 seconds to 360 seconds.

The irradiation is carried out under an inert gas atmosphere such as nitrogen and argon, at an oxygen concentration of preferably 1000 ppm or less, and more preferably 500 ppm or less, and heating may be carried out at a temperature of 50° C. to 150° C. during irradiation or after irradiation.

Examples of the photocuring catalyst include intramolecular cleavage type photocuring catalysts such as a benzyl ketal photocuring catalyst, an alkylphenone photocuring catalyst, an aminoalkylphenone photocuring catalyst, a phosphine oxide photocuring catalyst, a titanocene photocuring catalyst, and an oxime photocuring catalyst.

More specific example of the benzyl ketal photocuring catalyst include 2,2-dimethoxy-1,2-diphenylethan-1-one.

Furthermore, examples of the alkylphenone photocuring catalyst include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl] phenyl}-2-methyl-propan-1-one, acetophenone, and 2-phenyl-2-(p-toluenesulfonyloxy)acetophenone.

Examples of the aminoalkylphenone photocuring catalyst include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalyst include 2,4,6-trimethylbenzoyl-diphenyl phosphine oxide and bis(2,4,6-trimethylbenzoyl)phenyl phosphine oxide.

Examples of the titanocene photocuring catalyst include bis(η5-2,4-cyclopentadien-1-yl)-bis[2,6-difluoro-3-(1H-pyrrol-1-yl)-phenyl]titanium.

Examples of the oxime photocuring catalyst include 1,2-octanedione, 1-[4-(phenylthio)-, 2-(O-benzoyloxime), ethanone, 1-[9-ethyl-6-(2-methylbenzoyl)-9H-carbazol-3-yl]-, 1-(O-acetyloxime).

Examples of the hydrogen abstraction photocuring catalyst include a benzophenone photocuring catalyst, a thioxanthone photocuring catalyst, a benzyl photocuring catalyst, and a Michler's ketone photocuring catalyst.

More specific examples of the benzophenone photocuring catalyst include 2-benzoyl benzoic acid, 2-chlorobenzophenone, 4,4'-dichlorobenzophenone, 4-benzoyl-4'-methyldiphenyl sulfide, and p,p'-bisdiethylaminobenzophenone.

Examples of the thioxanthone photocuring catalyst include 2,4-diethylthioxanthen-9-one, 2-chlorothioxanthone, and 2-isopropylthioxanthone.

Example of the benzyl photocuring catalyst include benzyl, (±)-camphor-quinone, and p-anisyl.

These photopolymerization initiators may be used singly or in combination of two or more kinds thereof.

Thermal Curing

Examples of the thermal polymerization initiator include thermal radical generators or derivatives thereof, specifically, for example, an azo initiator such as V-30, V-40, V-59, V601, V65, V-70, VF-096, VE-073, Vam-110, and Vam-111 (all manufactured by Wako Pure Chemicals Industries, Ltd.), and OTAZO-15, OTAZO-30, AIBN, AMBN, ADVN, and ACVA (all manufactured by Otsuka Chemical Co., Ltd.); and PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER-BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (all manufactured by NOF CORPORATION), KAYAKETAL AM-055, TRIGONOX 36-C75, LAUROX, PERKADOX L-W75, PERKADOX CH-50L, TRIGONOX TMBH, KAYA CUMEN H, KAYA BUTYL H-70, PERKADOX BC-FF, KAYA HEXA AD, PERKADOX 14, KAYA BUTYL C, KAYA BUTYL D, KAYA HEXA YD-E85, PERKADOX 12-XL25, PERKADOX 12-EB20, TRIGONOX 22-N70, TRIGONOX 22-70E, TRIGONOX D-T50, TRIGONOX 423-C70, KAYA ESTER CND-C70, KAYA ESTER CND-W50, TRIGONOX 23-C70, TRIGONOX 23-W50N, TRIGONOX 257-C70, KAYA ESTER P-70, KAYA ESTER TMPO-70, TRIGONOX 121, KAYA ESTER O, KAYA ESTER HTP-65W, KAYA ESTER AN, TRIGONOX 42, TRIGONOX F-C50, KAYA BUTYL B, KAYA CARBON EH-C70, KAYA CARBON EH-W60, KAYA CARBON I-20, KAYA CARBON BIC-75, TRIGONOX 117, and KAYAREN 6-70 (all manufactured by Kayaku Akzo), LUPEROX 610, LUPEROX 188, LUPEROX 844, LUPEROX 259, LUPEROX 10, LUPEROX 701, LUPEROX 11, LUPEROX 26, LUPEROX 80, LUPEROX 7, LUPEROX 270, LUPEROX P, LUPEROX 546, LUPEROX 554, LUPEROX 575, LUPEROX TANPO, LUPEROX 555, LUPEROX 570, LUPEROX TAP, LUPEROX TBIC, LUPEROX TBEC, LUPEROX JW, LUPEROX TAIL, LUPEROX TAEC, LUPEROX DC, LUPEROX 101, LUPEROX F, LUPEROX DI, LUPEROX 130, LUPEROX 220, LUPEROX 230, LUPEROX 233, and LUPEROX 531 (all manufactured by ARKEMA Yoshitomi).

Among these, by using an azo polymerization initiator having a molecular weight of 250 or more, a reaction proceeds without unevenness at a low temperature, and thus, it is promoted to form a high-strength film having a suppressed unevenness. More suitably, the molecular weight of the azo polymerization initiator is 250 or more, and still more suitably 300 or more.

Heating is carried out in an inert gas atmosphere such as nitrogen and argon, at an oxygen concentration of preferably 1000 ppm or less, and more preferably 500 ppm or less, and furthermore, at a temperature of preferably 50° C. to 170° C., more preferably 70° C. to 150° C., for a period of preferably 10 minutes to 120 minutes, and more preferably 15 minutes to 100 minutes.

The total content of the photocuring catalyst or the thermal polymerization initiator is preferably in the range of 0.1% by weight to 10% by weight, more preferably 0.1% by weight to 8% by weight, and particularly preferably 0.1% by weight to 5% by weight, based on the total solid content in the dissolution liquid for forming a layer.

In addition, in the present exemplary embodiment, since it is difficult to attain structural relaxation of the coating film by crosslinking when the reaction proceeds too quickly, and thus, unevenness of the film and wrinkles easily occur. As a result, a curing method by heat, in which generation of radicals occurs relatively slowly is adopted.

In particular, by combining specific reactive group-containing charge transporting material with curing by heat, the structural relaxation of the coating film is further promoted, and a protective layer 5 having excellent surface properties and states is easily obtained.

The film thickness of the protective layer 5 (outermost surface layer) is preferably from about 3 μm to 40 μm, and more preferably from 5 μm to 35 μm.

Conductive Substrate

The conductive substrate 4 may be a metallic plate, metallic drum, or metallic belt made of aluminum, copper, zinc, stainless steel, chromium, nickel, molybdenum, vanadium, indium, gold, platinum, or the like, or an alloy containing such a metal. Further, examples of the conductive substrate 4 include paper, a resin film, or a belt on which an electroconductive polymer, an electroconductive compound such as indium oxide, a metal such as aluminum, palladium, or gold, or an alloy containing such a metal, is applied, evaporated or laminated.

The term "electroconductive" herein means that the volume resistivity is less than $10^{13}$ Ω·cm.

In the case where the electrophotographic photoreceptor 7A is used for a laser printer, the surface of the conductive substrate 4 may be made rough to have a centerline average roughness Ra of 0.04 μm to 0.5 μm in order to prevent interference fringes generated when a laser ray is radiated thereto. Further, in the case where an incoherent light ray is used as a light source, it is not particularly necessary to make the surface rough to prevent interference fringes.

As a surface-roughening method, wet honing performed by spraying a suspension, in which an abrasive agent is suspended in water onto the support, centerless grinding, in which a support is brought into contact with a rotating grinding stone to attain grinding continuously, an anodic oxidation treatment, or the like is preferable.

An additional surface-roughening method, a method in which electroconductive or semi-electroconductive powder is dispersed into a resin to form a layer on the support surface, thereby making the conductive substrate 4 rough through the particles dispersed in the layer without roughening the surface of the conductive substrate 4, is used.

Here, the surface-roughening treatment based on anodic oxidation is a treatment in which aluminum is used as an anode to perform anodic oxidation in an electrolytic solution, thereby forming an oxide film on the aluminum surface. Examples of the electrolytic solution include a sulfuric acid solution and an oxalic acid solution. However, the porous anodic oxide film formed by the anodic oxidation itself is chemically active. Thus, it is preferable to perform a pore-sealing treatment of sealing the fine pores in the anodic oxide film by volume expansion based on hydration reaction in pressured water vapor or boiling water (to which a salt of a metal such as nickel may be added), thereby changing the oxide to a hydrated oxide, which is more stable.

The film thickness of the anodic oxide film may preferably be from 0.3 μm to 15 μm.

The conductive substrate 4 may be subjected to a treatment with an aqueous acidic solution or boehmite treatment. A treatment with an acidic treating solution containing phosphoric acid, chromic acid, and hydrofluoric acid is conducted as follows.

First, an acidic treatment solution is prepared. With respect to the blend ratio among phosphoric acid, chromic acid, and hydrofluoric acid in the acidic treatment solution, the amount of phosphoric acid, that of chromic acid, and that of hydrofluoric acid may be from 10% by weight to 11% by weight, from 3% by weight to 5% by weight, and form 0.5% by weight to 2% by weight, respectively, and the sum total concentration of these acids is preferably from 13.5% by weight to 18% by weight. The treatment temperature is preferably from 42° C. to 48° C. When the treatment temperature is kept at such a high temperature, a thicker coating film is more rapidly formed. The thickness of the coating film is preferably from 0.3 μm to 15 μm.

The boehmite treatment is preferably conducted by immersing the conductive substrate 4 into pure water at 90° C. to 100° C. for 5 minutes to 60 minutes, or by bringing the conductive substrate 4 into contact with heated water vapor of 90° C. to 120° C. for 5 minutes to 60 minutes. The thickness of the coating film may be preferably from 0.1 μm to 5 μm. The resultant may be further subjected to an anodic oxidation treatment with an electrolyte solution containing adipic acid, boric acid, borate, phosphate, phthalate, maleate, benzoate, tartrate, or citrate having lower coat-solubility.

Undercoat Layer

The undercoat layer 1 is constituted with, for example, inorganic particles in a binder resin.

As the inorganic particles, inorganic particles having a powder resistivity (volume resistivity) of $10^2$ Ω·cm to $10^{11}$ Ω·cm are preferably used.

As the inorganic particles having the above powder resistivity (volume resistivity), inorganic particles such as tin oxide, titanium oxide, zinc oxide, or zirconium oxide are preferably used, and zinc oxide is particularly preferably used.

The inorganic particles may be subjected to a surface treatment and two or more kinds of the inorganic particles different from each other in the surface treatments or in the particle sizes may be used in a mixture.

The specific surface area of the inorganic particles is preferably 10 $m^2/g$ or more as determined by a BET method.

The volume average particle size of the inorganic particles is preferably in the range of 50 nm to 2000 nm (more preferably 60 nm to 1000 nm).

Moreover, the undercoat layer 1 preferably contains an acceptor type compound in combination with inorganic particles.

The acceptor type compound is not limited as long as the characteristics are achieved. Preferable examples thereof include electron transporting materials, for example, quinone compounds such as chloranil and bromoanil; tetracyanoquinodimethane compounds; fluorenone compounds such as 2,4,7-trinitrofluorenone, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole; and xanthone compounds; thiophene compounds; diphenoquinone compounds such as 3,3',5,5'-tetra-t-butyldiphenoquinone. In particular, compounds having an anthraquinone structure are desired. Additional desired examples thereof include acceptor type compounds having an anthraquinone structure, such as a hydroxyanthraquinone compound, an amino anthraquinone compound, and an aminohydroxyanthraquinone compound. Specific examples thereof include anthraquinone, alizarin, quinizarin, anthrarufin, and purpurin.

The content of these acceptor type compounds is not limited as long as the characteristics are achieved. But the acceptor type compounds are contained in the amount in the range of preferably 0.01% by weight to 20% by weight, and more preferably 0.05% by weight to 10% by weight, based on the inorganic particles.

The acceptor compound may be only added to a coating liquid for forming an undercoat layer or may be adhered to the surfaces of the inorganic particles in advance.

Examples of the method for applying the acceptor compound onto the surfaces of the inorganic particles include a wet method and a dry method.

In the case where the surface treatment is carried out by a dry method, the treatment is performed by stirring the inorganic particles by a mixer or the like that gives a large shearing force while dropping the acceptor compound directly thereon or dropping the acceptor compound dissolved in an organic solvent thereon, and spraying the compound or the compound dissolved in an organic solvent thereon together with dry air or nitrogen gas. The addition or spraying is conducted preferably at a temperature of the boiling point of the solvent or lower. After the addition or spraying, the resultant may be subjected to baking at 100° C. or higher. The baking is performed at a desired range of temperature for a desired period of time.

Furthermore, in a wet method, the inorganic particles are stirred in a solvent, and dispersed therein by use of ultrasonic waves, a sand mill, an attritor, a ball mill or the like. The acceptor compound is added thereto, and stirred or dispersed, and then the solvent is removed, thereby conducting the treatment. The method for removing the solvent is filtration, or distillation. After the removal of the solvent, the resultant may be further subjected to baking at 100° C. or higher. A temperature condition for the baking or a period condition for the baking is not restricted as long as electrophotographic characteristics are obtained. In the wet method, water contained in the inorganic particles may be removed before the addition of a surface treatment agent. The method for the removal is, for example, a method of removing the water while the particles are stirred and heated in the solvent used in surface treatment, or a method of removing the water by boiling the water and the solvent azeotropically.

Moreover, the inorganic particles may be subjected to surface treatment before the acceptor compound is applied to the particles. The surface treatment agent may be any agent as long as the undercoat layer gains desired characteristics, and may be selected from known materials. Examples of the surface treatment agent include a silane coupling agent, a titanate coupling agent, an aluminum coupling agent, and a surfactant. In particular, a silane coupling agent is preferably used since the agent gives good electrophotographic characteristics. A silane coupling agent having an amino group is more preferably used.

The silane coupling agent having an amino group may be any agent as long as electrophotographic photoreceptor characteristics are obtained. Specific examples thereof include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

Furthermore, the silane coupling agents may be used in a mixture of two or more kinds thereof. Examples of the silane coupling agent which may be used in combination of the silane coupling agent having an amino group include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

Furthermore, the surface treatment method using these surface treatment agents may be any known method, and a dry method or a wet method may be used. Application of the acceptor compound and surface treatment using a surface treatment agent such as a coupling agent may be carried out at once.

The amount of the silane coupling agent based on the inorganic particles in the undercoat layer 1 is not limited as long as electrophotographic characteristics are obtained. The amount is preferably from 0.5% by weight to 10% by weight based on the inorganic particles.

As the binder resin contained in the undercoat layer 1, any known resin that may form a favorable film and achieve desired characteristics may be used. For example, known polymeric resin compound including acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; and a known material such as a zirconium chelate compound, a titanium chelate compound, an aluminum chelate compound, a titanium alkoxide compound, an organic titanium compound, and a silane coupling agent may be used.

Further, as a binder resin that is contained in the undercoat layer 1, a charge transporting resin having a charge transporting group, an electroconductive resin such as polyaniline, or the like may be used.

Among these, a resin which is insoluble in a coating solvent for the upper layer is appropriate as a binder resin, and in particular, a resin obtained by the reaction of at least one selected from thermal curing resins such as a urea resin, a phenol resin, a phenol-formaldehyde resin, a melamine resin, a urethane resin, an unsaturated polyester resin, an alkyd resin, and an epoxy resin, and polyamide resins, polyester resins, polyether resins, acrylic resins, polyvinyl alcohol resins, and polyvinylacetal resins with a curing agent is suitable.

In the case where these are used in combination of two or more kinds of the binder resins, the mixing ratio is determined depending on the requirements.

In a coating solution for forming the undercoat layer, the ratio of the inorganic particles having their surfaces on which the acceptor compound is applied (acceptor-property-applied metal oxide) to the binder resin, or the ratio of the inorganic particles to the binder resin may be set to be in a range with which electrophotographic photoreceptor characteristics are obtained.

In addition, various additives may be added to the undercoat layer 1.

As the additives, known materials, for example, an electron transporting pigment such as a condensed polycyclic pigment and an azo pigment, a zirconium chelate compound, a titanium chelate compound, an aluminum chelate compound, a titanium alkoxide compound, an organic titanium compound, and a silane coupling agent, are used. The silane coupling agent is used for the surface treatment of the inorganic particles as described above; however, the agent may be further added, as an additive, into the coating liquid for forming an undercoat layer.

Specific examples of the silane coupling agent as the additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Further, examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, an ammonium salt of titanium lactate, titanium lactate, an ethyl ester of titanium lactate, titanium triethanol aminate, and polyhydroxytitanium stearate.

Examples of the aluminum chelate compound include aluminum isopropylate, monobutoxyaluminum diisopropylate, aluminum butyrate, diethylacetoacetate aluminum diisopropylate, and aluminum tris(ethylacetoacetate).

These compounds may be used singly or as a mixture or polycondensate of plural compounds.

The solvent for preparing a coating liquid for forming the undercoat layer is selected from known organic solvents, for example, alcoholic solvents, aromatic solvents, halogenated hydrocarbon solvents, ketone solvents, ketone alcohol solvents, ether solvents, and ester solvents.

As the solvent, an ordinary organic solvent, specifically, for example, methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene are used.

In addition, these solvents may be used singly or as a mixture of two or more kinds thereof. Any solvents may be used as a mixed solvent as long as the mixed solvent is able to dissolve a binder resin.

As the method for dispersing the inorganic particles when the coating liquid for forming an undercoat layer is prepared, a known method such as a roll mill, a ball mill, a vibrating ball mill, an attritor, a sand mill, a colloid mill, and a paint shaker is used.

Further, as the coating method used to provide the undercoat layer 1, an ordinary coating method such as a blade coating method, a wire bar coating method, an extrusion coating method, a spray coating method, a dipping coating method, a bead coating method, an air knife coating method, and a curtain coating method is used.

The coating liquid for forming an undercoat layer obtained as described above is used to form the undercoat layer 1 on the conductive substrate.

Furthermore, the Vickers hardness of the undercoat layer 1 is preferably 35 or more.

Incidentally, the thickness of the undercoat layer 1 may be set to be any value as long as desired characteristics are obtained, but the thickness is preferably 15 μm or more, and more preferably from 15 μm to 50 μm.

Furthermore, the surface roughness (ten-point average roughness) of the undercoat layer 1 is preferably adjusted from ¼n (n is a refractive index of the upper layer) to ½λ of the laser wavelength λ for exposure used.

In order to adjust the surface roughness, particles made of a resin or the like may be added to the undercoat layer. As the resin particles, silicone resin particles, crosslinkable polymethyl methacrylate resin particles, or the like are used.

The surface of the undercoat layer may be polished to adjust the surface roughness. As the polishing method, buff polishing, sandblast treatment, wet honing, grinding treatment or the like is used. In the case of using an incoherent light source such as an LED and an organic EL image array, a smooth surface may be used.

The undercoat layer 1 is obtained by drying the coating liquid for forming an undercoat layer as described above coated on the conductive substrate 4, but usually the drying is carried out at a temperature capable of evaporating the solvent and forming a film.

Charge Generating Layer

The charge generating layer 2 is a layer including a charge generating material and a binder resin. Further, the charge generating layer 2 may be formed as a deposited film containing no binder resin. It is preferable in the case of using, in particular, an incoherent light source such as an LED and an organic EL image array.

The charge generating material include azo pigments such as bisazo and trisazo pigments, condensed aromatic pigments such as dibromoanthanthrone, perylene pigments, pyrrolopyrrole pigments, phthalocyanine pigments, zinc oxide, and trigonal selenium. Among these, in order to respond to laser exposure of a near-infrared region, metallic and non-metallic phthalocyanine pigments are preferably used as the charge generating material, and in particular, hydroxy gallium phthalocyanine disclosed in JP-A-5-263007, JP-A-5-279591, and the like, chloro gallium phthalocyanine disclosed in JP-A-5-98181 and the like, dichloro tin phthalocyanine disclosed in JP-A-5-11172, JP-A-5-11173, and the like, and titanylphthalocyanine disclosed in JP-A-4-189873, JP-A-5-43823, and the like are preferably used. Furthermore, in order to cause the photoreceptor to respond the radiation of a laser exposure having a near ultraviolet wavelengths, as the charge generating material, a condensed ring aromatic pigment such as dibromoanthanthrone; a thioindigo pigment, a porphyrazine compound, zinc oxide, trigonal selenium; bisazo pigments disclosed in JP-A-2004-78147 and JP-A-2005-181992; and the like are more preferably used.

Moreover, also in the case where an incoherent light source such as an LED and an organic EL image array, having a light-emitting center wavelength of 450 nm to 780 nm, is used, the charge generating material may be used, but in the case where the photosensitive layer is used as a thin film having a thickness of 20 μm or less from the viewpoint of the resolution, the field strength in the photosensitive layer is enhanced and decrease in charge due to charge injection from a substrate, that is, image defects, called black spots, easily occurs.

This becomes noticeable when a charge generating material which is a p-type semiconductor such as trigonal selenium and a phthalocyanine pigment and easily generates dark currents is used.

In contrast, in the case where an n-type semiconductor such as a condensed ring aromatic pigment, a perylene pigment, an azo pigment, and the like is used, dark currents are hardly generated, and image defects called black spots even with a thin film may be suppressed.

By forming an undercoat layer formed on a smooth substrate using an incoherent light source such as an LED and an organic EL image array, having a light-emitting center wavelength of 450 nm to 780 nm, and further using an n-type charge generating material, an image is obtained, which does not cause image defects even when the photosensitive layer is made into a thin film having a thickness of 20 μm or less and has a high resolution over a long period of time.

Specific examples of the n-type charge generating material are shown below, but are not limited thereto. In addition, determination of the n-type is conducted by the polarity of the flowing photocurrent using a time-of-flight method that is generally used, and a type in which electrons flow more easily than holes as a carrier is taken as an n-type.

Structural formula

CG-1

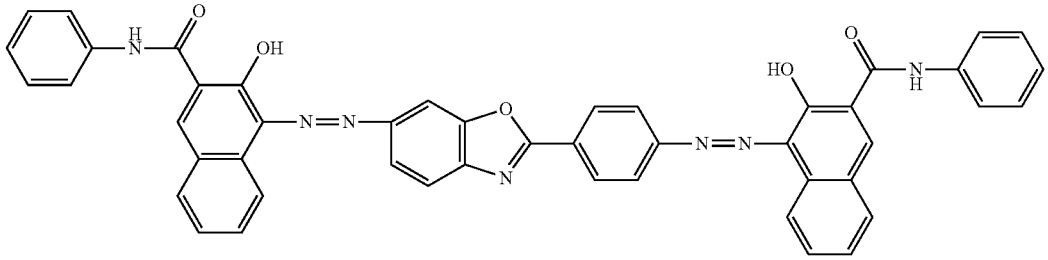

-continued
| | Structural formula |
|---|---|
| CG-2 | 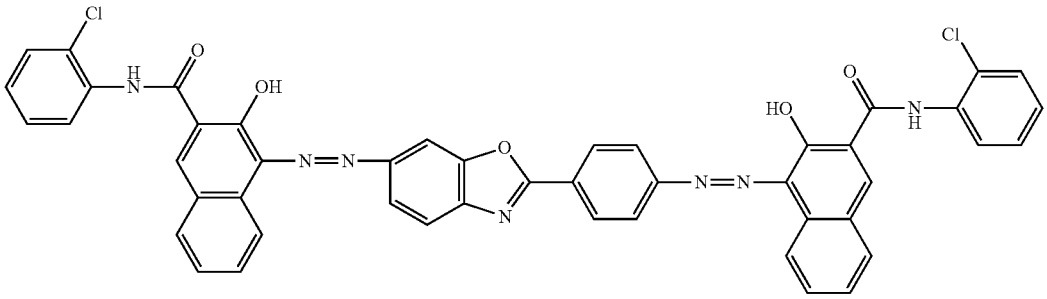 |
| CG-3 | 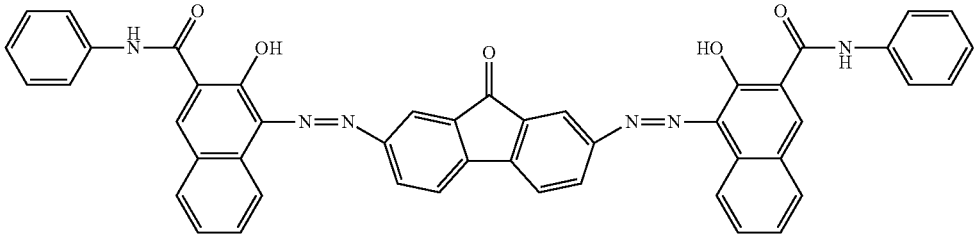 |
| CG-4 | 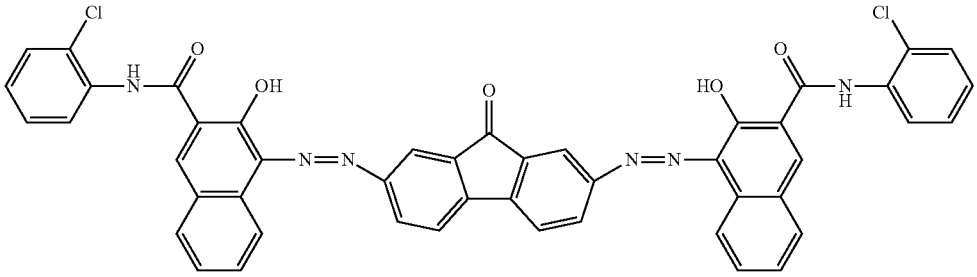 |
| CG-5 | 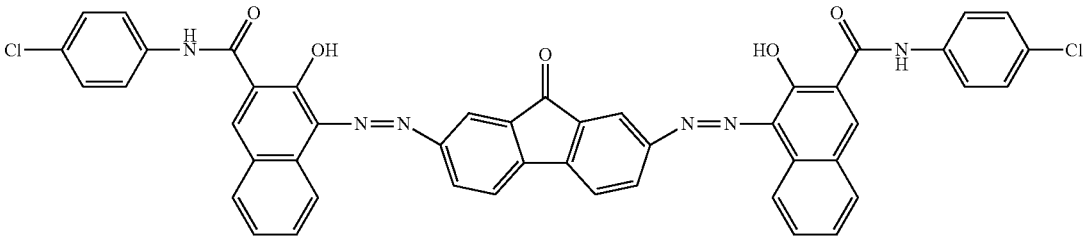 |
| CG-6 | 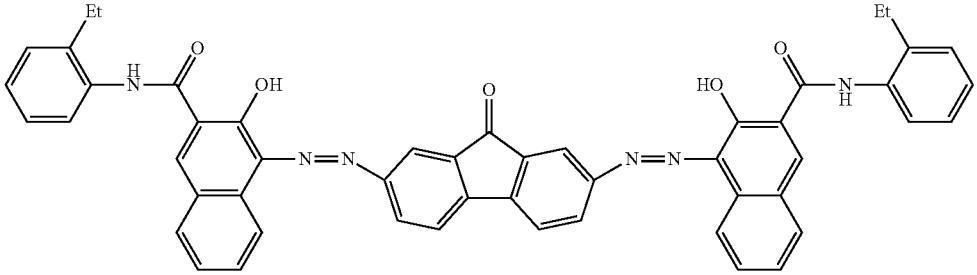 |
| CG-7 | 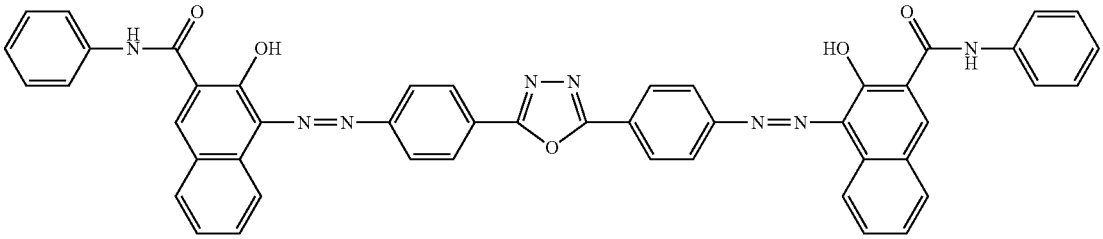 |

-continued
| Structural formula |
| --- |
| CG-8 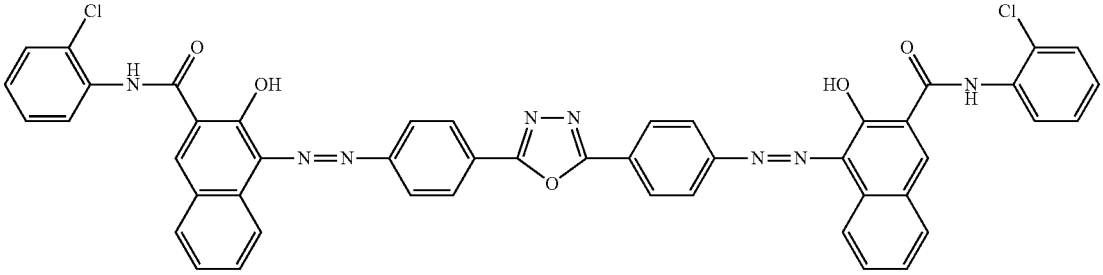 |
| CG-9 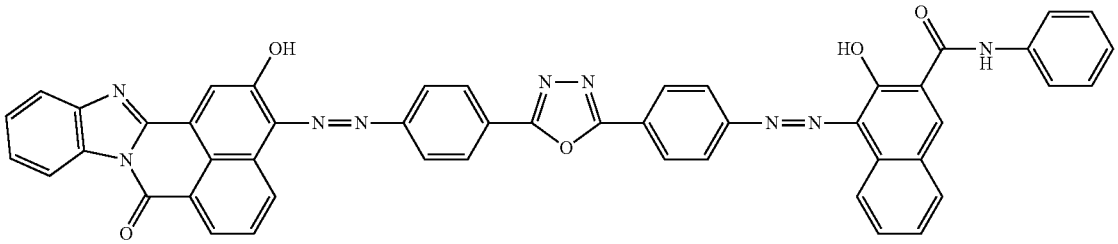 |
| CG-10 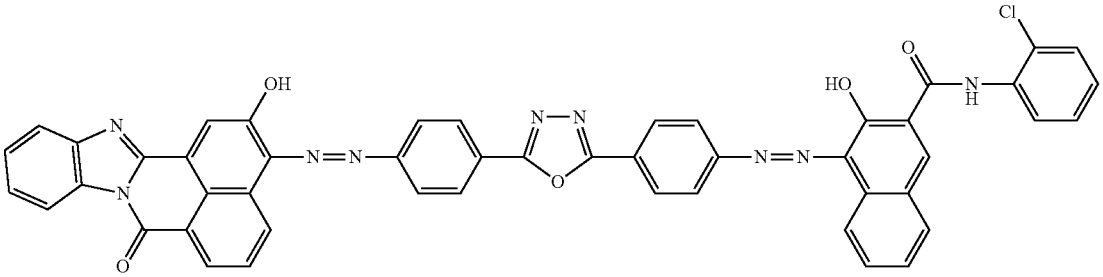 |
| CG-11 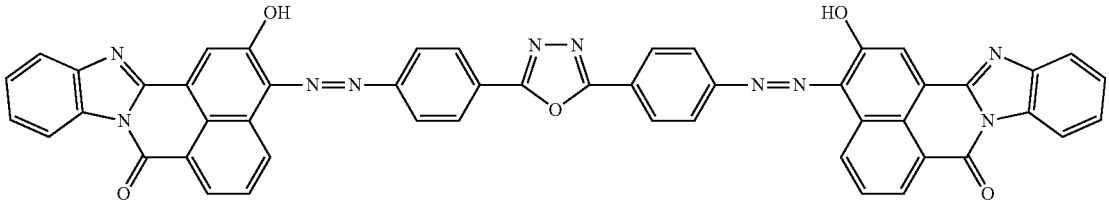 |
| CG-12 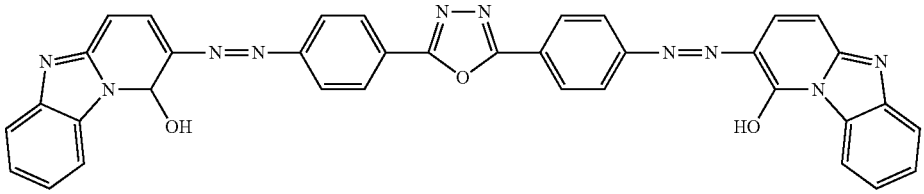 |
| CG-13 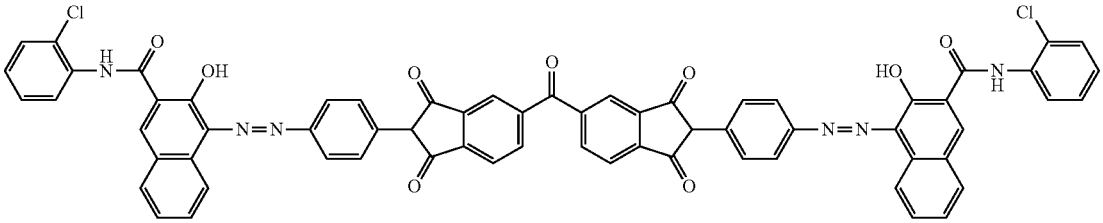 |

-continued
| | Structural formula |
|---|---|
| CG-14 | 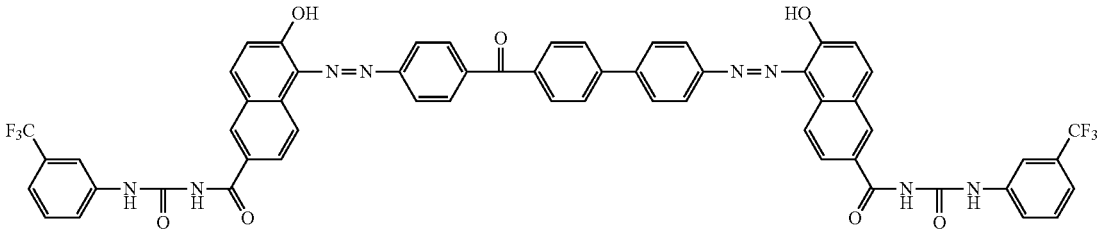 |
| CG-15 | 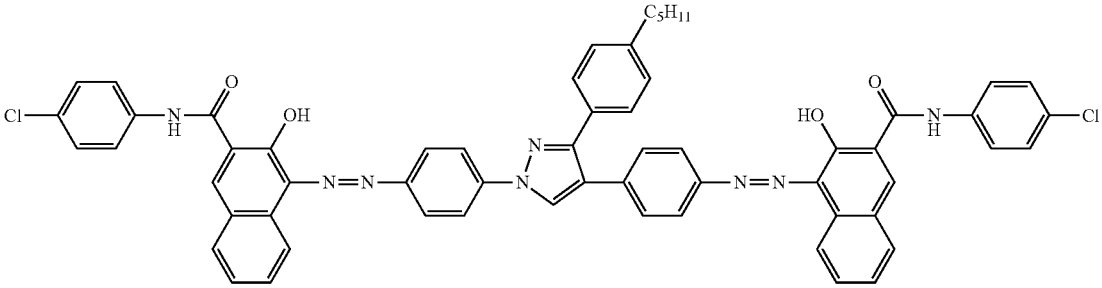 |
| CG-16 | 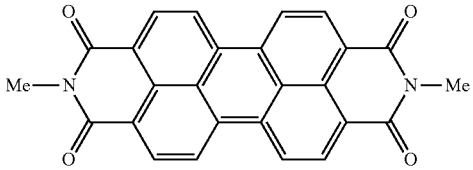 |
| CG-17 | 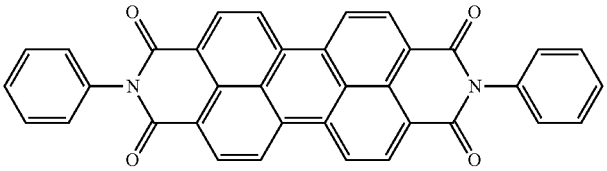 |
| CG-18 | 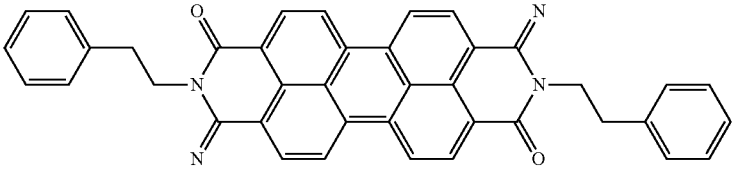 |
| CG-19 | 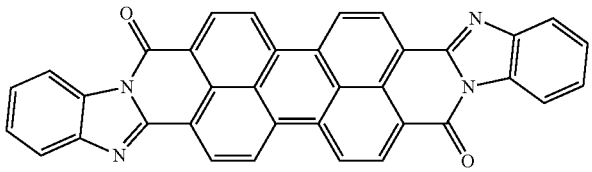 |
| CG-20 | 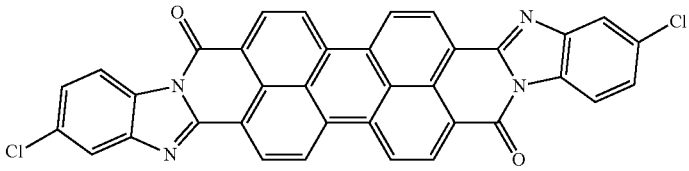 |

-continued
| Structural formula |
| --- |
| CG-21 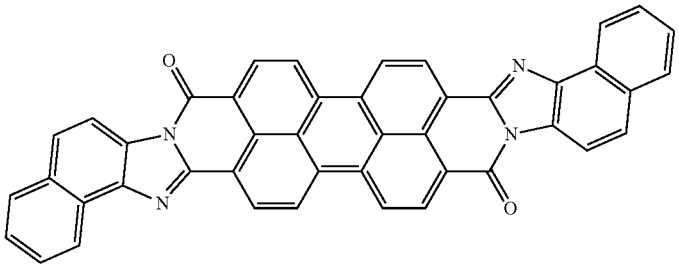 |
| CG-22 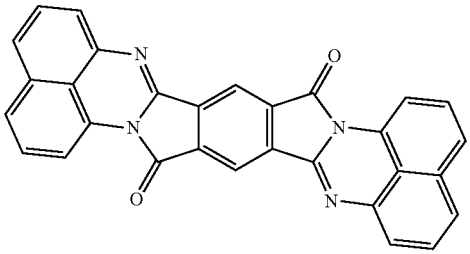 |
| CG-23 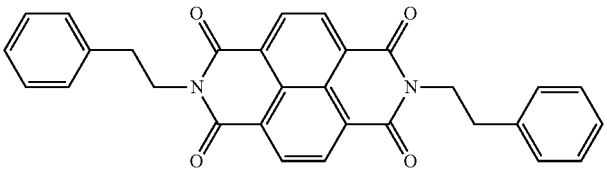 |
| CG-24 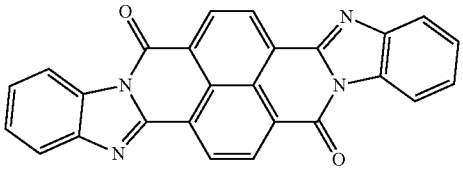 |
| CG-25 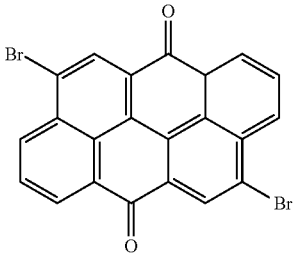 |
| CG-26 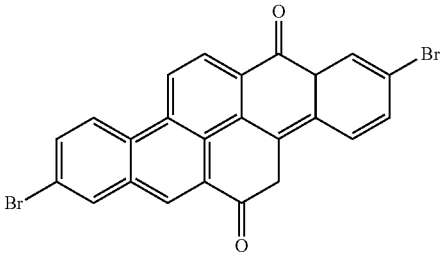 |

-continued

| | Structural formula |
|---|---|
| CG-27 | 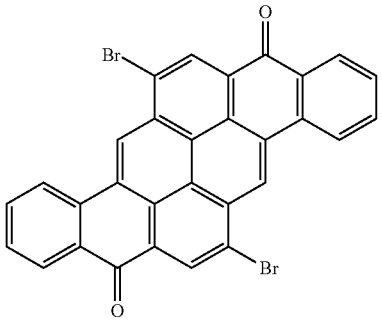 |

The binder resin used in the charge generating layer 2 is selected from a wide range of insulating resins, or may be selected from organic photoconductive polymers such as poly-N-vinylcarbazole, polyvinylanthracene, polyvinylpyrene, and polysilane. Preferable examples of the binder resin include polyvinyl butyral resin, polyarylate resin (such as a polycondensate made from a bisphenol and an aromatic divalent carboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. These binder resins may be used singly or as a mixture of two or more kinds thereof. The blend ratio by weight of the charge generating material to the binder resin is preferably in the range of 10:1 to 1:10. The term "insulating" herein means $10^{13}$ Ω·cm or more in terms of volume resistivity.

The charge generating layer 2 is formed using a coating liquid for forming a charge generating layer, in which the above-mentioned charge generating material and binder resin are dispersed in a predetermined solvent. Further, it may be formed as a deposited film containing no binder resin, and particularly, a condensed-ring aromatic pigment and a perylene pigment is preferably used as the deposited film.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These may be used singly or as a mixture of two or more kinds thereof.

Incidentally, as a method for dispersing the charge generating material and the binder resin in the solvent, an ordinary method, such as a ball mill dispersing method, an attritor dispersing method, and a sand mill dispersing method is used. According to such a dispersing method, the crystal form of the charge generating material is prevented from being changed by dispersion.

Further, at the time of the dispersion, it is effective to adjust the average particle size of the charge generating materials to be 0.5 μm or less, preferably 0.3 μm or less, and more preferably 0.15 μm or less.

Moreover, when the charge generating layer 2 is formed, an ordinary method such as a blade coating method, a wire bar coating method, an extrusion coating method, a spray coating method, a dipping coating method, a bead coating method, an air knife coating method, and a curtain coating method is used.

The film thickness of the thus-obtained charge generating layer 2 is preferably from 0.1 μm to 5.0 μm, and more preferably from 0.2 μm to 2.0 μm.

Charge Transporting Layer

The charge transporting layer 3 is formed so as to contain a charge transporting material and a binder resin, or a charge transporting polymer material.

Examples of the charge transporting material include electron transporting compounds including quinone compounds such as p-benzoquinone, chloranil, bromanil, and anthraquinone; tetracyanoquinodimethane compounds; fluorenone compounds such as 2,4,7-trinitrofluorenone, xanthone compounds, benzophenone compounds, cyanovinyl compounds, and ethylene compounds; and hole transporting compounds including triarylamine compounds, benzidine compounds, arylalkane compounds, aryl-substituted ethylene compounds, stilbene compounds, anthracene compounds, and hydrazone compounds. These charge transporting materials may be used singly or in combination of two or more kinds thereof, but are not limited thereto.

From the viewpoint of charge mobility, the charge transporting material is preferably a triarylamine derivative represented by the formula (a-1) and a benzidine derivative represented by the formula (a-2).

Among the triarylamine derivatives each represented by the formula (a-1) and the benzidine derivatives each represented by the formula (a-2), triarylamine derivatives each having "$—C_6H_4—CH=CH—CH=C(R^{13})(R^{14})$" and benzidine derivatives each having "$—CH=CH—CH=C(R^{21})(R^{22})$" are particularly preferable from the viewpoints that they are excellent in charge mobility, adhesiveness to the protective layer 5 (outermost surface layer), resistance to the residual image that occurs owing to the remaining history of a previous images (hereinafter also referred to as a "ghost"), and others.

Furthermore, as the charge transporting polymer material, known materials having charge transporting properties, such as poly-N-vinylcarbazole and polysilane are used. The polyester charge transporting polymer materials disclosed in JP-A-8-176293, JP-A-8-208820, and the like are particularly preferable. The charge transporting polymer materials may form a film independently, but may also be mixed with the above-described binder resin to form a film.

Examples of the binder resins for use in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. The polyester charge transporting polymer material disclosed in JP-A-8-176293 and JP-A-8-208820, and the like may be also used. Among these resins, polycarbonate resins or polyarylate resins are preferable.

These binder resins may be used singly or in combination of two or more kinds thereof.

As the binder resin for use in the charge transporting layer 3 (that is, the binder resin of a lower layer of the protective layer 5 (outermost surface layer)), a polycarbonate copolymer (hereinafter also referred to as a "specific polycarbonate copolymer") having a solubility parameter (hereinafter also referred to as "SP value") as calculated by a Feders method of from 11.40 to 11.75 (preferably from 11.40 to 11.70) is applied.

When the SP value of the specific polycarbonate copolymer is within the above ranges, the mixing with the material of the protective layer 5 (outermost surface layer) is suppressed, and thus, the electrical characteristics and the mechanical strength of the protective layer 5 are easily enhanced.

Particularly, in the case where the resin particles are included in the protective layer 5 (outermost surface layer), when the SP value of the specific polycarbonate copolymer is 11.40 or more, the uneven distribution of the resin particles on the side of the surface layer of the protective layer 5 is suppressed. On the other hand, when the SP value of the specific polycarbonate copolymer is 11.75 or less, the deterioration of the compatibility with the charge transporting material of the charge transporting layer 3 is suppressed, and thus, a decrease in the electrical characteristics of the electrophotographic photoreceptor (particularly an increase in the residual potential due to the repeated use) is easily suppressed.

The specific polycarbonate copolymer preferably has repeating structural units having an SP value of from 12.2 to 12.4. It is thought that if the repeating structural units having a high SP value in the above range are included as at least one of the repeating structural units of the polycarbonate copolymer, the entire specific polycarbonate copolymer is likely to have decreased compatibility with the resin components of a protective layer 5 (outermost surface layer), and thus, the diffusion of the charge transporting material of the charge transporting layer 3 into the protective layer 5 is easily suppressed. As a result, a decrease in the electrical characteristics of the electrophotographic photoreceptor (in particular, an increase in the residual potential due to the repeated used) is easily suppressed.

Here, the Feders method refers to a method for conveniently calculating a solubility parameter (SP value) from a formula. Specifically, in the Feders method, when the cohesive energy density is denoted as ΔE and the molar volume is denoted as V, the solubility parameter is calculated from SP Value $\delta=(AE/V)^{1/2}=(\Sigma\Delta_{ei}/\Sigma\Delta_{vi})^{1/2}$. Further, ei and vi are the cohesive energy and the molar volume of the unit of the formula, respectively, and the list thereof is described in, for example, "Fundamentals and Engineering of Coating" (Processing Technology Study Association), p. 55".

Further, $(cal/cm^3)^{1/2}$ is employed as a unit of the solubility parameter (SP value), but according to the customary practice, the solubility parameter is denoted without a dimension with the omission of the unit.

Moreover, the method for calculating the solubility parameter (SP value) according to the Feders method is defined as follows. That is, the solubility parameter of the repeating structural unit constituting the copolymer is denoted as δn and the presence ratio (molar ratio) of the repeating structural unit in the copolymer is denoted as χn, the solubility parameter (SP value) of the copolymer is denoted as $\delta=\Sigma(\delta n\cdot\chi n)$. When the solubility parameter (SP value) of the repeating structural unit is calculated, as the cohesive energy and the molar volume of the carbonate group, the values of $\Delta e_i$=4200 cal/mol and $\Delta v_i$=22.0 $cm^3$/mol are used, which are shown in the list of "Fundamentals and Engineering of Coating" (Processing Technology Study Association), p. 55. For example, in the case where the copolymer is a polycarbonate copolymer formed by the polymerization of bisphenol Z monomers and bisphenol F monomers, and the molar ratio of the respective repeating units is 70% of Z units/30% of F units, the repeating unit structure of the Z unit is the following Z unit (I): $\delta_z=((1180\times5+350\times1+7630\times2+4200\times1+250\times1)/(16.1\times5+(-19.2)\times1+52.4\times2+22.0\times1+16\times1))^{1/2}=11.28$; the repeating unit structure of the F unit is the following F unit (I): $\delta_F=((1180\times1+7630\times2+4200\times1)/(16.1\times1+52.4\times2+22.0\times1))^{1/2}=12.02$; and the solubility parameter $\delta_{Z70F30}$ of the polycarbonate copolymer is as follows: $\delta_{Z70F30}=11.28\times0.7+12.02\times0.3=11.50$.

Z unit (I)

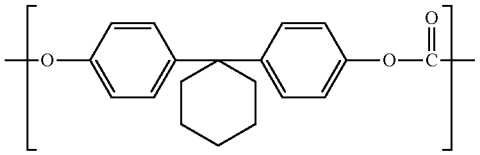

F unit (I)

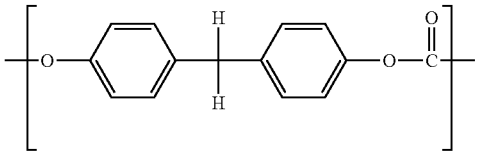

Specific examples of the specific polycarbonate copolymer include a copolymer of at least two or more divalent monomers (hereinafter referred to as a "divalent phenol") selected from a biphenyl monomer and a bisphenol monomer.

Particularly, from the viewpoint of the improvement of electrical characteristics and mechanical strength of the protective layer 5 (outermost surface layer), and suppression of the uneven distribution of the resin particles on the surface layer side of the protective layer 5 (outermost surface layer), suitable examples of the specific polycarbonate copolymer include a polycarbonate copolymer having the repeating structural units represented by the following formula (PC-1) and a polycarbonate copolymer having the repeating structural units represented by the following formula (PC-2).

Specifically, examples of the specific polycarbonate copolymer include:

1) a polycarbonate copolymer having two or more repeating structural units represented by the following formula (PC-1), having different structures from each other, 2) a polycarbonate copolymer having two or more repeating structural units represented by the following formula (PC-2), having different structures from each other, and 3) a polycarbonate copolymer having one repeating structural unit or two or more repeating structural units represented by the following formula (PC-1), having different structures from each other, and one repeating structural unit or two or more repeating structural units represented by the following formula (PC-2), having different structures from each other.

Further, for the specific polycarbonate copolymer, each repeating structural unit (monomer) is selected so as to allow the SP value to be in the above range.

(PC-1)

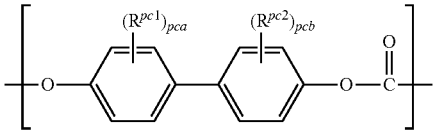

In the formula (PC-1), $R^{pc1}$ and $R^{pc2}$ each independently represent a halogen atom, an alkyl group having 1 to 6 carbon atoms, a cycloalkyl group having 5 to carbon atoms, or an aryl group having 6 to 12 carbon atoms.

pca and pcb each independently represent an integer of 0 to 4.

In the formula (PC-1), $R^{pc1}$ and $R^{pc2}$ each independently preferably represent an alkyl group having 1 to 6 carbon atoms, and more preferably a methyl group.

In the formula (PC-1), pca and pcb each independently represent an integer of preferably 0 to 2, and in particular, most preferably 0.

(PC-2)

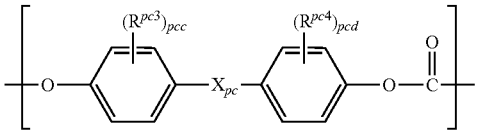

In the formula (PC-2), $R^{pc3}$ and $R^{pc4}$ each independently represent a halogen atom, an alkyl group having 1 to 6 carbon atoms, a cycloalkyl group having 5 to carbon atoms, or an aryl group having 6 to 12 carbon atoms. pcc and pcd each independently represent an integer of 0 to 4. $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α,ω-alkylene group having 2 to 10 carbon atoms, —O—, —S—, —SO—, or —$SO_2$—.

In the formula (PC-2), $R^{pc3}$ and $R^{pc4}$ each independently preferably represent an alkyl group having 1 to 6 carbon atoms, and more preferably a methyl group.

pcc and pcd each independently preferably represent an integer of 0 to 2.

$X_{pc}$ preferably represents —$CR^{pc5}R^{pc6}$— (provided that $R^{pc5}$ and $R^{pc6}$ each independently represent a hydrogen atom or an alkyl group having 1 to 6 carbon atoms), or a 1,1-cycloalkylene group having 5 to 11 carbon atoms.

For the specific polycarbonate copolymer, from the viewpoint of the improvement of electrical characteristics and mechanical strength of the protective layer 5 (outermost surface layer), and suppression of uneven distribution of the resin particles on the surface layer side of the protective layer 5, the ratio (molar ratio) of the repeating structural unit represented by the formula (PC-1) may be from 20% by mole to 40% by mole, preferably from 23% by mole to 37% by mole, more preferably from 25% by mole to 35% by mole based on the specific polycarbonate copolymer (the entire repeating structural units).

Furthermore, from the same viewpoint, the ratio (molar ratio) of the repeating structural unit represented by the formula (PC-2) may be from 35% by mole to 55% by mole, preferably from 38% by mole to 52% by mole, more preferably from 40% by mole to 50% by mole based on the polycarbonate copolymer (the entire repeating structural units).

Specific examples of the repeating unit constituting the specific polycarbonate copolymer are shown below. Further, specific examples (units) of the repeating structural unit are shown by exemplifying the structures of the X moiety of the divalent phenol HO—(X)—OH that forms the repeating unit. Specifically, for example, the repeating structural unit represented by "(BP)-0" in the column of Unit No. represents a structural unit represented by [—O— (the structure shown in the column of the structure) —O—C(═O)—].

| Unit No. | Structure | Solubility parameter (SP value) |
|---|---|---|
| (BP)-0 | 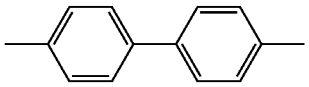 | 12.39 |
| (BP)-1 | 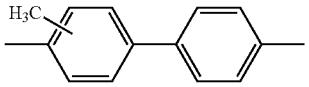 | 12.07 |
| (BP)-2-a | 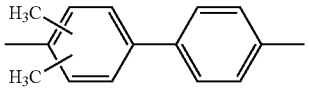 | 11.80 |
| (BP)-2-b | 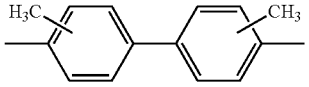 | 11.80 |
| (BP)-3 | 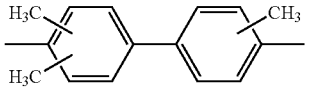 | 11.58 |
| (BP)-4 | 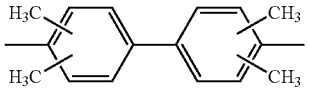 | 11.39 |
| (F)-0 | 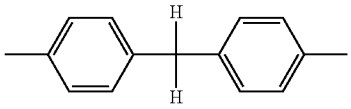 | 12.02 |
| (F)-1 | 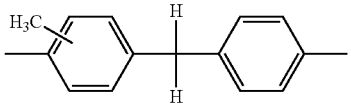 | 11.76 |
| (F)-2-a | 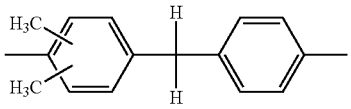 | 11.54 |
| (F)-2-b | 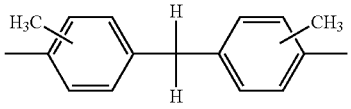 | 11.54 |

-continued
| Unit No. | Structure | Solubility parameter (SP value) |
|---|---|---|
| (F)-3 | 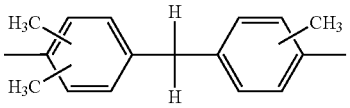 | 11.35 |
| (F)-4 | 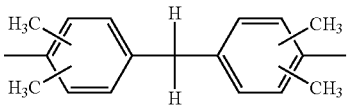 | 11.19 |
| (E)-0 | 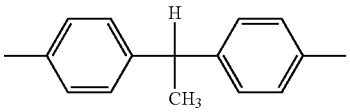 | 11.59 |
| (E)-1 | 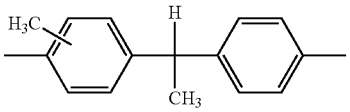 | 11.39 |
| (E)-2-a | 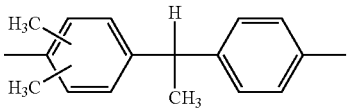 | 11.21 |
| (E)-2-b | 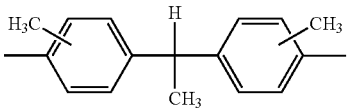 | 11.21 |
| (E)-3 | 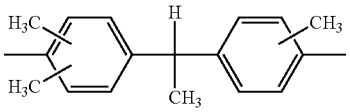 | 11.05 |
| (E)-4 | 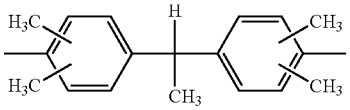 | 10.92 |
| (A)-0 | 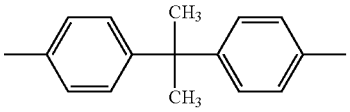 | 11.24 |
| (A)-1 | 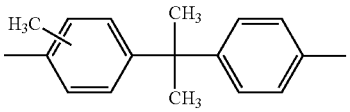 | 11.07 |
| (A)-2-b | 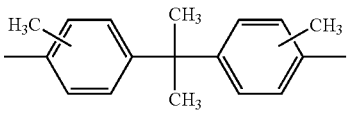 | 10.93 |
| (C)-0 | 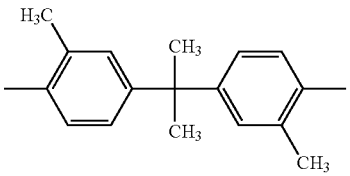 | 10.93 |
-continued
| Unit No. | Structure | Solubility parameter (SP value) |
|---|---|---|
| (A)-2-a | 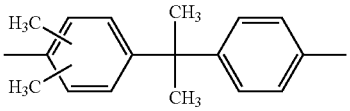 | 10.93 |
| (A)-3 | 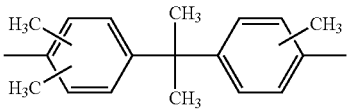 | 10.80 |
| (A)-4 | 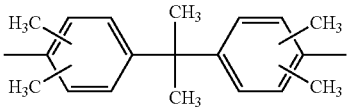 | 10.69 |
| (Oth)-1 | 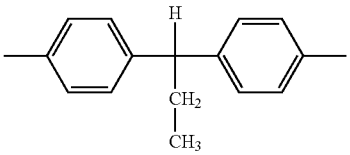 | 11.35 |
| (Oth)-2 | 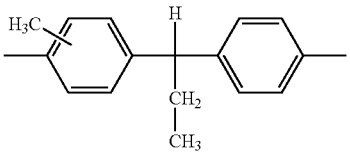 | 11.17 |
| (Oth)-3 | 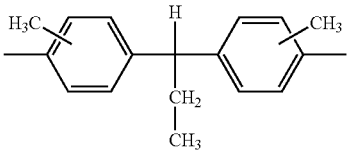 | 11.02 |
| (Oth)-4 | 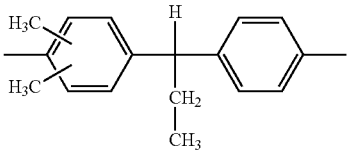 | 10.54 |
| (B)-0 | 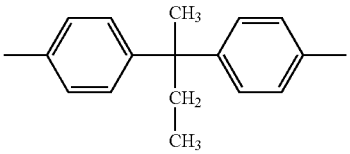 | 11.04 |
| (Oth)-5 | 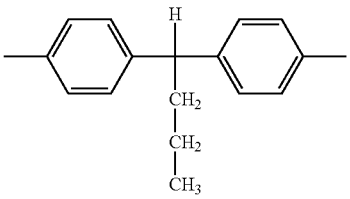 | 11.14 |

-continued
| Unit No. | Structure | Solubility parameter (SP value) |
|---|---|---|
| (Oth)-6 | 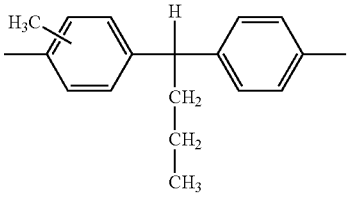 | 10.99 |
| (Oth)-7 | 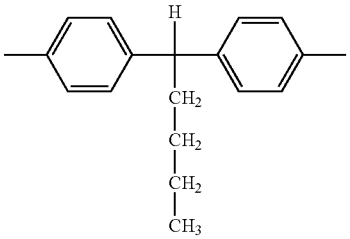 | 10.96 |
| (Oth)-8 | 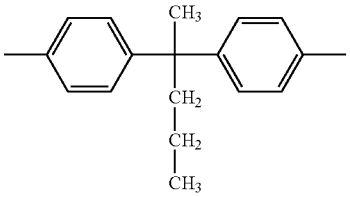 | 10.87 |
| (Oth)-9 | 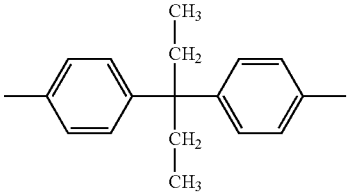 | 10.87 |
| (Oth)-10 | 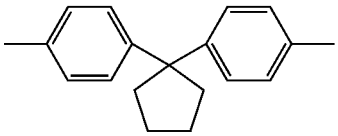 | 11.48 |
| (Oth)-11 | 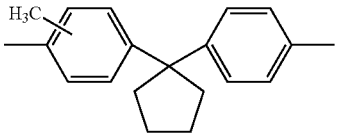 | 11.31 |
| (Oth)-12 | 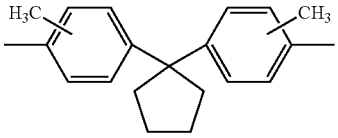 | 11.16 |
| (Oth)-13 | 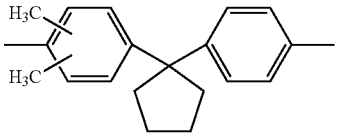 | 11.16 |
-continued
| Unit No. | Structure | Solubility parameter (SP value) |
|---|---|---|
| (Oth)-14 | 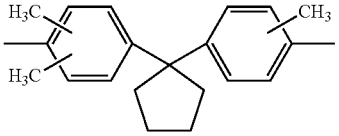 | 11.03 |
| (Oth)-15 | 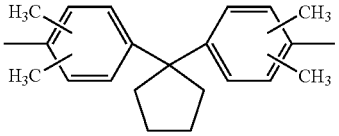 | 10.91 |
| (Z)-0 | 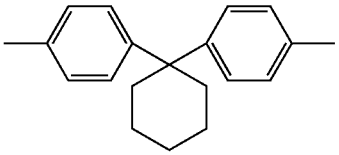 | 11.28 |
| (Z)-1 | 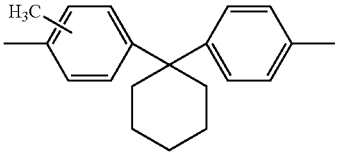 | 11.13 |
| (Z)-2-b | 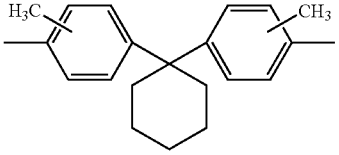 | 11.00 |
| (Z)-2-a | 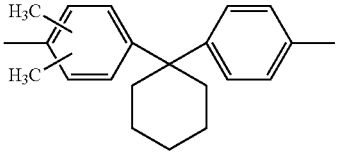 | 11.00 |
| (Z)-3 | 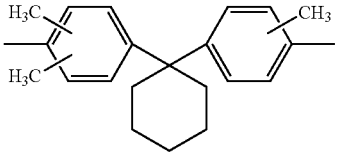 | 10.88 |
| (Z)-4 | 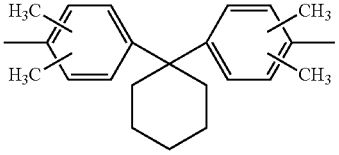 | 10.78 |
| (AP)-0 | 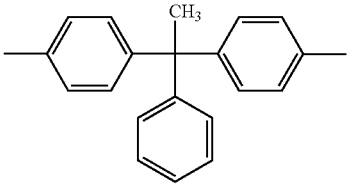 | 11.59 |

-continued

| Unit No. | Structure | Solubility parameter (SP value) |
|---|---|---|
| (TP)-0 | 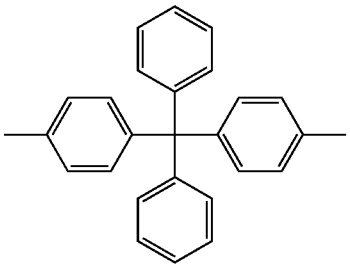 | 11.83 |

The specific polycarbonate copolymers may be used singly or in combination of two or more kinds thereof.

The viscosity average molecular weight of the specific polycarbonate copolymer is preferably 30000 or more, and more preferably 45000 or more. The upper limit of the viscosity average molecular weight of the specific polycarbonate copolymer is preferably 100000 or less.

Here, the viscosity average molecular weight is a value measured by a capillary viscometer.

The specific polycarbonate copolymer is synthesized by a well-known method, for example, by using a method in which a divalent phenol is reacted with a carbonate precursor material such as phosgene and carbonate diesters. Hereinafter, the basic method for this synthesis method will be briefly described.

For example, in the reaction using, for example, phosgene as a carbonate precursor material, the reaction is usually carried out in the presence of an acid binder and a solvent. As the acid binder, for example, pyridine, alkali metal hydroxides such as sodium hydroxide and potassium hydroxide, and the like are used. As the solvent, for example, halogenated hydrocarbons such as methylene chloride and chlorobenzene are used. Further, in order to promote the reaction, for example, a catalyst such as a tertiary amine and a quaternary ammonium salt may be used. The reaction temperature is usually from 0° C. to 40° C., the reaction time is from several minutes to 5 hours, and the pH during the reaction may be usually 10 or more, preferably.

In the polymerization reaction, monofunctional phenols that are usually used as a chain terminator may be used. Examples of these monofunctional phenols include phenol, p-tert-butylphenol, p-cumylphenol, and isooctylphenol.

For the specific polycarbonate copolymer, binder resins other than the specific polycarbonate copolymers may be used in combination. However, the content of the specific polycarbonate copolymers in the binder resin is, for example, 10% by weight or less, based on the entire binder resins.

Examples of the binder resin other than the specific polycarbonate copolymer include insulating resins such as a polycarbonate resin other than the specific polycarbonate copolymer, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinylacetate resin, a polyvinylformal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, and chlorine rubber, and organic photoconductive polymers such as a polyvinylcarbazole, a polyvinylanthracene, and a polyvinylpyrene. These binder resins may be used singly or in a mixture of two or more kinds thereof.

Further, the blending ratio of the charge transporting material to the binder resin is preferably, for example, from 10:1 to 1:5 in terms of the weight ratio.

The charge transporting layer 3 may be formed using the coating liquid for forming the charge transporting layer containing the above-described constituents.

Examples of the solvent used for the coating liquid for forming the charge transporting layer include ordinary organic solvents such as aromatic hydrocarbons such as benzene, toluene, xylene and chlorobenzene, ketones such as acetone and 2-butanone, aliphatic halogenated hydrocarbons such as methylene chloride, chloroform and ethylene chloride, cyclic or straight-chained ethers such as tetrahydrofuran and ethyl ether. These solvents may be used alone or in combination of two or more kinds thereof. Known methods may be used for dissolving the above-described constituents.

As a coating method for coating the charge generating layer 2 with a coating liquid for forming a charge transporting layer, an ordinary method such as a blade coating method, a wire bar coating method, an extrusion coating method, a spray coating method, a dipping coating method, a bead coating method, an air knife coating method, and a curtain coating method is used.

The film thickness of the charge transporting layer 3 is preferably from 5 μm to 50 μm, and more preferably from 10 μm to 30 μm.

The configuration of each layer in the function separation type photosensitive layer are described with reference to the electrophotographic photoreceptor 7A shown in FIG. 1, but such a configuration may also be adopted for each layer in the function separation type electrophotographic photoreceptor 7B shown in FIG. 2. In addition, in the case of the single-layer photosensitive layer 6 of the electrophotographic photoreceptor 7C shown in FIG. 3, the following aspect is preferable.

That is, the content of the charge generating material in the single-layer photosensitive layer 6 is preferably from 5% by weight to 50% by weight, more preferably from 10% by weight to 40% by weight, and particularly preferably from 15% by weight to 35% by weight, based on the total solid content of the composition used for forming the protective layer 5 (outermost surface layer).

As a method for forming the single-layer photosensitive layer 6, a forming method for the charge generating layer 2 or the charge transporting layer 3 may be adopted. The film thickness of the single-layer photosensitive layer 6 is preferably from 5 μm to 50 μm, and more preferably from 10 μm to 40 μm.

Image Forming Apparatus (and Process Cartridge)

Hereinafter, the image forming apparatus (and a process cartridge) according to the present exemplary embodiment will be described in detail.

According to the exemplary embodiment, an image forming apparatus includes the electrophotographic photoreceptor according to the exemplary embodiment; a charging unit that charges a surface of the electrophotographic photoreceptor; an electrostatic latent image forming unit that forms an electrostatic latent image on a charged surface of the electrophotographic photoreceptor; a developing unit that develops the electrostatic latent image formed on the surface of the electrophotographic photoreceptor with a developer including a toner to form a toner image; and a transfer unit that transfers the toner image onto a transfer medium.

Figure 4:
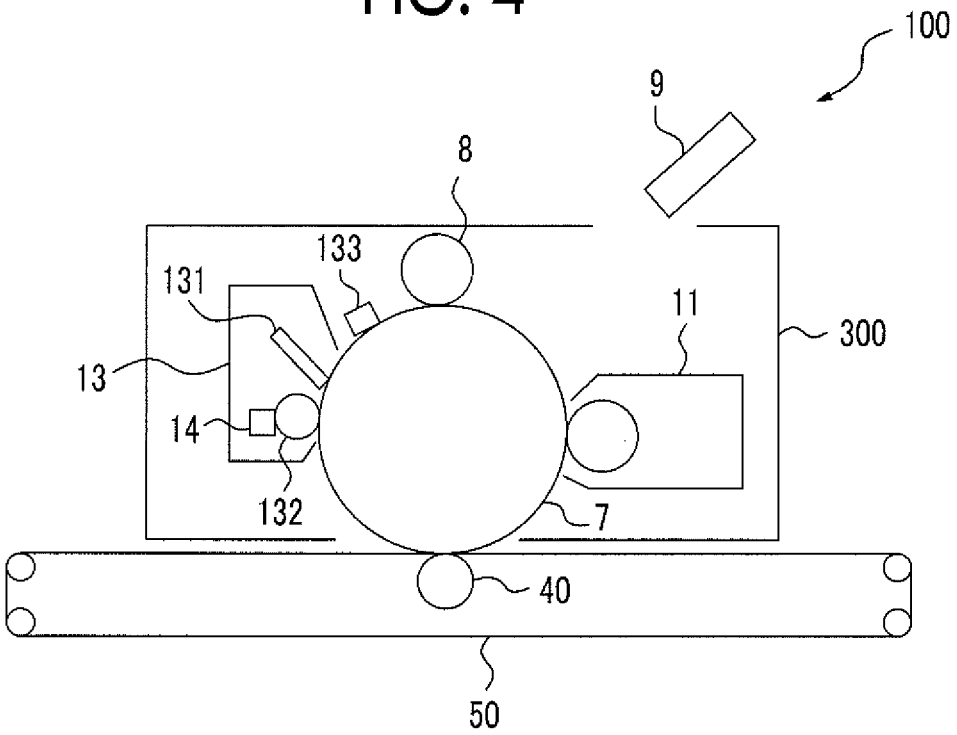
FIG. 4 is a schematic structural view showing an example of the image forming apparatus according to the present exemplary embodiment.

FIG. 4 is a schematic structural view showing an example of the image forming apparatus according to the present exemplary embodiment.

The image forming apparatus 100 according to the present exemplary embodiment is provided with a process cartridge 300 having an electrophotographic photoreceptor as shown in FIG. 4, an exposure device 9, a transfer device 40 (primary transfer device), and an intermediate transfer medium 50. Further, in the image forming apparatus 100, the exposure device 9 is arranged at a position where the exposure device 9 may expose the electrophotographic photoreceptor 7 through an opening in the process cartridge 300, and the transfer device 40 is arranged at a position opposite the electrophotographic photoreceptor 7 by the intermediary of the intermediate transfer medium 50. The intermediate transfer medium 50 is arranged to contact partially the electrophotographic photoreceptor 7. Further, although not shown in the figure, the apparatus also includes a secondary transfer device that transfers a toner image transferred onto the intermediate transfer medium 50 to a transfer medium (recording medium).

The process cartridge 300 in FIG. 4 supports an electrophotographic photoreceptor 7, a charging device 8, a developing device 11, and a cleaning device 13 as a unit in a housing. The cleaning device 13 has a cleaning blade (cleaning member), and the cleaning blade 131 is arranged so as to be in contact with the surface of the electrophotographic photoreceptor 7.

Furthermore, an example in which a fibrous member 132 (in a roll form) that supplies a lubricant material 14 onto the surface of the photoreceptor 7, and a fibrous member 133 (in a flat brush form) that assists cleaning are used is shown; however these members may or may not be used.

Hereinafter, the respective configurations of the image forming apparatus according to the present exemplary embodiment will be described.

Charging Device

As the charging device 8, for example, a contact type charger using an electroconductive or semiconductive charging roll, a charging brush, a charging film, a charging rubber blade, a charging tube, or the like is used. In addition, known chargers themselves, such as a non-contact type roller charger, and a scorotron charger and a corotron charger, each using corona discharge are also used.

A photoreceptor heating member, although not shown in the figure, may be further arranged around the electrophotographic photoreceptor 7 to raise the temperature of the electrophotographic photoreceptor 7, thus to decrease the relative temperature.

Exposure Device

The exposure device 9 may be an optical instrument for exposure of the surface of the photoreceptor 7, to rays such as a semiconductor laser ray, an LED ray, and a liquid crystal shutter ray in a predetermined imagewise manner. The wavelength(s) of the light source may be a wavelength or wavelengths in the range of the spectral sensitivity of the photoreceptor. As the wavelengths of semiconductor laser, near infrared wavelengths that are oscillation wavelengths near 780 nm are predominant. However, the wavelength of the laser ray to be used is not limited to such a wavelength, and a laser having an oscillation wavelength of 600 nm range, or a laser having any oscillation wavelength in the range of 400 nm to 450 nm may be used as a blue laser. In order to form a color image, it is effective to use a plane-emissive type laser light source capable of attaining a multi-beam output.

Here, as a light source of the exposure device 9, an incoherent exposure light source is preferably applied.

The incoherent exposure light source is a light source that radiates incoherent light, and for example, as the incoherent exposure light source, an LED, an organic EL image array, or the like is adopted.

The area of the exposures spot of the surface of the electrophotographic photoreceptor exposed by the incoherent exposure light source is 1000 $\mu m^2$ or less, and the light-emitting center wavelength of the incoherent exposure light source is preferably from 450 nm to 780 nm.

Next, an example of the exposure head will be described.

Figure 6:
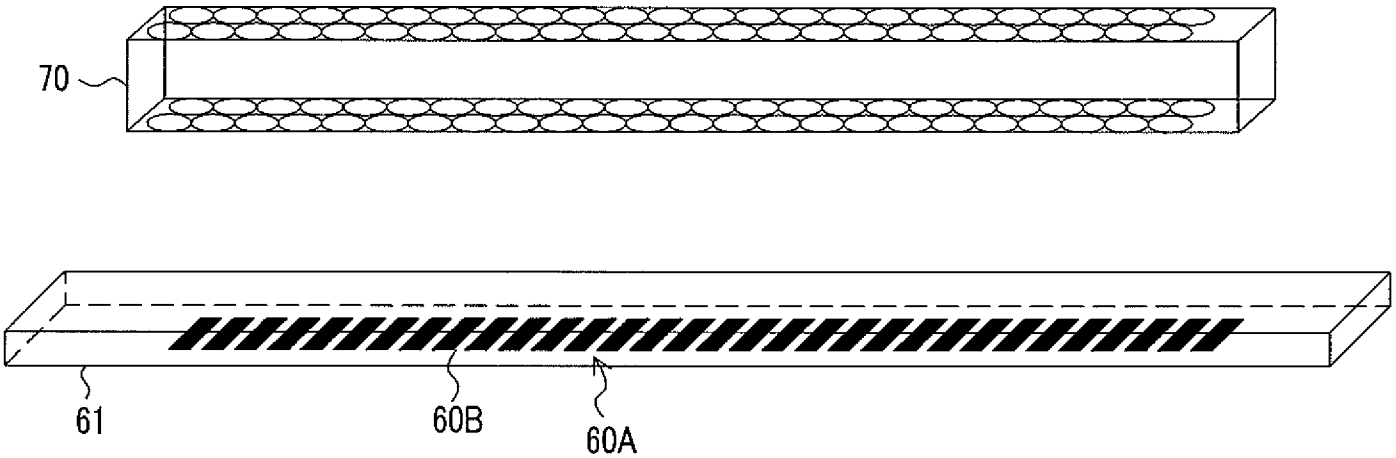
FIG. 6 is a schematic structural view showing an example of the exposure head.
Figure 7:
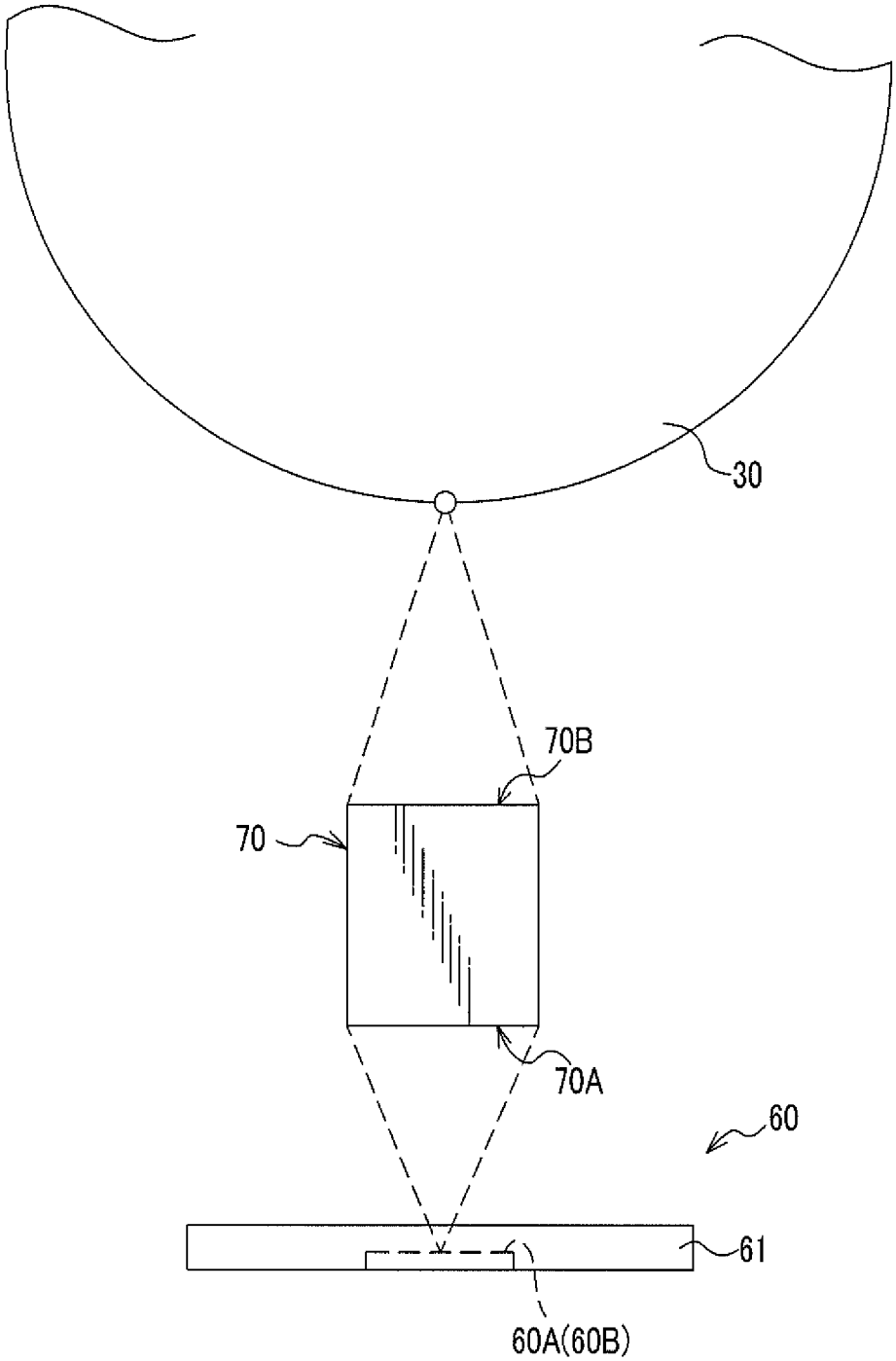
FIG. 7 is a schematic diagram showing the state of subjecting the electrophotographic photoreceptor to exposure by an exposure head.

FIG. 6 is a view showing an example of the exposure head, and FIG. 7 is a view showing a state in which an example of the photoreceptor is subjected to exposure by the exposure head. Each of the exposure heads includes, as shown in FIGS. 6 and 7, for example, an organic EL element array (light-emitting element array 60B) and an image pickup unit (lens 70).

The light emitting element array 60B includes, for example, a light emitting unit constituted with an organic EL element (light-emitting element 60A), and a mounting substrate on which the organic EL element is mounted (corresponding to the light-emitting element array substrate 61 in FIG. 6).

The organic EL element array (light-emitting element array 60B) and the image pickup unit (lens 70) are held apart by a holding member such that the optical distance between the light-emitting unit (light-emitting element 60A) and the light incidence surface 70A of the image pickup unit is a working distance of the image pickup unit.

Here, the working distance of the image pickup unit refers to a distance between a focal point of the lens 70 used in the image pickup unit and the incident surface 70A of the image pickup unit.

Further, in the image pickup unit, the light emitted from the light-emitting unit is incident from the light incidence surface 70A and simultaneously, output from the light emitting surface 70B to pickup an image at a predetermined position. That is, by pickup of the image emitted from the light-emitting element 60A on the photoreceptor 30, the photoreceptor 30 is exposed to form a latent image (FIG. 7).

Here, the organic EL element array (light-emitting element array 60B) will be described.

The organic EL element array may be, for example, a so-called bottom-emission type that extracts light radiated from a light-emitting unit from the side of a mounting substrate (light-emitting element array substrate 61), but a top-emission type is also available.

The light-emitting unit is constituted with, for example, a group of singular light-emitting elements 60A. The light-emitting elements 60A are arranged linearly (in series) or in a zigzag form along the longitudinal direction of the mounting substrate (light-emitting element array substrate 61) to constitute the light-emitting unit. The light-emitting unit constituted with the group of the light-emitting elements 60A is at least as long as the image forming area of the photoreceptor 30.

Next, the image pickup unit (lens 70) will be described.

The image pickup unit is constituted with, for example, an array of lenses, in which plural rod lenses are arranged. As the lens array, specifically, for example, a distributed refractive index lens array called an SELFOC lens array (SLA: SELFOC is a registered trademark of Nippon Sheet Glass Co., Ltd.) is most preferably used, but a combination of cylindrical lenses may be used. In addition, a microlens may be bonded to an individual organic EL element for a light source.

Developing Device

As the developing device 11, for example, a common developing device, in which a magnetic or non-magnetic single-component or two-component developer is contacted or not contacted for development, may be used. Such a developing device is not particularly limited as long as it has the above-described functions, and may be appropriately selected according to the intended use. Examples thereof include a known developing device in which the single-component or two-component developer is attached to the photoreceptor 7 using a brush or a roller. Among these, the developing device using developing roller retaining developer on the surface thereof is preferable.

Hereinafter, a developer toner used in the developing device 11 will be described.

The developer may be a single-component developer formed of a toner alone or a two-component developer formed of a toner and a carrier.

Cleaning Device

As the cleaning device 13, a cleaning blade type device provided with the cleaning blade 131 is used.

Further, in addition to the cleaning blade type, a fur brush cleaning type and a type of performing developing and cleaning at once may also be used.

Transfer Device

Examples of transfer device 40 include known transfer chargers themselves, such as a contact type transfer charger using a belt, a roller, a film, a rubber blade, or the like, a scorotron transfer charger, and a corotron transfer charger utilizing corona discharge.

Intermediate Transfer Medium

As the intermediate transfer medium 50, a form of a belt which is imparted with the semiconductivity (intermediate transfer belt) of polyimide, polyamideimide, polycarbonate, polyarylate, polyester, rubber, or the like is used. In addition, the intermediate transfer medium may also take the form of a drum, in addition to the form of a belt.

In addition to the above-described devices, the image forming apparatus 100 as described above may further be provided with, for example, a photoerasing device for photoerasing the photoreceptor 7.

Figure 5:
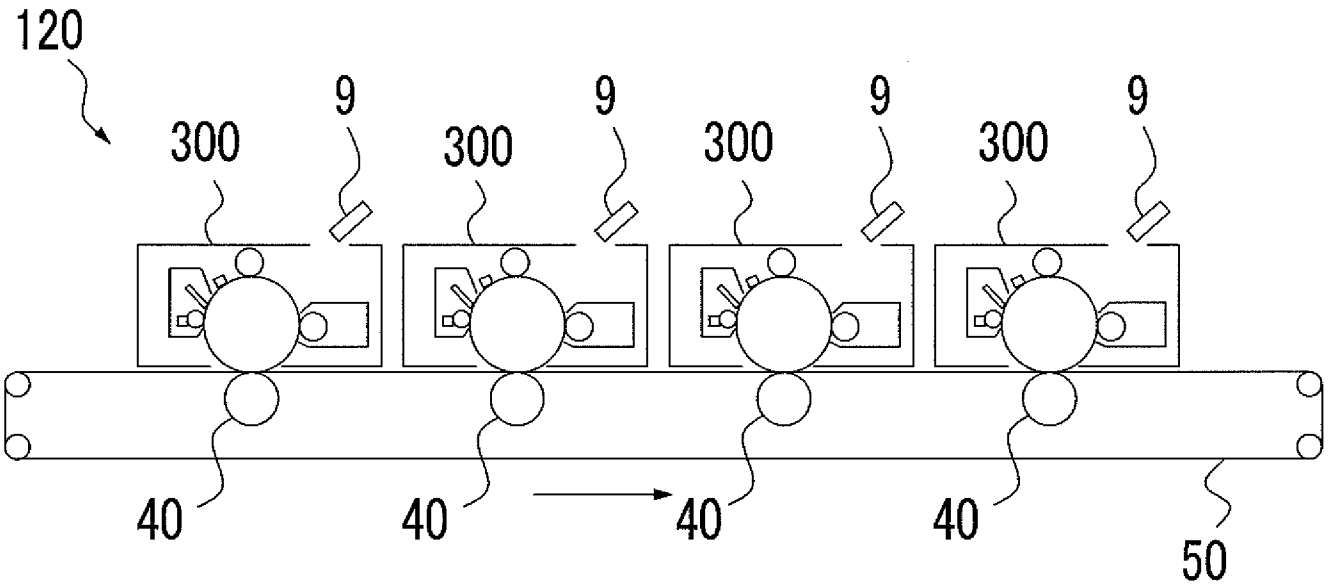
FIG. 5 is a schematic structural view showing another example of the image forming apparatus according to the present exemplary embodiment.

FIG. 5 is a schematic structural view showing another example of the image forming apparatus of the present exemplary embodiment.

The image forming apparatus 120 shown in FIG. 5 is a tandem type multi color image forming apparatus equipped with four process cartridges 300. In the image forming apparatus 120, four process cartridges 300 are disposed parallel with each other on the intermediate transfer medium 50, and one electrophotographic photoreceptor may be used for one color. Further, the image forming apparatus 120 has the same configuration as the image forming apparatus 100, except that it is a tandem type.

Further, it is only necessary that the process cartridge according to the present exemplary embodiment is a process cartridge detachable from an image forming apparatus, which is provided with the electrophotographic photoreceptor according to the present exemplary embodiment, a developing device, and a transfer device having an intermediate transfer medium.

EXAMPLES

Hereinafter, the invention will be described in detail with reference to Examples below, but the present invention is not limited thereto. Further, the "parts" and "%" are based on weight unless otherwise specified.

Example 1

Preparation of Undercoat Layer 100 parts by weight of zinc oxide (average particle size 70 nm: manufactured by Tayca Corporation: specific surface area value 15 $m^2/g$) is stirred and mixed with 500 parts by weight of tetrahydrofuran, and 1.3 parts by weight of a silane coupling agent (KBM503: manufactured by Shin-Etsu Chemical Co., Ltd.) is added thereto, followed by stirring for 2 hours. Subsequently, tetrahydrofuran is evaporated by distillation under reduced pressure and baked at 120° C. for 3 hours to obtain zinc oxide having the surface treated with a silane coupling agent.

110 parts by weight of the surface-treated zinc oxide is stirred and mixed with 500 parts by weight of tetrahydrofuran, and a solution obtained by dissolving 1.0 part by weight of purpurin derivative in 50 parts by weight of tetrahydrofuran is added thereto, followed by stirring at 50° C. for 5 hours. Thereafter, zinc oxide to which a purpurin derivative is added is separated by filtration under reduced pressure, and dried at 60° C. under reduced pressure to obtain purpurin derivative-added zinc oxide.

38 parts by weight of a solution obtained by dissolving 60 parts by weight of the purpurin derivative-added zinc oxide, 13.5 parts by weight of a curing agent (blocked isocyanate, SUMIDUR 3175, manufactured by Sumitomo-Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethyl ketone, followed by performing dispersion with a sand mill using diameter 1-mmϕ glass beads for 2 hours to obtain a dispersion.

To the obtained dispersion are added 0.005 part by weight of dioctyltin dilaurate as a catalyst and 45 parts by weight of silicone resin particles (TOSPEARL 145, manufactured by GE Toshiba Silicone Co., Ltd.) to obtain a coating liquid for an undercoat layer. An undercoat layer having a thickness of 18 μm is obtained by coating the coating liquid on an aluminum substrate having a diameter of 30 mm, a length of 340 mm, and a thickness of 1 mm by a dipping coating method, and drying to cure at a temperature of 170° C. for 40 minutes. Ra (center line average roughness), a surface roughness of the outside surface of the undercoat layer thus formed is about 0.3 μm.

Preparation of Charge Generating Layer

A mixture including 15 parts by weight of hydroxygallium phthalocyanine having diffraction peaks at Bragg angles (2θ±0.2°) of at least 7.3°, 16.0°, 24.9°, and 28.0° in an X-ray diffraction spectrum of Cukα X-rays as a charge generating material, 10 parts by weight of vinyl chloride-vinyl acetate copolymer resin (VMCH, manufactured by Nippon Unicar Co., Ltd.) as a binder resin, and 200 parts by weight of n-butyl acetate is dispersed with a sand mill using diameter 1-mmϕ glass beads for 4 hours. 175 parts by weight of n-butyl acetate and 180 parts by weight of methyl ethyl ketone are added to the obtained dispersion, followed by stirring, to obtain a coating liquid for a charge generating layer. The coating liquid for a charge generating layer is dip-coated to the undercoat layer, and dried 100° C. for 5 minutes to form a charge generating layer having a film thickness of 0.2 μm.

Preparation of Charge Transporting Layer 40 parts by weight of CTM-1, 10 parts by weight of CTM-2, and 55 parts of a binder resin (1) are dissolved in 800 parts of chlorobenzene to obtain a coating liquid for a charge transporting layer. This coating liquid is coated on the charge generating layer and dried at a temperature of 130° C. for 45 minutes to form a charge transporting layer having a film thickness of 15 μm.

Preparation of Protective Layer which is Surface Layer 20 parts by weight of the exemplary compound (I-c)-15, 20 parts by weight of the exemplary compound (II)-50, 20 parts by weight of CTM-1, and 0.2 part by weight of OTAZO-15 (manufactured by Otsuka Chemical Co., Ltd., molecular weight 354.4) are dissolved in 20 parts by weight of THF and 40 parts by weight of cyclopentylmethylether to obtain a coating liquid for a protective layer. This coating liquid is coated on the charge transporting layer by extrusion coating method. The coated film thus formed is subjected to air drying at room temperature (20° C.) for 30 minutes, heating from room temperature (20° C.) to 160° C. at a rate of 10° C./minute under nitrogen with an oxygen concentration of 200 ppm, and a heating treatment at 160° C. for 1 hour to cure, thereby forming a protective layer having a film thickness of about 4 μm.

Through the steps above, a photoreceptor 1 is prepared.

Further, the protective layer of the photoreceptor 1 prepared under the same condition is analyzed, and as a result, the contents of the exemplary compound (I-c)-15 after forming the protective layer and the exemplary compound (II)-50 after forming the protective layer are 0.3% by weight and 0.1% by weight, respectively.

Example 2

The same procedure as for the photoreceptor 1 except that OTAZO-15 is changed to 0.5 part by weight of 1-hydroxycyclohexyl-phenyl-ketone (IRGACURE 184, manufactured by Ciba Specialty Chemicals Inc.) in the coating liquid for a protective layer is carried out until coating of the coating liquid for a protective layer. Further, the coated film thus formed is subjected to air drying at room temperature (20° C.) for 30 minutes, and then to light irradiation under nitrogen with an oxygen concentration of 200 ppm under the conditions of a metal halide lamp: 160 W/cm, an irradiation distance: 120 mm, an irradiation intensity: 500 mW/cm$^2$, and an irradiation time: 60 seconds to cure the coated film. The film is further dried at 150° C. for 20 minutes to form a protective layer having a film thickness of about 4 μm.

Through the steps above, a photoreceptor 2 is prepared.

Further, the protective layer of the photoreceptor 2 prepared under the same condition is analyzed, and as a result, the contents of the exemplary compound (I-c)-15 after forming the protective layer and the exemplary compound (II)-50 after forming the protective layer are 0.5% by weight and 0.2% by weight, respectively.

Example 3

The same procedure as for the photoreceptor 1 except that OTAZO-15 is not added in the coating liquid for a protective layer is carried out until coating of the coating liquid for a protective layer, and the coated film thus formed is subjected to air drying at room temperature (20° C.) for 30 minutes, and then the photoreceptor is subjected to electron beam irradiation while rotating the photoreceptor at a speed of 300 rpm under nitrogen with an oxygen concentration of 20 ppm under the conditions of an irradiation distance of 30 mm, an electron beam acceleration voltage of 90 kV, an electron beam current of 2 mA, and an electron beam irradiation time of 1.0 second. Immediately after the irradiation, the photoreceptor is heated at 150° C. under nitrogen with an oxygen concentration of 20 ppm and held for 20 minutes to complete a curing reaction, thereby forming a protective layer having a film thickness of about 4 μm.

Through the steps above, a photoreceptor 3 is prepared.

Further, the protective layer of the photoreceptor 3 prepared under the same condition is analyzed, and as a result, the contents of the exemplary compound (I-c)-15 after forming the protective layer and the exemplary compound (II)-50 after forming the protective layer are 0.3% by weight and 0.1% by weight, respectively.

Comparative Example 1

The same procedure as for the photoreceptor 1 is carried out for the preparation until the charge transporting layer. 40 parts by weight of a compound (A), 20 parts by weight of CTM-1, and 0.2 part by weight of OTAZO-15 (manufactured by Otsuka Chemical Co., Ltd., molecular weight 354.4) are dissolved in 20 parts by weight of THF and 40 parts by weight of cyclopentylmethylether to obtain a coating liquid for a protective layer. This coating liquid is coated on the charge transporting layer by extrusion coating. The coated film thus formed is subjected to air drying at room temperature for 30 minutes, heating from room temperature (20° C.) to 160° C. at a rate of 10° C./minute under nitrogen with an oxygen concentration of 200 ppm, and a heating treatment at 160° C. for 1 hour to cure, thereby forming a protective layer having a film thickness of about 4 μm.

Through the steps above, a comparative photoreceptor 1 is prepared. However, in the formation of a protective layer in the comparative photoreceptor 1, crystallization of CTM-1 occurs in the cooling step after the completion of curing, and the surface of the protective layer turns white turbid. Therefore, the evaluation of the comparative photoreceptor 1 as the photoreceptor cannot be conducted.

Further, the protective layer of the comparative photoreceptor 1 prepared under the same condition is analyzed, and as a result, the content of the compound (A) after forming the protective layer is 0.3% by weight.

Comparative Example 2

The same procedure as for the photoreceptor 1 is carried out for the preparation until the charge transporting layer. 20 parts by weight of a compound (B), 20 parts by weight of trimethylolpropane triacrylate (A-TMPT, manufactured by Shin-Nakamura Chemical Co., Ltd.), 20 parts by weight of CTM-1, and 0.2 part by weight of OTAZO-15 (manufactured by Otsuka Chemical Co., Ltd., molecular weight 354.4) are dissolved in 20 parts by weight of THF and 40 parts by weight of cyclopentylmethylether to obtain a coating liquid for a protective layer. This coating liquid is coated on the charge transporting layer by extrusion coating. The coated film thus formed is subjected to air drying at room temperature (20° C.) for 30 minutes, heating from room temperature (20° C.) to 160° C. at a rate of 10° C./minute under nitrogen with an oxygen concentration of 200 ppm, and a heating treatment at 160° C. for 1 hour to cure, thereby forming a protective layer having a film thickness of about 4 μm.

Through the steps above, a comparative photoreceptor 2 is prepared. However, in the formation of a protective layer in the comparative photoreceptor 2, crystallization of CTM-1 occurs in the cooling step after the completion of curing, and the surface of the protective layer turns white turbid. Therefore, the evaluation of the comparative photoreceptor 2 as the photoreceptor cannot be conducted.

Further, the protective layer of the comparative photoreceptor 2 prepared under the same condition is analyzed, and as a result, the content of the compound (B) after forming the protective layer is 0.5% by weight.

Comparative Example 3

The same procedure as for the photoreceptor 1 except that V-601 (manufactured by Wako Pure Chemicals Industries, Ltd.) is used instead of OTAZO-15 in the coating liquid for a protective layer is carried out for the preparation until the coating of the coating liquid for a protective layer. Further, the coated film thus formed is subjected to air drying at room temperature (20° C.) for 30 minutes, heating from room temperature (20° C.) to 160° C. at a rate of 10° C./minute under nitrogen with an oxygen concentration of 200 ppm, and a heating treatment at 120° C. for 1 hour to cure, thereby forming a protective layer having a film thickness of about 4 μm.

Through the steps above, a comparative photoreceptor 3 is prepared.

Further, the protective layer of the comparative photoreceptor 3 prepared under the same condition is analyzed, and as a result, the contents of the exemplary compound (I-c)-15 after forming the protective layer and the exemplary compound (II)-50 after forming the protective layer are 2.6% by weight and 0.7% by weight, respectively.

Example 4

The same procedure as for the photoreceptor 1 is carried out for the preparation until the charge transporting layer. 20 parts by weight of the exemplary compound (I-c)-15, 20 parts by weight of the exemplary compound (II)-50, 20 parts by weight of CTM-1, 5 parts by weight of PTFE (LUBRON L-2: manufactured by Daikin Industries, Ltd.), and 0.3 part by weight of GF400 (manufactured by Toagosei Co., Ltd.) are dissolved in 20 parts by weight of THF and 40 parts by weight of cyclopentylmethylether, and dispersed using an ultrasonic homogenizer. After completion of the dispersion, 0.2 part by weight of OTAZO-15 (manufactured by Otsuka Chemical Co., Ltd., molecular weight 354.4) is added thereto to obtain a coating liquid for a protective layer. This coating liquid is coated on the charge transporting layer by extrusion coating. The coated film thus formed is subjected to air drying at room temperature (20° C.) for 30 minutes, heating from room temperature (20° C.) to 160° C. at a rate of 10° C./minute under nitrogen with an oxygen concentration of 200 ppm, and a heating treatment at 160° C. for 1 hour to cure, thereby forming a protective layer having a film thickness of about 4 μm.

Through the steps above, a photoreceptor 4 is prepared.

Further, the protective layer of the photoreceptor 4 prepared under the same condition is analyzed, and as a result, the contents of the exemplary compound (I-c)-15 after forming the protective layer and the exemplary compound (II)-50 after forming the protective layer are 0.5% by weight and 0.2% by weight, respectively. The PTFE dispersing property is about 95%.

Examples 5 to 31 and Examples 101 to 103

The same procedure as for the photoreceptor 1 is carried out for preparation until the charge generating layer. Using the coating liquid prepared in the same manner as for the photoreceptor 1 except for using the compositions according to Tables 1 to 3, a charge transporting layer and a protective layer are formed on the charge generating layer in the same manner as for the photoreceptor 1, thereby preparing photoreceptors 5 to 31 and photoreceptors 101 to 103.

Comparative Examples 4 to 6

The same procedure as for the photoreceptor 1 is carried out for preparation until the charge generating layer. Using the coating liquid prepared in the same manner as for the photoreceptor 1 except for using the compositions according to Table 4, a charge transporting layer and a protective layer are formed on the charge generating layer in the same manner as for the photoreceptor 1, thereby preparing comparative photoreceptors 4 to 6.

Evaluation of Characteristics

For the photoreceptor obtained in each of Examples, the content of the reactive group-containing charge transporting material in the protective layer after forming the protective layer and the dispersing property of PTFE are examined. The results are shown in Tables 1 to 4.

Content of Reactive Group-Containing Charge Transporting Material Before the Reaction in Protective Layer Quantification of the content of the reactive group-containing charge transporting material after forming the protective layer (denoted as "amount of components after forming the protective layer" in Tables 1 to 4) in the protective layer is carried out by the following procedure using liquid chromatography (HPLC) under the following procedure.

Conditions

Device: 8020 manufactured by Tosoh Corporation

Column: Unisil Q manufactured by GL Sciences Inc.

Solvent: Tetrahydrofuran/hexane mixed solvent (ratio adjusted according to the monomers)

Flow rate: 1 ml/min

Detection wavelength: 313 nm

Procedure (1) 1 mg of a reactive group-containing charge transporting material to be measured is dissolved in advance in 1 ml of THF to prepare a standard sample solution.

(2) By means of HPLC, sampling amounts (1 μl, 5 μl, 10 μl, and 20 μl) of the standard sample solution are assingned to create a calibration curve of the reactive group-containing charge transporting material.

(3) The protective layer is collected using a cutter knife and weighed (x mg).

(4) The collected protective layer is placed in THF (y ml), sealed, and stirred at 40° C. for 3 hours while extracting the soluble matter.

(5) The extract is analyzed by an HPLC method, and from the calibration curve determined previously, the elution amount (z mg) of the reactive group-containing charge transporting material is calculated.

(6) Based on an equation: $D(\%)=100\times z/x$, the content D of the reactive group-containing charge transporting material after forming the protective layer is calculated.

Dispersing Property of PTFE

The dispersing property of PTFE is evaluated by carrying out the following procedure.

Figure 8B:
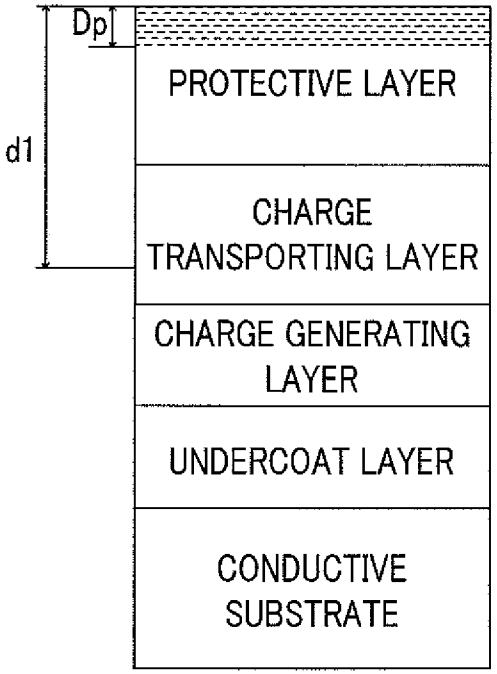
FIGS. 8A and 8B are each an illustrative view showing a method for evaluating a dispersing property of PTFE.
Figure 8A:
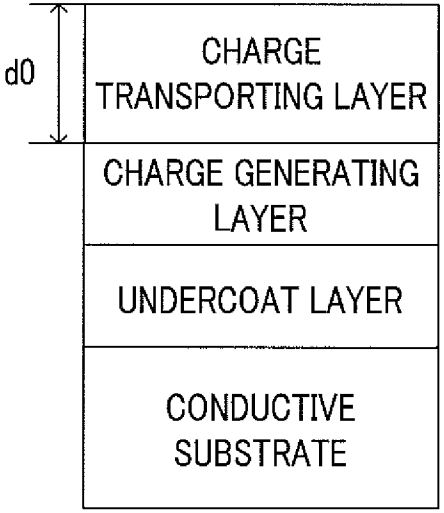

(1) The film thickness d0 of the photoreceptor in which layers are formed up to the charge transporting layer is measured in advance by a line interferometer (manufactured by Fuji Xerox Co.) (see FIG. 8A).

(2) After forming the protective layer, the photosensitive layer of the photoreceptor is cut and the cross-section is measured by SEM. Further, the total film thickness dl of the charge transporting layer and the protective layer, and the film thickness dp of the area having PTFE dispersed therein are measured ((see FIG. 8B).

(3) Based on an equation: P(%)=100×dp/(d1−d0) (%), the dispersing property P of PTFE is calculated.

Evaluation of Image Quality

The photoreceptor as prepared in each of Examples is mounted on an ApeosPort-IV C5570 manufactured by Fuji Xerox Co., Ltd., and continuously subjected to evaluation of image quality below under low temperature and low humidity (8° C., 20% RH), and high temperature and high humidity (28° C., 85% RH).

First, the surface potential of the photoreceptor is prepared before the evaluation of image quality.

Next, an image formation test is performed on 10000 sheets under a low temperature and a low humidity (8° C., 20% RH), and the image quality (ghost, fogging, streaks, black spots, character resolution, and image deletion) of the $10000^{th}$ sheet is evaluated. Further, during the image forming test, evaluation of blade squeal is also carried out. The results are shown in Table 5.

Next, subsequently to evaluation of the image quality under the low temperature and low humidity environment, an image formation test of 10000 sheets is performed under a high temperature and high humidity environment (28° C., 85% RH), and the image quality (ghost, fogging, streaks, black spots, character resolution, and image deletion) of the $10000^{th}$ sheet is evaluated. Further, during the image forming test, evaluation of blade squeal is also carried out. In addition, after completion of the evaluation of the image quality, the abrasion amount of the photoreceptor is evaluated. The results are shown in Table 6.

Surface Potential of Photoreceptor

Before the image formation test, the photoreceptor is charged with an initial potential of −700 V using a device for evaluating electrical characteristics manufactured by Fuji Xerox Co., Ltd., and exposed at 3.7 mJ/$m^2$ with a wavelength of 780 nm, and the surface potential (VL) after 30 msec is measured. It means that the smaller the value, the higher the photoresponsiveness, which is suitable for use at a high speed.

Evaluation of Ghost

Figure 9A:
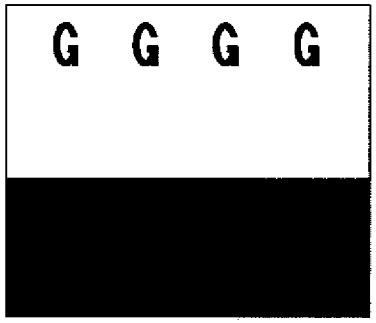
FIGS. 9A to 9C are each an illustrative view showing the criteria for evaluation of a ghost.

For a ghost, a chart having a pattern of G and a gray area having an image density of 50% shown in FIG. 9A is printed, and the state where the letters G appear in the gray area of 50% is evaluated visually.

A: The degree is from good to slightly conspicuous as in FIG. 9A.

Figure 9B:
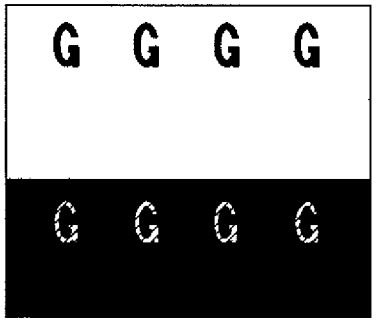

B: Slightly conspicuous as in FIG. 9B.

Figure 9C:
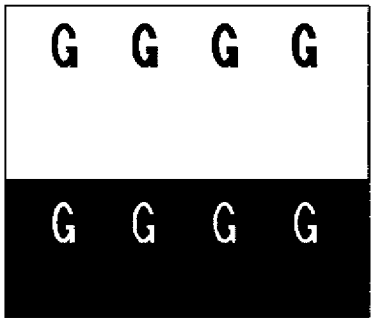

C: Clearly observed as in FIG. 9C.

Evaluation of Fogging

For the evaluation of fogging, using the same samples as for the evaluation of a ghost, the degree of toner adherence on the white background area is visually observed and determined.

A: There is no fogging.

B: There is slight fogging.

C: There is fogging at a practically problematic level in terms of image quality.

Evaluation of Streaks

For the evaluation of streaks, using the same samples as for the evaluation of a ghost, the degree of toner adherence on the white background area is visually observed and determined.

A: There is no streak.

B: There are pale streaks.

C: There are streaks at a practically problematic level in terms of image quality.

Evaluation of Black Spots

For the evaluation of black spots, using the same samples as for the evaluation of a ghost, the degree of the image quality defects in the form of spots on the white area is visually observed and determined.

A: There is no generation of black spots.

B: There is generation of more or less black spots.

C: There are black spots at a problematic level in terms of image quality.

Evaluation of Character Resolution

For the evaluation of character resolution, a Kanji character "響" at a point size of 8 is printed and the resolution is visually observed and determined.

A: There is no collapse of the character.

B: There is slight collapse of the character.

C: The resolution is clearly poor.

Evaluation of Image deletion

The image deletion is visually determined using the same samples as for the evaluation of a ghost.

A: There is no image deletion.

B: When the image formation test is continuously performed, there is no problem, but the image deletion occurs after being left for 1 day (24 hours).

C: Even when the image formation test is continuously performed, the image deletion occurs.

Evaluation of Adherence to Surface of Photoreceptor

For the evaluation of adherence to the surface of the photoreceptor, the surface of the photoreceptor after the image formation test is visually determined.

A: There no adherence of an adherend.

B: There is partially adherence of an adherend in the form of streaks, and the adherend can be removed by gently wiping the surface of the photoreceptor with cloth that has been deeply soaked with isopropanol.

C: There is adherence of an adherend in the form of streaks on the entire surface, and the adherend cannot be removed even by gently wiping the surface of the photoreceptor with cloth that has been deeply soaked with isopropanol.

Evaluation of Blade Squeal

The grade of the blade squeal (sound generated by the friction between the photoreceptor and the cleaning blade) during the image formation test is evaluated.

A: There is no squeal.

B: There is slight squeal.

C: There is clear squeal.

TABLE 1

| Examples | | | | | | | | | | | | | |
|---|---|---|---|---|---|---|---|---|---|---|---|---|---|
| | | Charge transporting layer | | | | | | Protective layer | | | | | |
| | | Binder resin | | Non-reactive charge transporting material | | | | Reactive group-containing charge transporting material | | | | Non-reactive charge transporting material | |
| Example No. | Photoreceptor No. | No. | Number of parts | No. | Number of parts | No. | Number of parts | No. | Number of parts | No. | Number of parts | No. | Number of parts |
| 1 | 1 | (1) | 55 | CTM-1 | 40 | CTM-2 | 10 | (I-c)-15 | 20 | (II)-50 | 20 | CTM-1 | 20 |
| 2 | 2 | (1) | 55 | CTM-1 | 40 | CTM-2 | 10 | (I-c)-15 | 20 | (II)-50 | 20 | CTM-1 | 20 |
| 3 | 3 | (1) | 55 | CTM-1 | 40 | CTM-2 | 10 | (I-c)-15 | 20 | (II)-50 | 20 | CTM-1 | 20 |
| 4 | 4 | (1) | 55 | CTM-1 | 40 | CTM-2 | 10 | (I-c)-15 | 20 | (II)-50 | 20 | CTM-1 | 20 |

TABLE 1-continued

| Examples | | | | | | | | | | | | | |
|---|---|---|---|---|---|---|---|---|---|---|---|---|---|
| 5 | 5 | (2) | 55 | CTM-1 | 40 | CTM-3 | 10 | (I-c)-43 | 40 | — | — | CTM-2 | 10 |
| 6 | 6 | (2) | 55 | CTM-1 | 40 | CTM-3 | 10 | (I-c)-46 | 40 | — | — | CTM-3 | 20 |
| 7 | 7 | (3) | 55 | CTM-1 | 40 | CTM-4 | 10 | (I-c)-53 | 40 | — | — | CTM-2 | 20 |
| 8 | 8 | (3) | 55 | CTM-1 | 40 | CTM-4 | 10 | (I-c)-15 | 20 | (II)-46 | 20 | CTM-4 | 5 |
| 9 | 9 | (4) | 55 | CTM-1 | 40 | CTM-3 | 10 | (I-c)-15 | 20 | (II)-56 | 20 | CTM-1 | 20 |
| 10 | 10 | (4) | 55 | CTM-4 | 40 | — | | (I-c)-15 | 20 | (II)-58 | 20 | CTM-1 | 20 |
| 11 | 11 | (4) | 55 | CTM-1 | 40 | CTM-2 | 10 | (I-c)-15 | 20 | (II)-50 | 10 | CTM-2 | 15 |
| 12 | 12 | (5) | 55 | CTM-1 | 40 | CTM-3 | 10 | (II)-46 | 40 | — | — | CTM-2 | 10 |
| 13 | 13 | (5) | 55 | CTM-1 | 40 | CTM-3 | 10 | (II)-56 | 40 | — | — | CTM-3 | 20 |
| 14 | 14 | (5) | 55 | CTM-1 | 40 | CTM-4 | 10 | (II)-58 | 40 | — | — | CTM-2 | 20 |
| 15 | 15 | (5) | 55 | CTM-1 | 40 | CTM-4 | 10 | (II)-50 | 40 | — | — | CTM-1 | 20 |
| 16 | 16 | (6) | 55 | CTM-1 | 40 | CTM-3 | 10 | (I-c)-7 | 20 | (II)-46 | 20 | CTM-1 | 5 |
| 17 | 17 | (6) | 55 | CTM-4 | 40 | — | | (I-c)-7 | 20 | (II)-56 | 20 | CTM-1 | 20 |
| 18 | 18 | (7) | 55 | CTM-1 | 40 | CTM-2 | 10 | (I-c)-15 | 20 | (II)-58 | 20 | CTM-1 | 20 |
| 19 | 19 | (8) | 55 | CTM-1 | 40 | CTM-3 | 10 | (I-c)-15 | 20 | (II)-50 | 10 | CTM-1 | 15 |
| 20 | 20 | (8) | 55 | CTM-1 | 40 | CTM-3 | 10 | (II)-46 | 40 | — | — | CTM-1 | 10 |
| 21 | 21 | (9) | 55 | CTM-1 | 40 | CTM-4 | 10 | (II)-56 | 40 | — | — | CTM-1 | 20 |
| 22 | 22 | (9) | 55 | CTM-1 | 40 | CTM-4 | 10 | (II)-58 | 40 | — | — | CTM-1 | 20 |
| 23 | 23 | (9) | 55 | CTM-1 | 40 | CTM-3 | 10 | (II)-50 | 40 | — | — | CTM-1 | 20 |
| 24 | 24 | (10) | 55 | CTM-4 | 40 | — | | (I-c)-15 | 20 | (II)-50 | 20 | CTM-1 | 20 |
| 25 | 25 | (10) | 55 | CTM-1 | 40 | CTM-2 | 10 | (I-c)-15 | 20 | (II)-50 | 20 | CTM-1 | 20 |

| | Protective layer | | | | | | | | | |
|---|---|---|---|---|---|---|---|---|---|---|
| | Additive | | | | Polymerization initiator | | | Amount (% by weight) of | Dispersing |
| Example No. | No. | Number of parts | No. | Number of parts | No. | Number of parts | Curing method | components before the reaction | property of PTFE |
| 1 | — | — | — | — | OTazo-15 | 0.2 | Thermal curing | 0.4 | — |
| 2 | — | — | — | — | Irgacure 184 | 0.5 | Photocuring | 0.7 | — |
| 3 | — | — | — | — | — | — | Electron beam curing | 0.4 | — |
| 4 | — | — | PTFE | 5 | OTazo-15 | 0.2 | Thermal curing | 0.7 | 95% |
| 5 | — | — | PTFE | 5 | OTazo-15 | 0.2 | Thermal curing | 0.2 | 100% |
| 6 | — | — | PTFE | 5 | OTazo-15 | 0.2 | Thermal curing | 0.5 | 100% |
| 7 | — | — | PTFE | 5 | OTazo-15 | 0.2 | Thermal curing | 0.5 | 95% |
| 8 | — | — | PTFE | 5 | OTazo-15 | 0.2 | Thermal curing | 0.7 | 95% |
| 9 | — | — | PTFE | 5 | OTazo-15 | 0.2 | Thermal curing | 0.6 | 90% |
| 10 | — | — | PTFE | 5 | OTazo-15 | 0.2 | Thermal curing | 0.7 | 90% |
| 11 | A-TMPT | 5 | PTFE | 5 | OTazo-15 | 0.2 | Thermal curing | 0.4 | 90% |
| 12 | — | — | PTFE | 5 | OTazo-15 | 0.2 | Thermal curing | 0.3 | 95% |
| 13 | — | — | PTFE | 5 | OTazo-15 | 0.2 | Thermal curing | 0.7 | 95% |
| 14 | — | — | PTFE | 5 | OTazo-15 | 0.2 | Thermal curing | 0.5 | 95% |
| 15 | — | — | PTFE | 5 | OTazo-15 | 0.2 | Thermal curing | 0.2 | 95% |
| 16 | — | — | PTFE | 5 | OTazo-15 | 0.2 | Thermal curing | 1.5 | 95% |
| 17 | — | — | PTFE | 5 | OTazo-15 | 0.2 | Thermal curing | 2.2 | 95% |
| 18 | — | — | PTFE | 5 | OTazo-15 | 0.2 | Thermal curing | 0.7 | 90% |
| 19 | — | — | PTFE | 5 | OTazo-15 | 0.2 | Thermal curing | 0.5 | 95% |
| 20 | — | — | PTFE | 5 | OTazo-15 | 0.2 | Thermal curing | 0.2 | 95% |
| 21 | — | — | PTFE | 5 | OTazo-15 | 0.2 | Thermal curing | 0.9 | 90% |
| 22 | — | — | PTFE | 5 | OTazo-15 | 0.2 | Thermal curing | 0.7 | 90% |
| 23 | — | — | PTFE | 5 | OTazo-15 | 0.2 | Thermal curing | 0.6 | 90% |
| 24 | — | — | PTFE | 5 | OTazo-15 | 0.2 | Thermal curing | 0.6 | 95% |
| 25 | — | — | — | — | OTazo-15 | 0.2 | Thermal curing | 0.6 | — |

TABLE 2

| Examples | | | | | | | | | | | | | |
|---|---|---|---|---|---|---|---|---|---|---|---|---|---|
| | | Charge transporting layer | | | | | | Protective layer | | | | | |
| | | Binder resin | | Non-reactive charge transporting material | | | | Reactive group-containing charge transporting material | | | | Non-reactive charge transporting material | |
| Example No. | Photoreceptor No. | No. | Number of parts | No. | Number of parts | No. | Number of parts | No. | Number of parts | No. | Number of parts | No. | Number of parts |
| 26 | 26 | (1) | 55 | CTM-1 | 40 | CTM-2 | 10 | (I-a)-25 | 20 | (II)-50 | 20 | CTM-1 | 20 |
| 27 | 27 | (1) | 55 | CTM-1 | 40 | CTM-2 | 10 | (I-b)-23 | 20 | (II)-50 | 20 | CTM-1 | 20 |
| 28 | 28 | (1) | 55 | CTM-1 | 40 | CTM-2 | 10 | (I-d)-20 | 20 | (II)-50 | 20 | CTM-1 | 20 |
| 29 | 29 | (1) | 55 | CTM-1 | 40 | CTM-2 | 10 | (I-d)-20 | 20 | (II)-184 | 20 | CTM-1 | 10 |

TABLE 2-continued

| Examples | | | | | | | | | | | | | |
|---|---|---|---|---|---|---|---|---|---|---|---|---|---|
| 30 | 30 | (1) | 55 | CTM-1 | 40 | CTM-2 | 10 | (I-d)-20 | 20 | (II)-181 | 20 | CTM-1 | 10 |
| 31 | 31 | (1) | 55 | CTM-1 | 40 | CTM-2 | 10 | (I-d)-20 | 20 | (II)-182 | 20 | CTM-1 | 10 |

| | Protective layer | | | | | | | | | |
|---|---|---|---|---|---|---|---|---|---|---|
| | | Additive | | | | Polymerization initiator | | | Amount (% by weight) of | Dispersing |
| | Example No. | No. | Number of parts | No. | Number of parts | No. | Number of parts | Curing method | components before the reaction | property of PTFE |
| | 26 | — | — | — | — | OTazo-15 | 0.2 | Thermal curing | 0.4 | — |
| | 27 | — | — | — | — | OTazo-15 | 0.2 | Thermal curing | 0.4 | — |
| | 28 | — | — | — | — | OTazo-15 | 0.2 | Thermal curing | 0.4 | — |
| | 29 | — | — | — | — | OTazo-15 | 0.2 | Thermal curing | 0.4 | — |
| | 30 | — | — | — | — | OTazo-15 | 0.2 | Thermal curing | 0.4 | — |
| | 31 | — | — | — | — | OTazo-15 | 0.2 | Thermal curing | 0.4 | — |

TABLE 3

| Examples | | | | | | | | | | | | | |
|---|---|---|---|---|---|---|---|---|---|---|---|---|---|
| | | Charge transporting layer | | | | | | Protective layer | | | | | |
| | | Binder resin | | Non-reactive charge transporting material | | | | Reactive group-containing charge transporting material | | | | Non-reactive charge transporting material | |
| Example No. | Photoreceptor No. | No. | Number of parts | No. | Number of parts | No. | Number of parts | No. | Number of parts | No. | Number of parts | No. | Number of parts |
| 101 | 101 | (11) | 55 | CTM-1 | 40 | CTM-2 | 10 | (I-c)-15 | 20 | (II)-50 | 20 | CTM-1 | 20 |
| 102 | 102 | (12) | 55 | CTM-1 | 40 | CTM-2 | 10 | (I-c)-15 | 20 | (II)-50 | 20 | CTM-1 | 20 |
| 103 | 103 | (13) | 55 | CTM-1 | 40 | CTM-2 | 10 | (I-c)-15 | 20 | (II)-50 | 20 | CTM-1 | 20 |

| | Protective layer | | | | | | | | | |
|---|---|---|---|---|---|---|---|---|---|---|
| | | Additive | | | | Polymerization initiator | | | Amount (% by weight) of | Dispersing |
| | Example No. | No. | Number of parts | No. | Number of parts | No. | Number of parts | Curing method | components before the reaction | property of PTFE |
| | 101 | — | — | PTFE | 5 | OTazo-15 | 0.2 | Thermal curing | 0.7 | 40% |
| | 102 | — | — | PTFE | 5 | OTazo-15 | 0.2 | Thermal curing | 0.6 | 55% |
| | 103 | — | — | PTFE | 5 | OTazo-15 | 0.2 | Thermal curing | 0.8 | 40% |

TABLE 4

| Comparative Examples | | | | | | | | | | | | | |
|---|---|---|---|---|---|---|---|---|---|---|---|---|---|
| | | Charge transporting layer | | | | | | Protective layer | | | | | |
| | Comparative | Binder resin | | Non-reactive charge transporting material | | | | Reactive group-containing charge transporting material | | | | Non-reactive charge transporting material | |
| Comparative Example No. | photoreceptor No. | No. | Number of parts | No. | Number of parts | No. | Number of parts | No. | Number of parts | No. | Number of parts | No. | Number of parts |
| 1 | 1 | (1) | 55 | CTM-1 | 40 | CTM-2 | 10 | Compound (A) | 40 | — | — | CTM-1 | 20 |
| 2 | 2 | (1) | 55 | CTM-1 | 40 | CTM-2 | 10 | Compound (B) | 20 | — | — | CTM-1 | 20 |
| 3 | 3 | (1) | 55 | CTM-1 | 40 | CTM-2 | 10 | (I-c)-15 | 20 | (II)-50 | 20 | CTM-1 | 20 |
| 4 | 4 | (3) | 55 | CTM-1 | 40 | CTM-4 | 10 | (I-c)-53 | 40 | — | | CTM-2 | 30 |

TABLE 4-continued

| Comparative Examples | | | | | | | | | | | | | |
|---|---|---|---|---|---|---|---|---|---|---|---|---|---|
| 5 | 5 | (8) | 55 | CTM-1 | 40 | CTM-3 | 10 | (I-c)-7 | 20 | (II)-46 | 20 | — | — |
| 6 | 8 | (6) | 55 | CTM-1 | 40 | — | | (I-c)-7 | 30 | (II)-56 | 20 | CTM-1 | 10 |

| | Protective layer | | | | | | | | |
|---|---|---|---|---|---|---|---|---|---|
| | Additive | | | | Polymerization initiator | | | Amount (% by weight) of | Dispersing |
| Comparative Example No. | No. | Number of parts | No. | Number of parts | No. | Number of parts | Curing method | components before the reaction | property of PTFE |
| 1 | — | — | — | — | OTazo-15 | 0.2 | Thermal curing | 0.3 | — |
| 2 | A-TMPT | 20 | — | — | OTazo-15 | 0.2 | Thermal curing | 0.5 | — |
| 3 | — | — | — | — | V-601 | 0.2 | Thermal curing | 3.3 | — |
| 4 | — | — | PTFE | 2 | OTazo-15 | 0.2 | Thermal curing | 1.3 | 95% |
| 5 | — | — | PTFE | 5 | OTazo-15 | 0.2 | Thermal curing | 1.5 | 95% |
| 6 | — | — | PTFE | 5 | OTazo-15 | 0.2 | Thermal curing | 3.2 | 95% |

TABLE 5

| | | | Evaluation under low temperature and low humidity (8° C., 20% RH) | | | | | | | |
|---|---|---|---|---|---|---|---|---|---|---|
| | photoreceptor | Potential VL (V) on surface of photoreceptor | Ghost | Fogging | Streaks | Black spots | Character resolution | Image deletion | Adherence to surface of photoreceptor | Blade squeal |
| Example 1 | Photoreceptor 1 | −85 | A | A | A | A | A | A | A | A |
| Example 2 | Photoreceptor 2 | −90 | A | A | A | A | A | A | A | A |
| Example 3 | Photoreceptor 3 | −38 | A | A | A | A | A | A | A | A |
| Example 4 | Photoreceptor 4 | −70 | A | A | A | A | A | A | A | A |
| Example 5 | Photoreceptor 5 | −92 | A | A | A | A | A | A | A | A |
| Example 6 | Photoreceptor 6 | −83 | A | A | A | A | A | A | A | A |
| Example 7 | Photoreceptor 7 | −88 | A | A | A | A | A | A | A | A |
| Example 8 | Photoreceptor 8 | −110 | B | A | A | A | A | A | A | A |
| Example 9 | Photoreceptor 9 | −75 | A | A | A | A | A | A | A | A |
| Example 10 | Photoreceptor 10 | −85 | A | A | A | A | A | A | A | A |
| Example 11 | Photoreceptor 11 | −79 | A | A | A | A | A | A | A | A |
| Example 12 | Photoreceptor 12 | −105 | B | A | A | A | A | A | A | A |
| Example 13 | Photoreceptor 13 | −92 | A | A | A | A | A | A | A | A |
| Example 14 | Photoreceptor 14 | −90 | A | A | A | A | A | A | A | A |
| Example 15 | Photoreceptor 15 | −78 | A | A | A | A | A | A | A | A |
| Example 16 | Photoreceptor 16 | −125 | B | A | A | A | A | A | A | A |
| Example 17 | Photoreceptor 17 | −91 | A | A | A | A | A | A | A | A |
| Example 18 | Photoreceptor 18 | −92 | A | A | A | A | A | A | A | A |
| Example 19 | Photoreceptor 19 | −103 | B | A | A | A | A | A | A | A |
| Example 20 | Photoreceptor 20 | −124 | B | A | A | A | A | A | A | A |
| Example 21 | Photoreceptor 21 | −85 | A | A | A | A | A | A | A | A |
| Example 22 | Photoreceptor 22 | −79 | A | A | A | A | A | A | A | A |
| Example 23 | Photoreceptor 23 | −94 | A | A | A | A | A | A | A | A |
| Example 24 | Photoreceptor 24 | −90 | A | A | A | A | A | A | A | A |
| Example 25 | Photoreceptor 25 | −78 | A | A | A | A | A | A | A | B |
| Example 26 | Photoreceptor 26 | −92 | A | A | A | A | A | A | A | A |
| Example 27 | Photoreceptor 27 | −87 | A | A | A | A | A | A | A | A |
| Example 28 | Photoreceptor 28 | −90 | A | A | A | A | A | A | A | A |
| Example 29 | Photoreceptor 29 | −103 | A | A | A | A | A | A | A | A |
| Example 30 | Photoreceptor 30 | −110 | A | A | A | A | A | A | A | A |
| Example 31 | Photoreceptor 31 | −112 | A | A | A | A | A | A | A | A |
| Example 101 | Photoreceptor 101 | −83 | A | A | A | A | A | A | A | A |
| Example 102 | Photoreceptor 102 | −89 | A | A | A | A | A | A | A | A |
| Example 103 | Photoreceptor 103 | −90 | A | A | A | A | A | A | A | A |
| Comparative Example 1 | Comparative Photoreceptor 1 | | | | Evaluation not allowed | | | | | |
| Comparative Example 2 | Comparative Photoreceptor 2 | | | | Evaluation not allowed | | | | | |
| Comparative Example 3 | Comparative Photoreceptor 3 | −90 | A | C | A | A | A | A | C | B |
| Comparative Example 4 | Comparative Photoreceptor 4 | −83 | A | A | B | A | A | A | C | B |
| Comparative Example 5 | Comparative Photoreceptor 5 | −190 | C | A | B | A | B | A | A | A |
| Comparative Example 6 | Comparative Photoreceptor 6 | −105 | A | A | B | A | B | A | C | B |

TABLE 6

| | | Evaluation under high temperature and high humidity (28° C., 85% RH) | | | | | | | | |
|---|---|---|---|---|---|---|---|---|---|---|
| | Photoreceptor No. | Ghost | Fogging | Streaks | Black spots | Character resolution | image deletion | Adherence to surface of photoreceptor | Abrasion amount (μm) of photoreceptor | Blade squeal |
| Example 1 | Photoreceptor 1 | A | A | A | A | A | A | A | 1.1 | B |
| Example 2 | Photoreceptor 2 | A | A | A | A | A | A | A | 1.3 | B |
| Example 3 | Photoreceptor 3 | A | A | A | A | A | A | A | 1.1 | B |
| Example 4 | Photoreceptor 4 | A | A | A | A | A | A | A | 0.6 | A |
| Example 5 | Photoreceptor 5 | A | A | A | A | A | A | A | 0.4 | A |
| Example 6 | Photoreceptor 6 | A | A | A | A | A | A | A | 0.6 | A |
| Example 7 | Photoreceptor 7 | A | A | A | A | A | A | A | 0.6 | A |
| Example 8 | Photoreceptor 8 | A | A | A | A | A | A | A | 1.1 | A |
| Example 9 | Photoreceptor 9 | A | A | A | A | A | A | A | 1.4 | A |
| Example 10 | Photoreceptor 10 | A | A | A | A | A | A | A | 1.1 | A |
| Example 11 | Photoreceptor 11 | A | A | A | A | A | B | A | 0.4 | A |
| Example 12 | Photoreceptor 12 | A | A | A | A | A | B | A | 0.4 | A |
| Example 13 | Photoreceptor 13 | A | A | A | A | A | B | A | 0.5 | A |
| Example 14 | Photoreceptor 14 | A | A | A | A | A | A | A | 0.7 | A |
| Example 15 | Photoreceptor 15 | A | A | A | A | A | A | A | 0.6 | A |
| Example 16 | Photoreceptor 16 | A | A | A | A | A | A | A | 1.1 | A |
| Example 17 | Photoreceptor 17 | A | A | B | A | A | A | B | 1.5 | A |
| Example 18 | Photoreceptor 18 | A | A | A | A | A | A | A | 1.0 | A |
| Example 19 | Photoreceptor 19 | A | A | A | A | A | A | A | 1.3 | A |
| Example 20 | Photoreceptor 20 | A | A | A | A | A | A | A | 0.6 | A |
| Example 21 | Photoreceptor 21 | A | A | A | A | A | A | A | 0.5 | A |
| Example 22 | Photoreceptor 22 | A | A | A | A | A | A | A | 0.7 | A |
| Example 23 | Photoreceptor 23 | A | A | A | A | A | A | A | 0.6 | A |
| Example 24 | Photoreceptor 24 | A | A | A | A | A | A | A | 0.6 | A |
| Example 25 | Photoreceptor 25 | A | A | A | A | A | A | A | 1.2 | B |
| Example 26 | Photoreceptor 26 | A | A | A | A | A | A | A | 0.8 | B |
| Example 27 | Photoreceptor 27 | A | A | A | A | A | A | A | 0.9 | B |
| Example 28 | Photoreceptor 28 | A | A | A | A | A | A | A | 0.4 | B |
| Example 29 | Photoreceptor 29 | A | A | A | A | A | A | A | 0.5 | B |
| Example 30 | Photoreceptor 30 | A | A | A | A | A | A | A | 0.4 | B |
| Example 31 | Photoreceptor 31 | A | A | A | A | A | A | A | 0.4 | B |
| Example 101 | Photoreceptor 101 | A | A | C | A | A | A | A | 0.9 | B |
| Example 102 | Photoreceptor 102 | A | A | A | A | C | A | A | 1.0 | B |
| Example 103 | Photoreceptor 103 | A | C | C | A | A | A | C | 1.1 | B |
| Comparative Example 1 | Comparative Photoreceptor 1 | Evaluation not allowed | | | | | | | | |
| Comparative Example 2 | Comparative Photoreceptor 2 | Evaluation not allowed | | | | | | | | |
| Comparative Example 3 | Comparative Photoreceptor 3 | A | A | C | A | A | A | C | 2.4 | C |
| Comparative Example 4 | Comparative Photoreceptor 4 | A | B | C | A | A | A | C | 1.9 | C |
| Comparative Example 5 | Comparative Photoreceptor 5 | C | A | B | A | C | C | A | 0.7 | A |
| Comparative Example 6 | Comparative Photoreceptor 6 | A | C | C | A | C | A | C | 2.5 | C |

From the results above, it is found that in the present Examples, the surface potential of the photoreceptor is high, and favorable results are obtained with respect to evaluations of image quality (ghost, fogging, streaks, black spots, character resolution, and image deletion), blade squeal, and the abrasion amount of the photoreceptor, as compared with Comparative Examples.

Further, it is found that in the case where the protective layer includes PTFE, in the present Examples, favorable results are obtained with respect to evaluation of the dispersing property of PTFE, as compared with Comparative Examples.

Hereinafter, the details of the materials used in the respective examples and the respective abbreviations shown in Tables are described.

Binder Resin

Binder resins (1) to (13): Those synthesized by the preparation methods below (see Table 6 for the composition)

Synthesis of Binder Resin: Synthesis of Polycarbonate Copolymer

In a flask equipped with a phosgene inlet tube, a thermometer, and a stirrer, 106.9 g (0.398 mole) of 1,1-bis(4-hydroxyphenyl)cyclohexane (hereinafter referred to as Z), 24.7 g (0.133 mole) of 4,4'-dihydroxybiphenyl (hereinafter referred to as BP), 0.41 g of hydrosulfite, 825 ml (2.018 moles of sodium hydroxide) of a 9.1% sodium hydroxide aqueous solution, and 500 ml of methylene chloride are put and dissolved under a nitrogen atmosphere, maintained at from 18° C. to 21° C. under stirring, and 76.2 g (0.770 mole) of phosgene is blown thereinto over 75 minutes to perform a phosgenation reaction. After the end of the phosgenation reaction, 1.11 g (0.0075 mole) of p-tert-butylphenol and 54 ml (sodium hydroxide 0.266 mole) of a 25% sodium hydroxide aqueous solution are added thereto, followed by stirring, while 0.18 mL (0.0013 mole) of triethylamine is added thereto to perform a reaction at a temperature of from 30° C. to 35° C. for 2.5 hours. The separated methylene chloride phase is washed with an acid and water until the inorganic salts and the amines disappear, and then methylene chloride is removed to obtain a binder resin (1) [polycarbonate copolymer]. The binder resin (1) [polycarbonate copolymer] has a ratio of structural units of Z to BP of 75:25 in terms of a molar ratio.

In addition, the binder resins (2) to (13) are synthesized in the same manner as for the binder resin (1) except that the monomers used are changed such that the binder resins have the units (repeating units) according to Table 7.

TABLE 7

| Binder resin of charge transporting layer | | | | | | | | | | | |
|---|---|---|---|---|---|---|---|---|---|---|---|
| Binder resin | | | Unit 1 | | | Unit 2 | | | Unit 3 | | |
| No. | Solubility parameter | Viscosity average molecular weight | Kind | Molar ratio | Solubility parameter | Kind | Molar ratio | Solubility parameter | Kind | Molar ratio | Solubility parameter |
| (1) | 11.56 | 50,000 | (Z)-0 | 75 | 11.28 | (BP)-0 | 25 | 12.39 | | | |
| (2) | 11.67 | 50,000 | (Z)-0 | 65 | 11.28 | (BP)-0 | 35 | 12.39 | | | |
| (3) | 11.46 | 50,000 | (Z)-0 | 80 | 11.28 | (BP)-0 | 10 | 12.39 | (F)-0 | 10 | 12.02 |
| (4) | 11.44 | 50,000 | (Z)-0 | 85 | 11.28 | (BP)-0 | 15 | 12.39 | | | |
| (5) | 11.52 | 50,000 | (Z)-0 | 70 | 11.28 | (BP)-1 | 30 | 12.07 | | | |
| (6) | 11.65 | 50,000 | (Z)-0 | 50 | 11.28 | (F)-0 | 50 | 12.02 | | | |
| (7) | 11.50 | 50,000 | (Z)-0 | 30 | 11.28 | (E)-0 | 70 | 11.59 | | | |
| (8) | 11.79 | 50,000 | (AP)-0 | 75 | 11.59 | (BP)-0 | 25 | 12.39 | | | |
| (9) | 11.63 | 50,000 | (A)-0 | 50 | 11.24 | (F)-0 | 50 | 12.02 | | | |
| (10) | 11.47 | 50,000 | (A)-0 | 70 | 11.24 | (F)-0 | 30 | 12.02 | | | |
| (11) | 11.28 | 50,000 | (Z)-0 | 100 | 11.28 | | | | | | |
| (12) | 11.33 | 50,000 | (Z)-0 | 95 | 11.28 | (BP)-0 | 5 | 12.39 | | | |
| (13) | 11.82 | 50,000 | (A)-0 | 25 | 11.24 | (F)-0 | 75 | 12.02 | | | |

20

Charge Generating Material

CTM-1 to CTM-4: Charge generating materials represented by the following formulae (CTM-1)

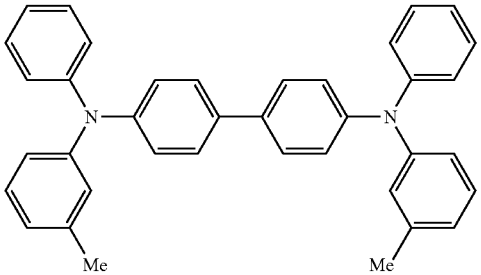

(CTM-2)

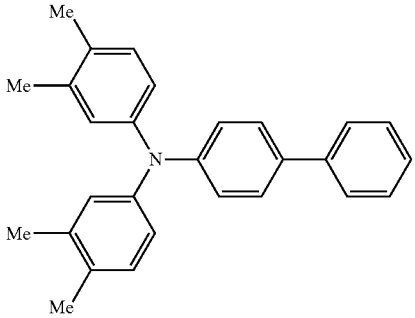

(CTM-3)

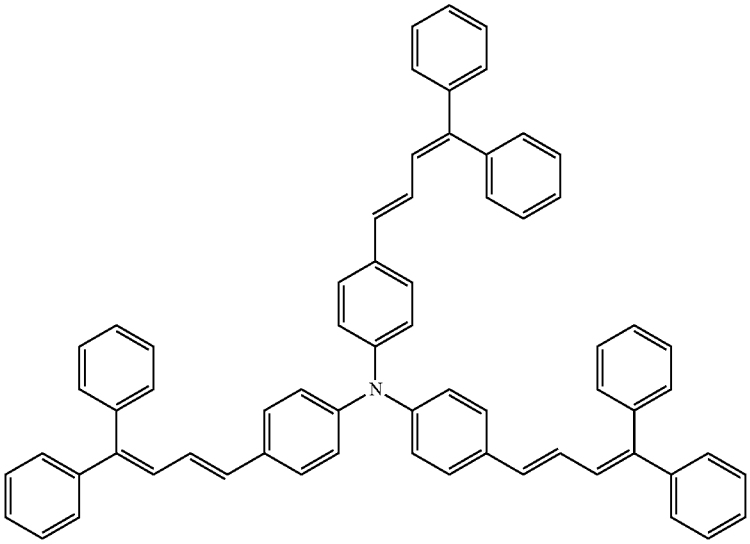

-continued (CTM-4)

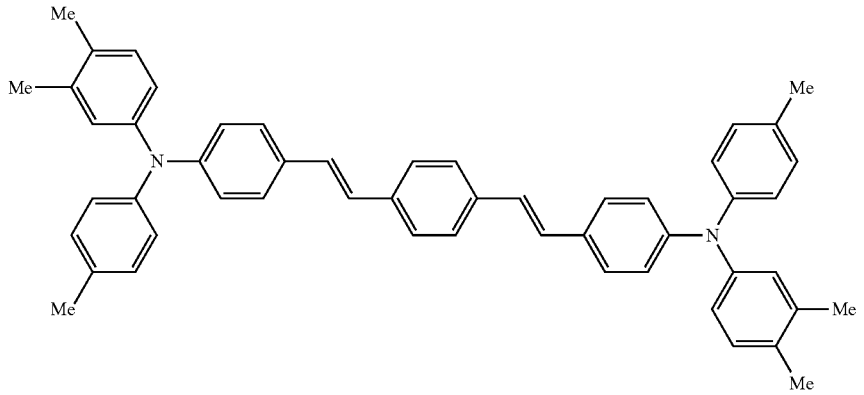

Reactive Group-Containing Charge Transporting Material (I-c)-7: Exemplary compound (I-c)-7

(I-c)-15: Exemplary compound (I-c)-15

(I-c)-43: Exemplary compound (I-c)-43 (see the following synthesis method)

(I-c)-46: Exemplary compound (I-c)-46

(I-c)-53: Exemplary compound (I-c)-53

(II)-46: Exemplary compound (II)-46

(II)-50: Exemplary compound (II)-50

(II)-56: Exemplary compound (II)-56

(II)-58: Exemplary compound (II)-58

Compound (A): Charge transporting material represented by the following formula

Compound (B): Charge transporting material represented by the following formula

Synthesis of Exemplary Compound (I-c)-43

To a 500-ml three necked flask are added 68.3 g of 4,4'-bis(2-methoxycarbonylethyl)diphenylamine, 43.4 g of 4,4'-diiodo-3,3'-dimethyl-1,1'-biphenyl, 30.4 g of potassium carbonate, 1.5 g of copper sulfate pentahydrate, and 50 ml of n-tridecane, and the system is stirred for 20 hours while heating at 220° C. under a nitrogen flow. Thereafter, the temperature is lowered to room temperature, and 200 ml of toluene and 150 ml of water are added to the system to perform a liquid separation operation. The toluene layer is collected, 10 g of sodium sulfate is added thereto, followed by stirring for 10 minutes, and then sodium sulfate is filtered. A crude composition formed by evaporation of toluene under reduced pressure is purified by silica gel column chromatography using toluene/ethyl acetate as an eluent to obtain 56.0 g (yield of 65%) of (I-c)-43a.

To a 3-L three necked flask are added 43.1 g of (I-c)-43a and 350 ml of tetrahydrofuran, and an aqueous solution having 8.8 g of sodium hydroxide dissolved in 350 ml of water is added thereto, followed by heating and stirring at 60° C. for 5 hours. Thereafter, the reaction liquid is added dropwise to an aqueous solution of 1 L of water/40 ml of concentrated hydrochloric acid, and the precipitated solid is collected by suction filtration. This solid is made into a suspension state by further adding 50 ml of a mixed solvent of acetone/water (volume ratio of 40/60) thereto and stirred, and the mixture is then collected by suction filtration and dried in vacuum for 10 hours to obtain 36.6 g (yield of 91%) of (I-c)-43b.

To a 500-ml three necked flask are added 28.2 g of (I-c)-43b, 23.5 g of 4-chloromethylstyrene, 21.3 g of potassium carbonate, 0.09 g of nitrobenzene, and 175 ml of DMF (N,N-dimethylformamide), and the system is stirred for hours while heating at 75° C. under a nitrogen flow. Thereafter, the temperature is lowered to room temperature, and the reaction solution is subjected to a liquid separation operation by the addition of 200 ml of ethyl acetate/200 ml of water. The ethyl acetate layer is collected, 10 g of sodium sulfate is added thereto, followed by stirring for 10 minutes, and then sodium sulfate is filtered. A crude composition formed by evaporation of ethyl acetate under reduced pressure is purified by silica gel column chromatography using toluene/ethyl acetate as an eluent to obtain 37.8 g (yield of 85%) of the exemplary compound (I-c)-43.

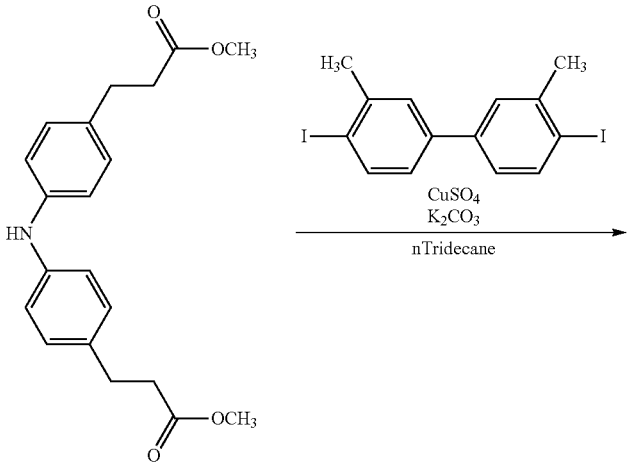

-continued
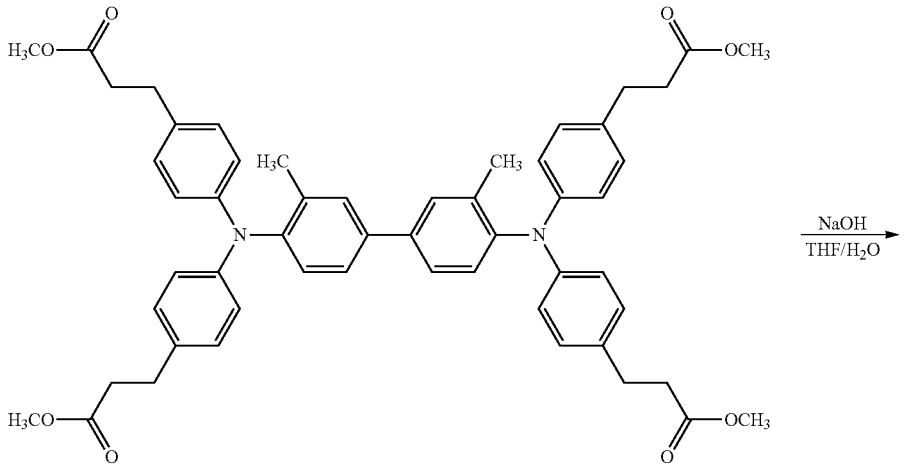
(I-c)-43a
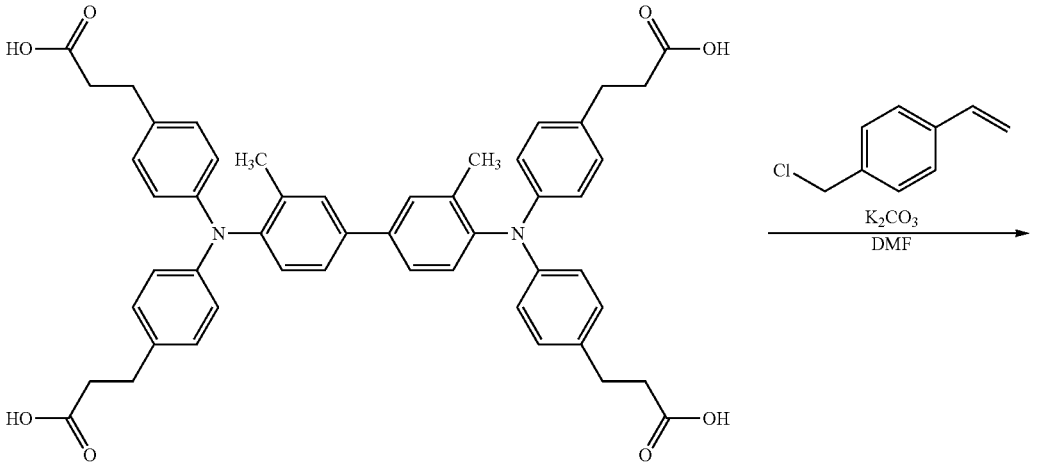
(I-c)-43b
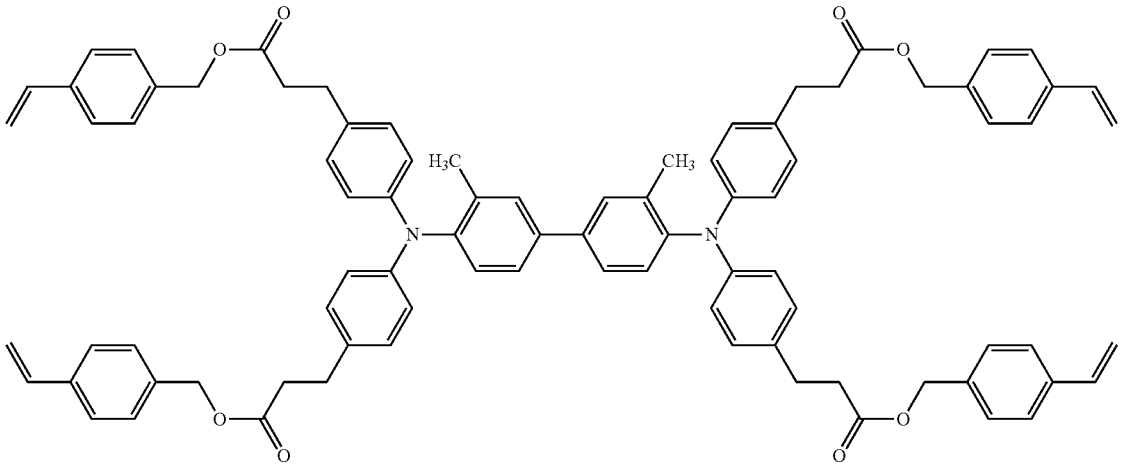
(I-c)-43

Furthermore, other exemplary compounds are synthesized according to the synthesis above.

Compound (A)

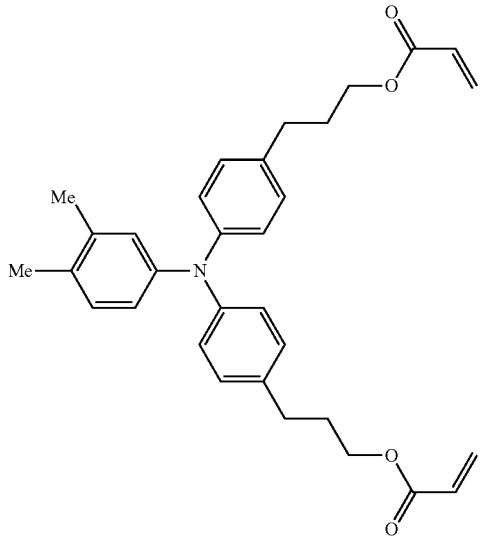

Compound (B)

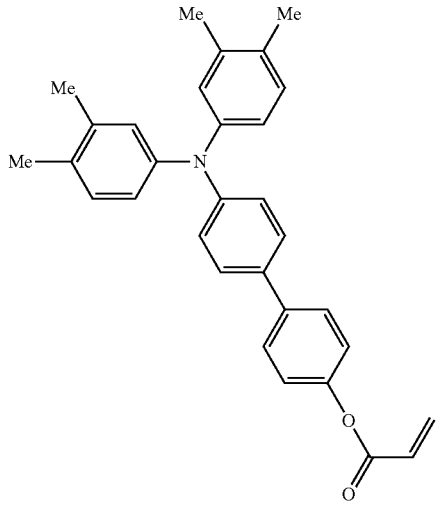

Additives

A-TMPT: Trimethylol propane triacrylate "A-TMPT (manufactured by Shin-nakamura Chemical Co., Ltd.)"

PTFE: fluorine resin particles "LUBRON L2 (manufactured by Daikin Industries, Ltd.)"

Polymerization Initiator

OTAZO-15: Thermal polymerization initiator "OTAZO-15 (manufactured by Otsuka Chemical Co., Ltd., molecular weight 354.4)"

V-601: Thermal polymerization initiator "V-601 (manufactured by Wako Pure Chemicals Industries, Ltd)"

IRGACURE 184: Photopolymerization initiator "IRGACURE 184 (manufactured by Ciba Specialty Chemicals Inc.)"

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention claimed is:

1. An electrophotographic photoreceptor comprising:

a conductive substrate;

a photosensitive layer provided on the conductive substrate; and an outermost surface layer provided on the photosensitive layer, wherein:

the outermost surface layer comprises a polymerized product or a crosslinked product of a composition including:

at least one reactive compound selected from compounds represented by formula (II), and a non-reactive charge transporting material;

a content of the non-reactive charge transporting material in the composition is from 5% by weight to 40% by weight based on the weight of the outermost surface layer; and a content of the unreacted reactive compound in the outermost surface layer after formation of the outermost surface layer is 3% by weight or less based on the weight of the outermost surface layer, (II)

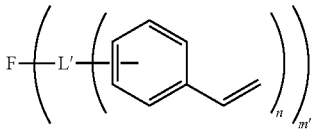

wherein in formula (II), F represents a charge transporting skeleton; L' represents an (n+1)-valent linking group including two or more selected from the group consisting of a trivalent or tetravalent group derived from an alkane or an alkene, an alkylene group, an alkenylene group, —C(=O)—, —N(R)—, —S—, and —O—; R represents a hydrogen atom, an alkyl group, an aryl group, or an aralkyl group; m' represents an integer of 1 to 6; and n represents an integer of 2 to 3.

2. The electrophotographic photoreceptor according to claim 1, wherein the group linked to the charge transporting skeleton represented by F of the compound represented by the formula (II) is a group represented by the following formula (IIA-a3) or (IIA-a4):

(IIA-a3)

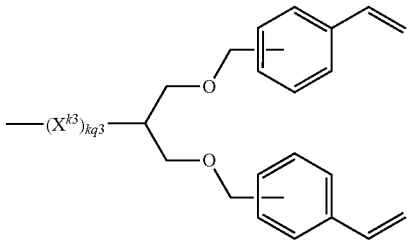

-continued (IIA-a4)

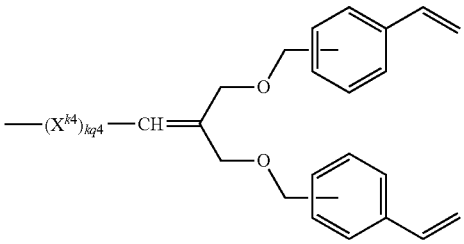

wherein in the formula (IIA-a3) or (IIA-a4), $X^{k3}$ represents a divalent linking group; kq3 represents an integer of 0 or 1; $X^{k4}$ represents a divalent linking group; and kq4 represents an integer of 0 or 1.

3. The electrophotographic photoreceptor according to claim 1, wherein the compound represented by the formula (II) is a compound represented by the following formula (II-a):

(II-a)

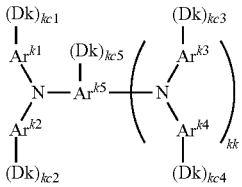

wherein in the formula (II-a), $Ar^{k1}$ to $Ar^{k4}$ each independently represent a substituted or unsubstituted aryl group; Ar represents a substituted or unsubstituted aryl group, or a substituted or unsubstituted arylene group; Dk represents a group represented by the following formula (IIA-a); kc1 to kc5 each independently represent an integer of 0 to 2; And kk represents 0 or 1; provided that the total number of Dk is from 1 to 8:

(IIA-a)

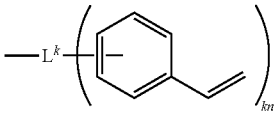

wherein in the formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—; R represents a hydrogen atom, an alkyl group, an aryl group, or an aralkyl group; and kn represents an integer of 2 to 3.

4. The electrophotographic photoreceptor according to claim 1, wherein the group linked to the charge transporting skeleton represented by F of the compound represented by the formula (II) is a group represented by the following formula (IIA-a1) or (IIA-a2):

(IIA-a1)

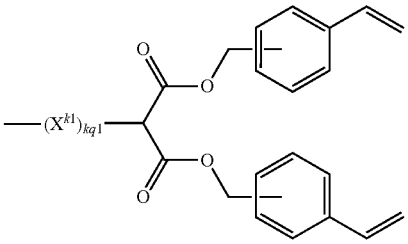

(IIA-a2)

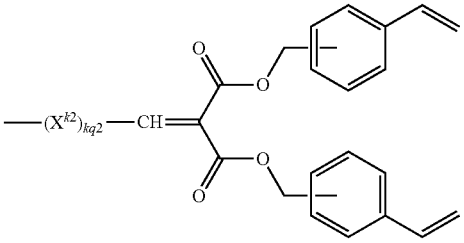

wherein in the formula (IIA-a1) or (IIA-a2), $X^{k1}$ represents a divalent linking group; kq1 represents an integer of 0 or 1; $X^{k2}$ represents a divalent linking group; and kq2 represents an integer of 0 or 1.

5. The electrophotographic photoreceptor according to claim 1, wherein the outermost surface layer further comprises resin particles.

6. The electrophotographic photoreceptor according to claim 5, wherein the resin particles are particles of at least one resin selected from the group consisting of an ethylene tetrafluoride resin, an ethylene trifluorochloride resin, an ethylenepropylene hexafluoride resin, a vinyl fluoride resin, a vinylidene fluoride resin, an ethylene dichlorodifluoride resin, and a copolymer thereof.

7. The electrophotographic photoreceptor according to claim 1, further comprising a lower layer that is in contact with the outermost surface layer and that is configured to include a non-reactive charge transporting material and a polycarbonate copolymer having a solubility parameter as calculated by a Feders method of from 11.40 to 11.75.

8. The electrophotographic photoreceptor according to claim 7, wherein the polycarbonate copolymer has repeating structural units having a solubility parameter as calculated by a Feders method of from 12.2 to 12.4.

9. The electrophotographic photoreceptor according to claim 7, wherein the polycarbonate copolymer has repeating structure units represented by the following formula (PC-1):

(PC-1)

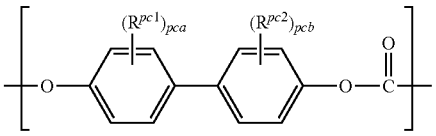

wherein in the formula (PC-1), $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms; and pca and pcb each independently represent an integer of 0 to 4.

10. The electrophotographic photoreceptor according to claim 9, wherein a ratio of the repeating structure units represented by the formula (PC-1) is from 20% by mole to 40% by mole based on the polycarbonate copolymer.

11. The electrophotographic photoreceptor according to claim 7, wherein the polycarbonate copolymer has repeating structure units represented by the following formula (PC-2):

(PC-2)

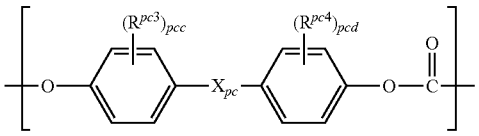

wherein in the formula (PC-2), $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms; pcc and pcd each independently represent an integer of 0 to 4; and $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α,ω-alkylene group having 2 to 10 carbon atoms, —O—, —S—, —SO—, or —$SO_2$—.

12. The electrophotographic photoreceptor according to claim 11, wherein a ratio of the repeating structure units represented by the formula (PC-2) is from 35% by mole to 55% by mole based on the polycarbonate copolymer.

13. A process cartridge comprising the electrophotographic photoreceptor according to claim 1, which is detachable from an image forming apparatus.

14. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor with a developer including a toner to form a toner image; and a transfer unit that transfers the toner image onto a transfer medium.

15. The electrophotographic photoreceptor according to claim 1, wherein the at least one reactive compound is selected from compounds represented by formula (I) and the compounds represented by formula (II), (I)

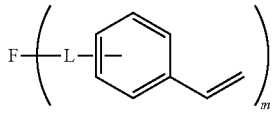

wherein in the formula (I), F represents a charge transporting skeleton; L represents a divalent linking group including two or more selected from the group consisting of an alkylene group, an alkenylene group, —C(═O)—, —N(R)—, —S—, and —O—; R represents a hydrogen atom, an alkyl group, an aryl group, or an aralkyl group; and m represents an integer of 1 to 8.

16. The electrophotographic photoreceptor according to claim 15, wherein L in formula (I) is selected from the group consisting of —$(CH_2)_p$—C(═O)—O—$(CH_2)_q$—, —$(CH_2)_p$—O—C(═O)—$(CH_2)_r$—C(═O)—O—$(CH_2)_q$—, —$(CH_2)_p$—C(═O)—N(R)—$(CH_2)_q$—, —$(CH_2)_p$—C(═O)—S—$(CH_2)_q$—, and —$(CH_2)_p$—S—$(CH_2)_q$—; p represents 0 or an integer of 1 to 6, q represents an integer of 1 to 6, and r represents an integer of 1 to 6.

* * * * *